US011597200B2

(12) United States Patent
Donnert et al.

(10) Patent No.: US 11,597,200 B2
(45) Date of Patent: Mar. 7, 2023

(54) SHEET PROCESSING MACHINE, METHOD FOR INSPECTING AT LEAST ONE REMAINING PORTION OF AT LEAST ONE SHEET PROCESSED BY A SHAPING DEVICE, AND METHOD FOR INSPECTING A SHEET

(71) Applicant: KOENIG & BAUER AG, Würzburg (DE)

(72) Inventors: Michael Donnert, Würzburg (DE); Bastian Deppisch, Karlstadt (DE); Elmar Klüpfel, Kleinrinderfeld (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/606,210

(22) PCT Filed: Mar. 11, 2020

(86) PCT No.: PCT/EP2020/056486
§ 371 (c)(1),
(2) Date: Oct. 25, 2021

(87) PCT Pub. No.: WO2020/216521
PCT Pub. Date: Oct. 29, 2020

(65) Prior Publication Data

US 2022/0143967 A1 May 12, 2022

(30) Foreign Application Priority Data

Apr. 26, 2019 (DE) ..... 10 2019 110 853.5

(51) Int. Cl.
*B41F 19/00* (2006.01)
*B26D 5/00* (2006.01)
(Continued)

(52) U.S. Cl.
CPC ..... *B41F 19/008* (2013.01); *B26D 5/007* (2013.01); *B26F 1/0092* (2013.01); *B26F 1/10* (2013.01); *B26F 1/38* (2013.01); *B41F 33/16* (2013.01)

(58) Field of Classification Search
CPC ..... B41F 19/008; B41F 33/16; B26D 5/007; B26D 7/27; B26F 1/10; B26F 1/38; B26F 1/0092
See application file for complete search history.

(56) References Cited

U.S. PATENT DOCUMENTS

2005/0000842 A1* 1/2005 Timmerman ..... B26D 5/32 53/399
2006/0191426 A1* 8/2006 Timmerman ..... B26F 1/384 101/24

(Continued)

FOREIGN PATENT DOCUMENTS

CN 1400097 A 3/2003
CN 101393141 A 3/2009

(Continued)

OTHER PUBLICATIONS

International Search Report of PCT/EP2020/056486 dated Jun. 16, 2020.

(Continued)

*Primary Examiner* — David H Banh
(74) *Attorney, Agent, or Firm* — Mattingly & Malur, PC

(57) ABSTRACT

A sheet-processing machine has a shaping device for processing sheets. The shaping device has at least one shaping point. The sheet-processing machine comprises at least one separating device. The at least one separating device is designed to remove at least one remaining piece from at least one sheet of the sheets. The at least one separating device is arranged downstream of the at least one shaping point along a transport path provided for transporting the sheets. At least (Continued)

one inspection device is arranged, downstream of the separating device in the transport direction of the sheets, to determine an actual state of the at least one sheet of the sheets. The invention additionally relates to a method for inspecting at least one remaining part of at least one sheet of sheets, which part has been processed by a shaping device, and to a method for inspecting at least one sheet of sheets.

26 Claims, 12 Drawing Sheets

(51) Int. Cl.

| | |
|---|---|
| ***B26F 1/00*** | (2006.01) |
| ***B26F 1/10*** | (2006.01) |
| ***B26F 1/38*** | (2006.01) |
| ***B41F 33/16*** | (2006.01) |

(56) References Cited

U.S. PATENT DOCUMENTS

| | | | | |
|---|---|---|---|---|
| 2017/0320182 | A1* | 11/2017 | Jeong | B23Q 17/098 |
| 2020/0240926 | A1* | 7/2020 | Pauchard | G01N 21/8901 |

FOREIGN PATENT DOCUMENTS

| | | | |
|---|---|---|---|
| CN | 102917879 | A | 2/2013 |
| CN | 105793179 | A | 7/2016 |
| CN | 107548358 | A | 1/2018 |
| DE | 19653927 | C1 | 4/1998 |
| DE | 102007033544 | A1 | 2/2008 |
| DE | 102012023391 | A1 | 6/2014 |
| DE | 102017208744 | A1 | 11/2017 |
| EP | 1759845 | A2 | 3/2007 |
| EP | 1844865 | A1 | 10/2007 |
| EP | 1727679 | B1 | 10/2008 |
| EP | 2080600 | A1 | 7/2009 |
| EP | 2407402 | A2 | 1/2012 |
| EP | 2589494 | A1 | 5/2013 |
| EP | 3064327 | A1 | 9/2016 |
| JP | H07165212 | A | 6/1995 |
| JP | H11300853 | A | 11/1999 |
| JP | 2006053080 | A | 2/2006 |
| JP | 2008012778 | A | 1/2008 |
| WO | 2004/108428 | A2 | 12/2004 |
| WO | 2017/089422 | A2 | 6/2017 |
| WO | 2019/034289 | A2 | 2/2019 |

OTHER PUBLICATIONS

Japanese Office Action received in corresponding Japanese Application No. 2021-563412 dated Jun. 1, 2022.

Chinese Office Action received in corresponding Chinese Application No. 202080031533.X dated Jan. 29, 2022.

* cited by examiner

SHEET PROCESSING MACHINE, METHOD FOR INSPECTING AT LEAST ONE REMAINING PORTION OF AT LEAST ONE SHEET PROCESSED BY A SHAPING DEVICE, AND METHOD FOR INSPECTING A SHEET

CROSS-REFERENCE TO RELATED APPLICATIONS

This application is the US national phase, under 35 USC § 371, of PCT/EP 2020/056486, filed Mar. 11, 2020; published as WO 2020/216521 A1 on Oct. 29, 2020, and claiming priority to DE 10 2019 110 853.5, filed Apr. 26, 2019, the disclosures of which are expressly incorporated herein in their entireties by reference.

FIELD OF THE INVENTION

The present invention relates to a sheet processing machine. The sheet processing machine comprises a shaping device for processing sheets, the shaping device including at least one shaping point. The sheet processing machine also comprises at least one separation device, the at least one separation device being configured to remove at least one off cut piece from at least one sheet of the sheets, the at least one separation device being arranged downstream from the at least one shaping point along the transport path provided for the transport of sheets. A method is provided and relates to inspecting at least one remaining portion of at least one sheet processed by a shaping device. In a method for inspecting at least one remaining portion of at least one sheet of sheets being processed by the shaping device, in the sheet processing machine, the at least one sheet including at least one multiple-up of the at least one sheet being processed in the at least one shaping device of the shaping machine, at least one off cut piece is removed from the at least one sheet downstream from the shaping device in the transport direction of the sheets, the at least one off cut piece being removed from the at least one sheet by at least one separation device. A further method also relates to inspecting a sheet. In the method for inspecting at least one sheet of sheets, by way of the at least one inspection device in a sheet processing machine, the at least one sheet is detected by the inspection device including at least two multiple ups, and at least one sheet opening.

BACKGROUND OF THE INVENTION

A flat-bed die-cutting machine comprising an inspection device for monitoring the substrate for register errors and a sheet diverter for channeling out defective sheets is known from EP 3 064 327 A1.

A box production device comprising an inspection device for detecting the position of a slot, generated by a die-cutting device on a sample sheet, is known from EP 2 589 494 A1.

A method for identifying a single multiple-up copy, containing a print image of defective quality, on a printing substrate comprising several multiple-up copies is known from EP 1 727 679 B1. An inspection system records a picture of the printing substrate and compares data of the recorded image to a data set derived from stored data regarding the shape of the individual multiple-ups on the printing substrate.

A method for controlling, by closed-loop control, cut-off registers or color registers at a printing press is known from EP 1 759 845 A2. An actual value of a sheet, measured by an inspection device, is compared to a prepress-based desired value, and an actuating signal is ascertained based on the ascertained control deviation.

A device for checking the quality of a product composed of two corrugated cardboard portions is known from WO 2019/034289 A1, wherein the corrugated cardboard portions are connected to one another by a slot. The device comprises two cameras, each of which detects the slot of one side of the product in the delivery pile, and an evaluation device, which ascertains a deviation of the position of the slot from one side of the product relative to the other side.

EP 1 844 865 A1 shows an inspection system in a single-object sorting device comprising a cutting device and an identification sensor. A print sheet comprising multiple individual objects is divided into multiple individual objects by the cutting device. The identification sensor detects individual markings, whereupon a sorting decision for activating the diverter is made in a sorting electronics system.

DE 10 2012 023 391 A1 shows a device for printing a paper or film web using a die cutter for die cutting individual multiple-ups from the film and an ejector station. An inspection system is arranged between the die cutter and the ejector station, which detects and reads out a previously applied code that is assigned to a print image. A comparison of the read-out code controls an ejection of the die-cut multiple-up.

DE 196 53 927 C1 discloses a sheet processing machine comprising transverse and longitudinal cutting devices, inspection devices and a delivery device. A first inspection device checks the sheet for damage. A second inspection device inspects the front side of the sheet and a fresh edge of the sheet resulting from the trimmed end. A third inspection device inspects the back side and trimmed edges in the longitudinal direction and the trailing end of the sheet.

WO 2004/108428 A2 discloses a processing machine for producing bundled printed sheet articles. The processing machine comprises a rotary die-cutting device for processing substrate, downstream from which the articles are separated from a waste matrix. One or more inspection devices can be arranged along the transport path of the substrate.

DE 10 2017 208 744 A1 discloses a sheet printing machine comprising printing couples and a shaping unit that is configured as a shaping device and comprises a dedicated drive controllable by open-loop and/or closed-loop control. An inspection device for monitoring the print quality is arranged downstream from the printing couples.

SUMMARY OF THE INVENTION

It is the object of the present invention to devise a sheet processing machine, a method for inspecting at least one remaining portion of at least one sheet processed by a shaping device, and a method for inspecting a sheet.

The object is achieved according to the present invention by the provision that at least one inspection device is configured to ascertain an actual state of the at least one sheet of the sheets downstream from the separation device in the transport direction (T) of the sheets. The at least one inspection device ascertains an actual state of the at least one sheet downstream from the separation device in the transport direction (T), and the actual state of the at least one sheet is compared to a desired state of the at least one sheet. The at least one inspection device ascertains the actual state of the at least one sheet of the sheets downstream from the separation device in the transport direction (T) of the sheets.

A sheet processing machine preferably comprises a shaping device for processing sheets. The shaping device preferably comprises at least one shaping point. The sheet processing machine preferably comprises at least one separation device. The separation device is preferably configured to remove at least one offcut piece from at least one sheet. The separation device is preferably configured to remove the at least one offcut piece from the at least one sheet. The at least one separation device is preferably arranged along a transport path provided for the transport of the sheets, downstream from the at least one shaping point. In the transport direction of the sheets downstream from the separation device, at least one inspection device is preferably configured to ascertain an actual state of the at least one sheet of the sheets. At least one inspection device for inspecting at least one remaining portion of the at least one sheet processed by the shaping device, comprising at least one multiple-up, is preferably arranged in the transport direction of the sheets downstream from the separation device.

A method for inspecting the at least one remaining portion of the at least one sheet of sheets which is processed by the shaping device in the sheet processing machine is preferred. The at least one sheet comprises at least one multiple-up. The at least one sheet is preferably processed in the at least one shaping device of the sheet processing machine. At least one offcut piece is preferably removed from the at least one sheet downstream from the shaping device in the transport direction of the sheets. The at least one offcut piece is preferably removed from the at least one sheet by at least one separation device. The at least one inspection device preferably ascertains an actual state of the at least one sheet downstream from the separation device in the transport direction. The actual state of the at least one sheet is compared to a desired state of the at least one sheet.

As an alternative or in addition, a method for inspecting at least one sheet of sheets by way of at least one inspection device in a sheet processing machine is preferred. The at least one sheet detected by the inspection device preferably comprises at least two multiple-ups and at least one sheet opening. The at least one inspection device preferably ascertains an actual state of the at least one sheet. The actual state of the at least one sheet is compared to a desired state of the at least one sheet.

This yields the advantage that remaining offcut pieces and/or portions of remaining offcut pieces can be easily removed from the sheets, downstream from the shaping device in the transport direction of the sheets, by at least one separation transport means and/or by the separation device, in particular by gravity and, additionally or alternatively, by at least one preferred embodiment of the separation device and/or of the separation transport means and, additionally or alternatively, by preferred embodiments of the separation device and/or of the separation transport means. If offcut pieces and/or portions of offcut pieces remain in the sheet downstream from the separation device in the transport direction of the sheets, these at least partially remaining offcut pieces can cause problems during the further course of the treatment and/or of the transport of the sheets along a transport path of sheets in the transport direction, for example when the delivery pile is formed. By detecting the respective sheet by way of the inspection device, it is possible to identify relevant sheets with at least one partially remaining offcut piece and, for example, to additionally divert them from the regular transport path and/or, for example, to separate them from sheets without at least partially remaining offcut pieces. In particular, the relevant sheets are advantageously identified and diverted and/or separated from sheets without at least partially remaining offcut pieces. In this way, the process reliability of the sheet processing machine is increased.

Advantageously, the comparison of the actual state of the respective, preferably the at least one, sheet to the desired state of the relevant, preferably the at least one, sheet is used to inspect the processing operation of the particular sheet by the shaping device, for example at least one die cutting operation and/or at least one creasing operation and/or at least one embossment and/or at least one perforation. In addition, or as an alternative, the comparison of the actual state of the respective, preferably the at least one, sheet to the desired state of the relevant, preferably the at least one, sheet is used to inspect and/or check a removal, preferably a complete removal, of at least one offcut piece and/or of an at least partially present offcut piece from the sheet in question.

The sheets are preferably inspected within the sheet processing machine, in particular without at least one sheet being removed and/or having to be removed, for example randomly, for the inspection from the sheet processing machine. As an alternative, the sheets are inspected outside the sheet processing machine, preferably after at least one processing operation of the sheets in the sheet processing machine.

The sheets are preferably inspected downstream from the separation device, in particular immediately following the separation device. In this way, it is preferably ensured that the sheet is inspected after the respective sheet has been processed by the shaping device and after the at least one offcut piece has been removed. It is preferably possible to identify a defective sheet, for example upstream from a further processing device, for example a separation of the individual multiple-ups and/or upstream from a delivery unit, arranged downstream from the separation device in the transport direction, and, for example, to channel it out upstream from the further processing device and/or upstream from the delivery unit in the transport direction.

As a result of a preferably orthogonal arrangement of the inspection device with respect to the transport path provided for the transport of sheets, sheets can preferably be inspected without the transport of sheets being at least partially impaired along the transport path.

In a preferred embodiment, the sheet processing machine comprises the at least one delivery unit. The sheet processing machine preferably comprises at least one sheet diverter for channeling out at least one sheet. The at least one sheet diverter is preferably configured to channel out at least one sheet. The at least one sheet diverter is preferably configured to generate a change of the transport path provided for the transport of sheets. Sheets can then preferably be sorted out and/or removed for sampling purposes, preferably without influencing a delivery pile and/or further treatment and/or processing of the sheets along the transport path.

In a preferred embodiment, data about the respective transported sheets can be stored and, for example, a report about the quality of the sheets can be created and be evaluated. In particular, the data is preferably stored and, for example, the report is created and evaluated. The inspection device is preferably configured to store and evaluate data about the at least one sheet and respective further transported sheets and to create at least one report about a quality of the respective transported sheets. It is thus possible, for example, to exactly set, and preferably to guarantee, a desired and/or required quality of the sheets processed by the shaping machine, for example in a delivery pile of the delivery unit.

A preferred embodiment of the sheet processing machine enables particularly gentle and/or exact guidance of sheets along the transport path. The sheets can preferably be transported flat, the sheets are, in particular, transported flat, and are protected in the process. In a preferred embodiment, the sheets are at least partially transported in a hanging state in the sheet processing machine. Preferably, at least one transport means configured as a selective transport means, which is preferably configured for the hanging transport of sheets, is arranged along the transport path of sheets, following the at least one separation transport means. The transport means, which is preferably configured as a selective transport means, is preferably configured to transport the sheets in a hanging state. Advantageously, a preferred embodiment of the sheet processing machine protects at least one print image applied to the sheet, which is preferably applied to the relevant sheet from beneath, during the transport of the respective sheet. Another advantage is preferably that a hanging guidance of sheets allows the selective transport means and/or the separation transport means to be easily maintained from beneath, even in the case of large working widths. Gentle handling of sheets is in particular advantageous in connection with corrugated cardboard.

In an advantageous embodiment, at least one imbricating device, which comprises at least one transport means configured as an upper suction transport means and/or as a sheet infeed means, is arranged between the at least one selective transport means and/or the at least one sheet diverter on one hand and the at least one sheet decelerating means on the other hand, along the transport path provided for the transport of sheets. Sheets having particularly large dimensions can thus be deposited and/or are deposited onto the delivery pile and/or can be deposited and/or are deposited in particularly rapid succession. As an alternative or in addition, the sheet processing machine is preferably characterized in that the at least one upper suction transport means of the at least one imbricating device is configured as a passively driven suction transport means. This facilitates imbrication and protects the sheets. Another advantage of an imbricating device is, in particular, that excessive accelerations of sluggish components are not necessary.

This allows energy to be saved and wear and tear to be reduced and/or saves energy and reduces wear and tear, for example. Another advantage is that a succeeding sheet can at least partially overtake and/or, for example, be configured to overtake a leading sheet, thereby enabling relatively smooth movements of the sheets.

Preferably, a degree of tool wear of at least one tool of the at least one shaping device is ascertained, in particular from the comparison of the actual state of the at least one sheet to the desired state of the relevant, preferably the at least one, sheet. In this way, it is preferably possible to detect wear and/or tear of the tool at an early stage. It is preferably possible to replace the tool before it is entirely worn and/or completely torn and/or before the tool breaks. As an alternative, premature replacement of the tool, for example if the wear and/or tear is less than expected, can thus preferably be prevented and/or is prevented, for example.

Preferably, a degree of wear of at least one surface of at least one counterpressure cylinder of the at least one shaping device is ascertained, in particular from the comparison of the actual state of the at least one sheet to the desired state of the relevant, preferably the at least one, sheet. In this way, it is preferably possible to detect wear and/or tear of the surface of the counterpressure cylinder at an early stage. It is preferably possible to replace the surface of the counterpressure cylinder before it is entirely worn and/or completely torn. As an alternative, premature replacement of the surface of the counterpressure cylinder, for example if the wear and/or tear is less than expected, can thus preferably be prevented and/or is prevented, for example.

In a preferred embodiment, the sheet processing machine comprises at least one application mechanism for applying at least one print image to the at least one sheet. The at least one application mechanism is preferably configured to apply at least one print image to the at least one sheet. By way of the inspection device, in particular by way of an evaluation means, it is preferably possible to evaluate at least one color register of the at least one print image of the at least one sheet and/or to at least compare the at least one print image of the at least one sheet to at least one sheet opening and/or at least one inner contour and/or at least one outer contour of the particular sheet.

The sheet is preferably inspected with respect to the processing of the particular sheet by the shaping device and, additionally or alternatively, the at least one print image applied to the particular sheet and, additionally or alternatively, the at least one print image applied to the particular sheet relative to the at least one sheet opening and/or the at least one inner contour and/or the at least one outer contour of the particular sheet.

BRIEF DESCRIPTION OF THE DRAWINGS

Exemplary embodiments of the invention are illustrated in the drawings and will be described in greater detail below.

The drawings show.

DESCRIPTION OF PREFERRED EMBODIMENT

Figure 1:
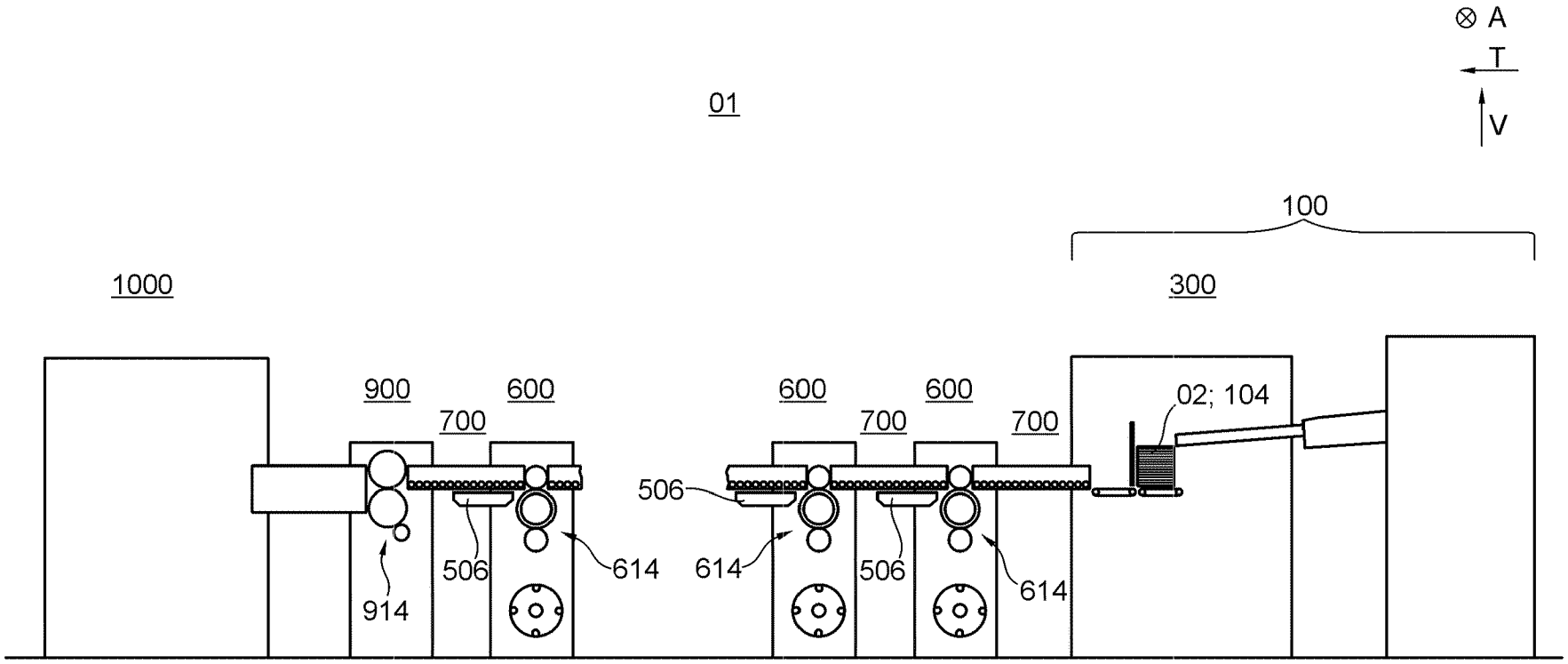
FIG. 1 a schematic representation of a sheet processing machine.
Figure 2:
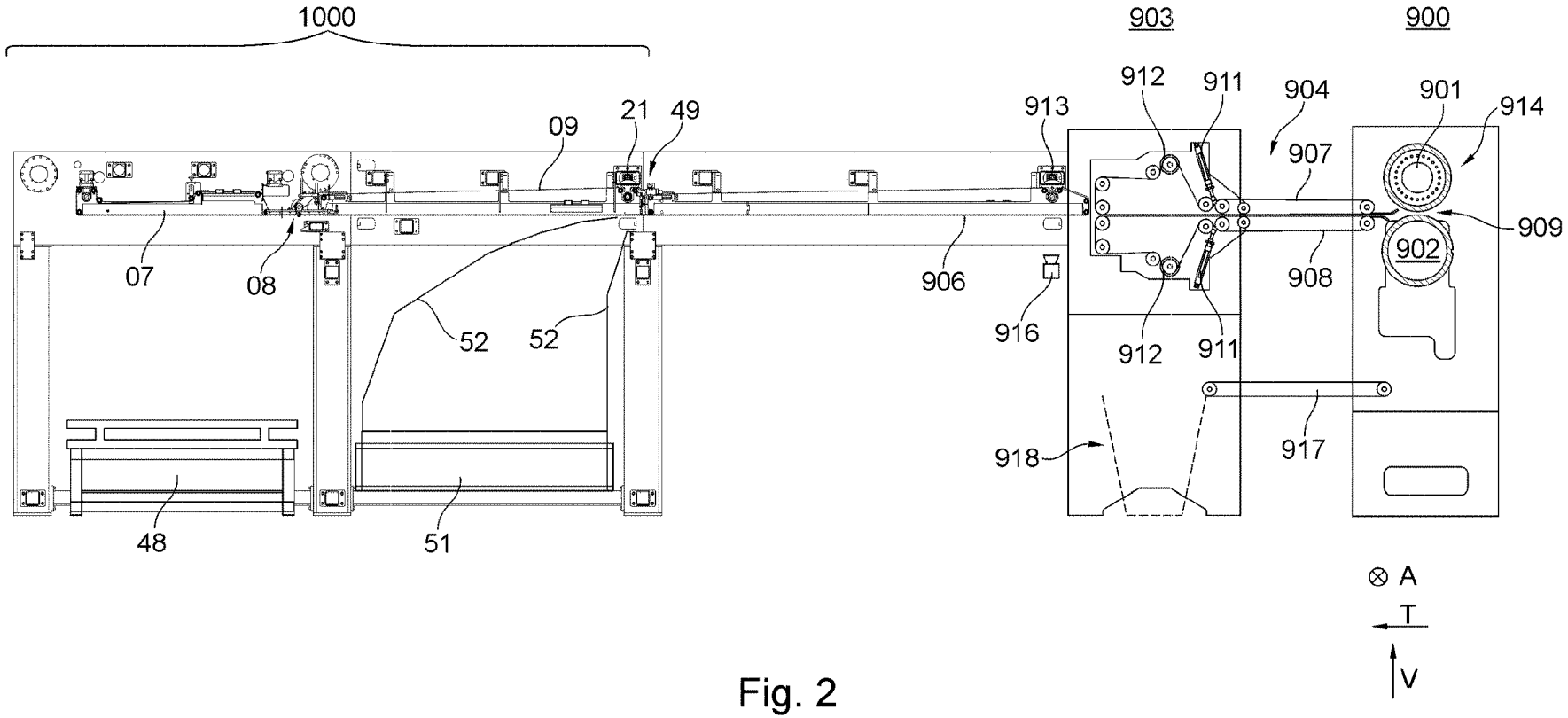
FIG. 2 a schematic representation of a shaping device and a sheet delivery unit.
Figure 3:
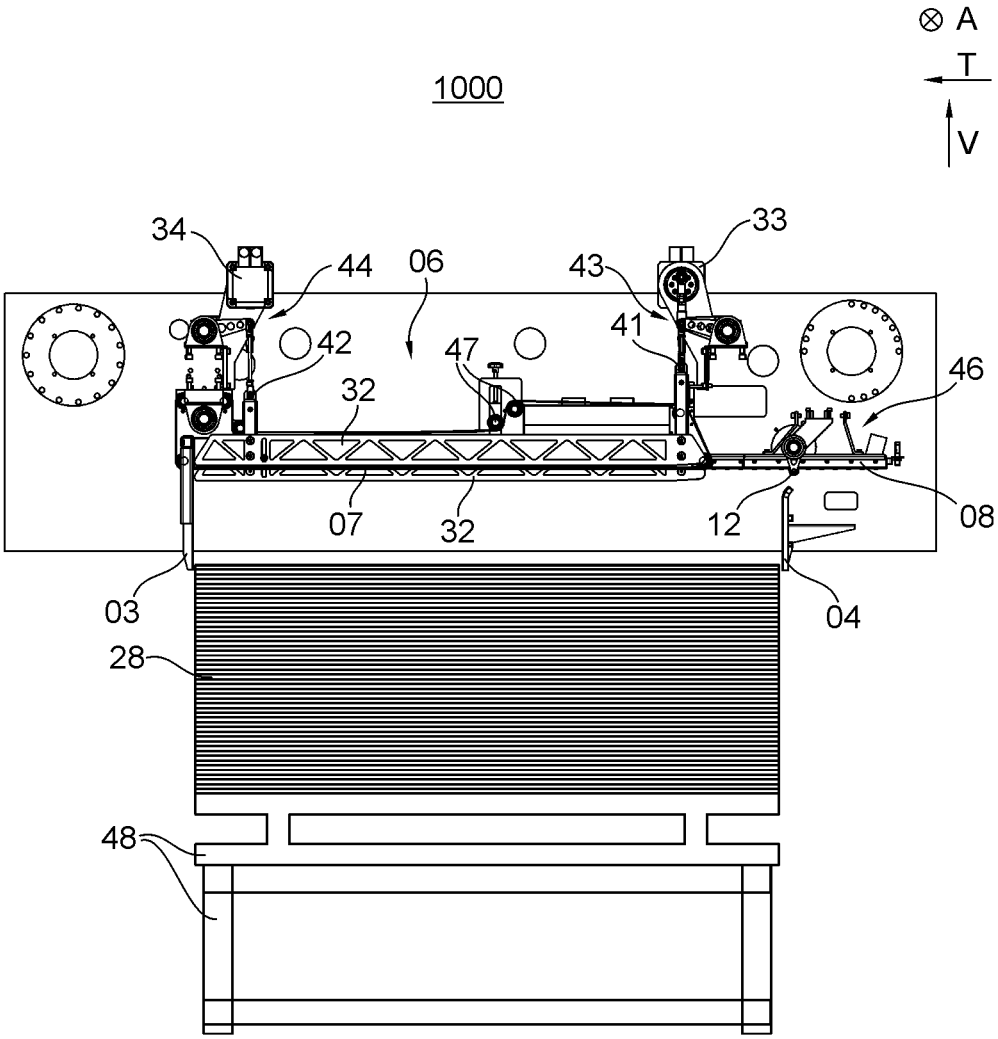
FIG. 3 a schematic representation of a section of a sheet delivery unit.
Figure 4A:
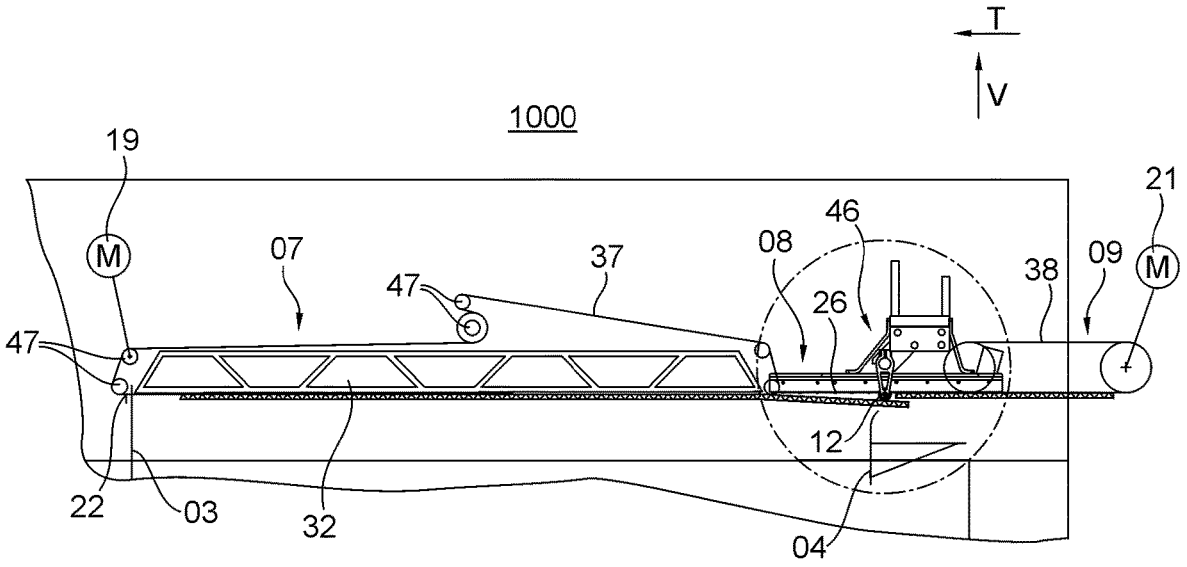
FIG. 4*a* a schematic representation of a section of a sheet delivery unit.
Figure 4B:
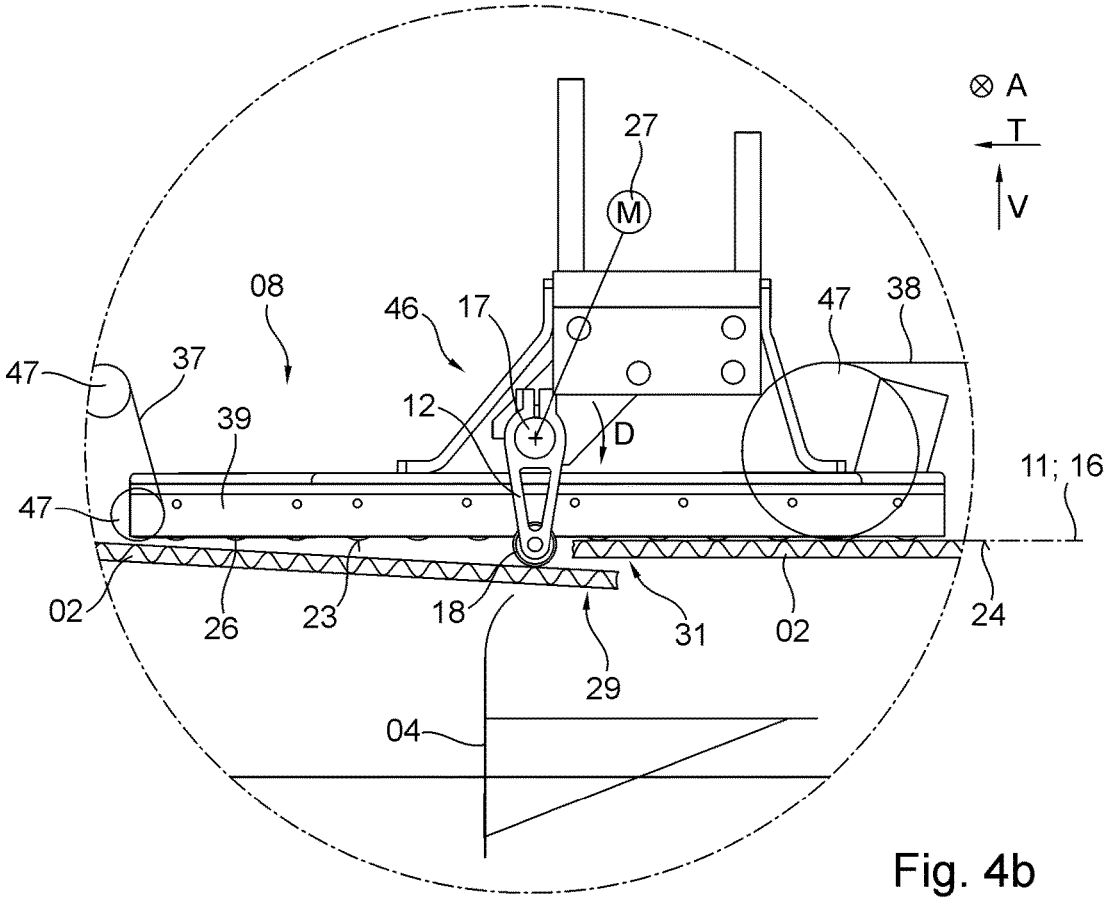
FIG. 4*b* a schematic representation of a detail from FIG. 4*a;*
Figure 5:
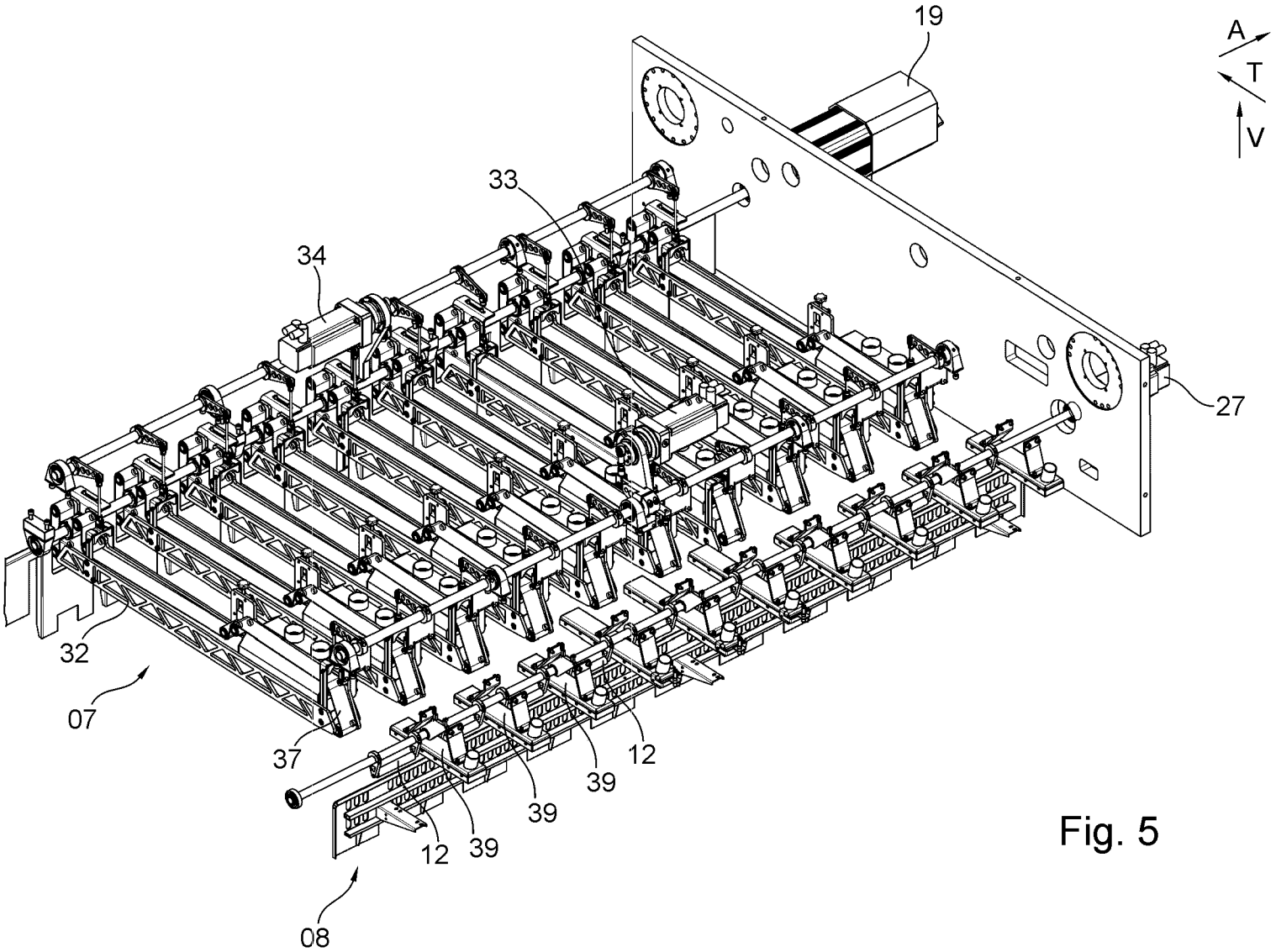
FIG. 5 a schematic representation of the section of the sheet delivery unit according to FIG. 3 in a perspective view.
Figure 6:
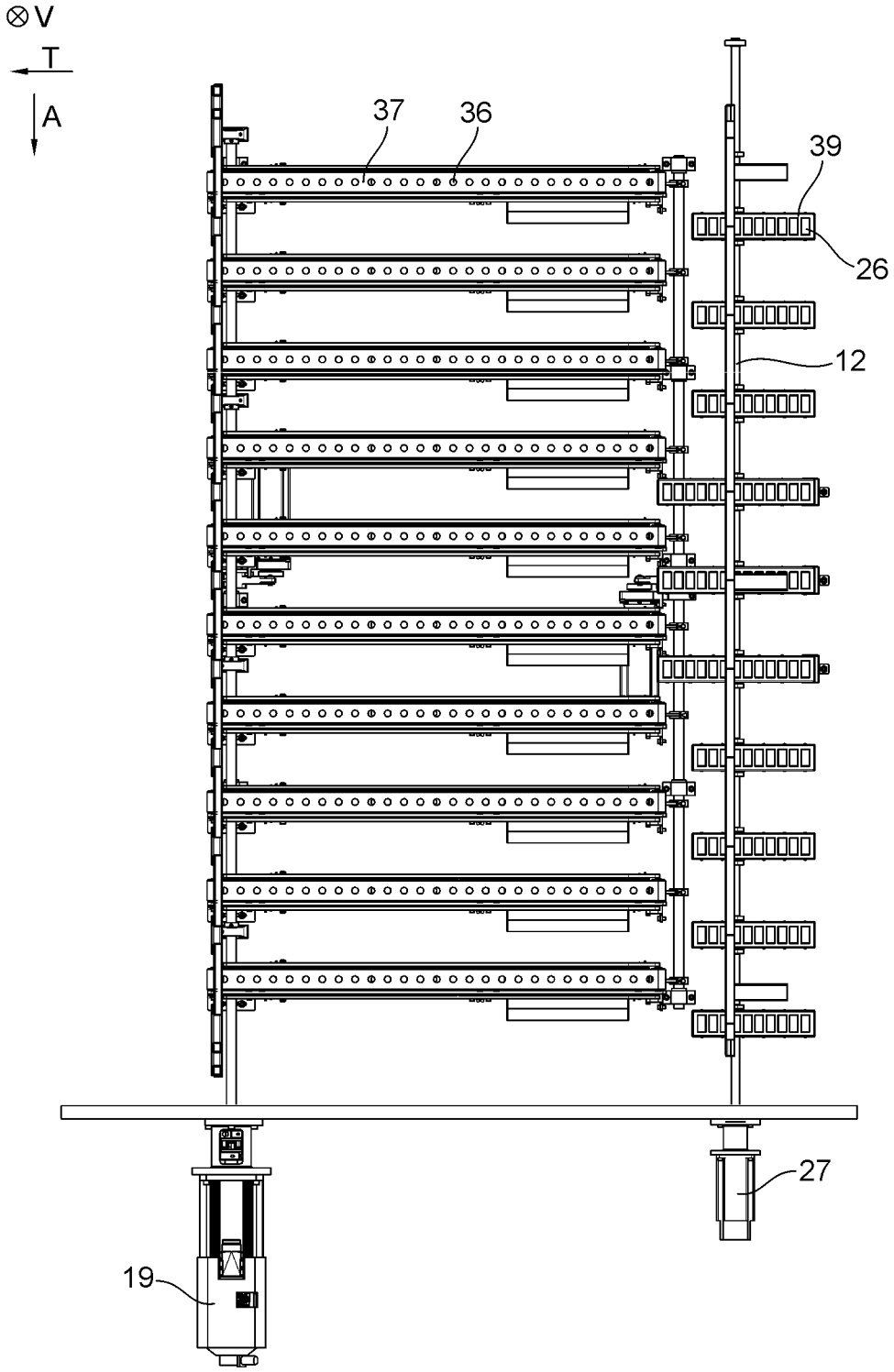
FIG. 6 a schematic representation of the section of the sheet delivery unit according to FIG. 3 in a view from beneath.
Figure 7:
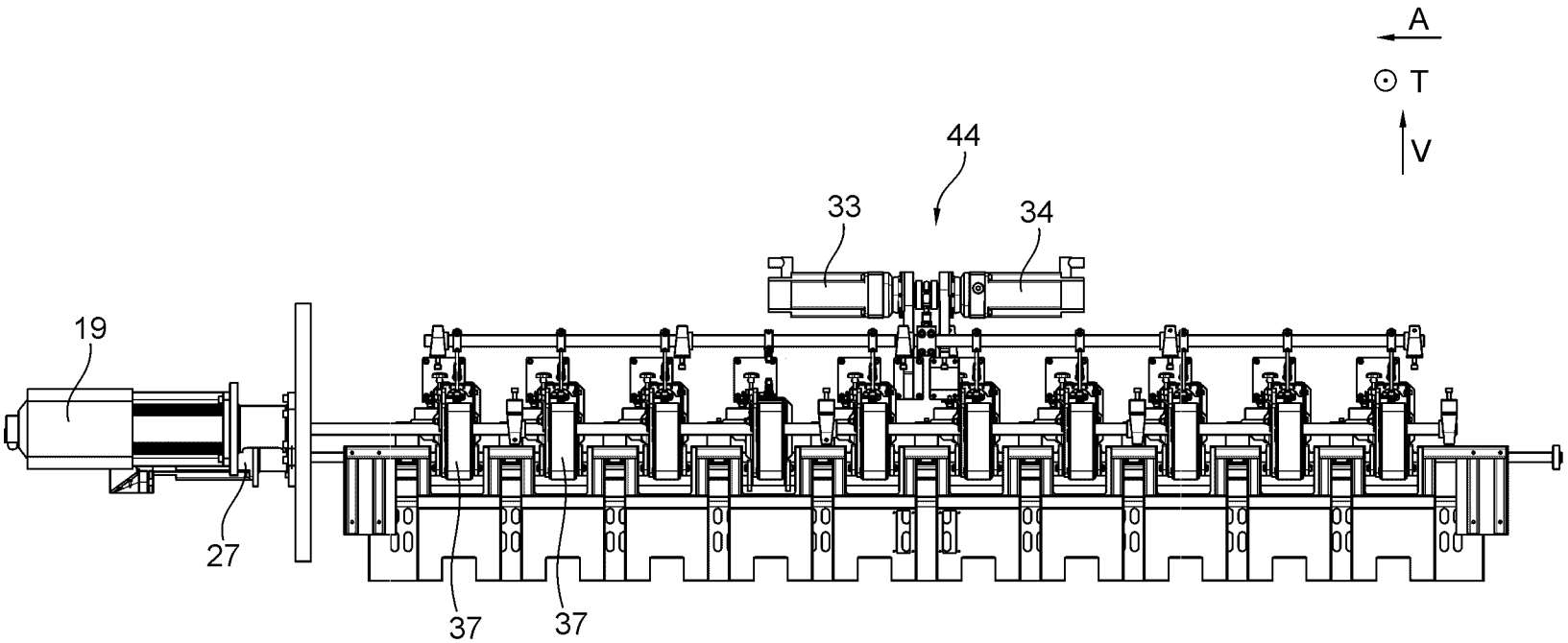
FIG. 7 a schematic representation of the section of the sheet delivery unit according to FIG. 3 in a view counter to a transport direction.

Above and below, the term application fluid covers inks and printing inks, but also primers, coating materials, and pasty materials. Application fluids are preferably materials that are transferred and/or can be transferred by a processing machine 01, in particular a printing press 01, or by at least one application mechanism 614 or a unit 600 configured as an application unit 600 of the processing machine 01, in particular at least one printing couple 614 or printing unit 600 of the printing press 01, onto a substrate 02, in particular a printing substrate 02, for example onto at least one sheet 02, thereby creating a preferably visible and/or perceptible, by sensory impressions, and/or machine detectable texture, preferably in finely structured form and/or not merely over a large surface area, on the substrate 02, in particular printing substrate 02. Inks and printing inks are preferably solutions or dispersions of at least one colorant in at least one solvent, for example water and/or organic solvent. As an alternative or in addition, the application fluid may be an application fluid that cures under UV light. Inks are relatively low viscosity application fluids, and printing inks are relatively high viscosity application fluids. Inks preferably contain no binding agent or relatively little binding agent, whereas printing inks preferably contain a relatively large amount of binding agent, and more preferably contain additional auxiliary substances. Above and below, when application fluids and/or inks and/or printing inks are mentioned, this in particular also includes colorless coating materials. Above and below, when application fluids and/or inks and/or printing inks are mentioned, this preferably also includes, in particular, agents for pretreating (priming or precoating) the printing substrate 02. The term printing fluid and the term coating agent shall be understood as synonymous alternatives to the term application fluid. A respective application fluid is preferably not gaseous. A respective application fluid is preferably liquid and/or powdered.

A processing machine 01 is preferably configured as a printing press 01 and/or as a shaping machine 01, in particular a die-cutting machine 01. The printing press 01 is configured as a flexo printing press 01, for example.

The processing machine 01 is preferably referred to as a printing press 01 when it comprises at least one printing couple 614 and/or at least one printing unit 600, in particular regardless of whether it comprises additional units for processing substrate 02. A processing machine 01 configured as a printing press 01 also comprises, for example, at least one additional such unit 900, for example at least one shaping unit 900, which is preferably configured as a die-cutting unit 900, more preferably as a die-cutting device 900. The processing machine 01 is preferably referred to as a shaping machine 01 if it comprises at least one shaping mechanism 914 and/or at least one shaping unit 900, in particular regardless of whether it comprises additional units 600 for processing substrate 02. The processing machine 01 is preferably referred to as a die-cutting machine 01 when it comprises at least one die-cutting mechanism 914 and/or at least one die-cutting unit 900 and/or at least one die-cutting device 900, in particular regardless of whether it comprises additional units 600 for processing substrate 02. A processing machine 01 configured as a shaping machine 01 or die-cutting machine 01 also comprises, for example, at least one additional unit 600 for processing substrate 02, for example at least one printing unit 600 and/or at least one printing couple 614.

In a preferred embodiment, the processing machine 01, in particular a sheet processing machine 01, preferably comprises a unit 100 configured as a sheet feeder 100 and/or at least one application mechanism 614 for applying at least one print image onto substrate 02. Thus, if the processing machine 01 comprises at least one printing couple 614 and/or at least one printing unit 600, and also comprises at least one shaping mechanism 914 and/or at least one shaping unit 900, it is configured both as a printing press 01 and as a shaping machine 01. If the processing machine 01 comprises at least one printing couple 614 and/or at least one printing unit 600, and also comprises at least one die-cutting mechanism 914 and/or at least one die-cutting unit 900 and/or at least one die-cutting device 900, it is accordingly configured both as a printing press 01 and as a shaping machine 01, in particular a die-cutting machine 01.

The processing machine 01 is configured as a sheet processing machine 01, i.e., as a processing machine 01 for processing sheet-format substrate 02 or sheets 02, in particular a sheet-format printing substrate 02. For example, the sheet processing machine 01 is configured as a sheet-fed printing press 01 and/or as a sheet-fed shaping machine 01 and/or as a sheet-fed die-cutting machine 01. The processing machine 01 is further preferably configured as a corrugated cardboard sheet processing machine 01, i.e., as a processing machine 01 for processing sheet-format substrate 02 or sheets 02 made of corrugated cardboard 02, in particular sheet-format printing substrate 02 made of corrugated cardboard 02. The processing machine 01 is further preferably configured as a sheet-fed printing press 01, in particular as a corrugated cardboard sheet printing press 01, i.e., as a printing press 01 for coating and/or printing sheet-format substrate 02 or sheets 02 made of corrugated cardboard 02, in particular sheet-format printing substrate 02 made of corrugated cardboard 02. The printing press 01 is configured as a printing press 01 that operates according to a printing forme-based printing method, for example.

Unless an explicit distinction is made, the term sheet-format substrate 02, in particular printing substrate 02, specifically sheet 02, shall generally include any flat substrate 02 present in the form of sections, i.e., including substrates 02 in tabular form or panel form, i.e., including boards or panels. The sheet-format substrate 02 or sheet 02 thus defined is made, for example, of paper or paperboard, i.e., as a sheet of paper or paperboard, or by sheets 02, boards, or optionally panels made of plastic, cardboard, glass, or metal. More preferably, the substrate 02 is corrugated cardboard 02, in particular corrugated cardboard sheets 02. The at least one sheet 02 is preferably configured as corrugated cardboard 02. A thickness of a sheet 02 shall preferably be understood to mean a dimension orthogonal to a largest surface area of the sheet 02. This largest surface area is also referred to as the main surface area. For example, the thickness of the sheets 02 is at least 0.1 mm, more preferably at least 0.3 mm, and still more preferably at least 0.5 mm. Considerably greater thicknesses are also customary, especially in the case of corrugated cardboard sheets 02, for example at least 4 mm or also 10 mm and more. Corrugated cardboard sheets 02 are relatively stable and are therefore not very flexible. Corresponding adjustments to the processing machine 01 therefore facilitate the processing of sheets 02 of great thickness.

The respective, preferably the at least one, sheet 02 is preferably made of paper or cardboard or paperboard. According to DIN 6730, paper is a flat material, consisting mainly of fibers derived from vegetable sources, which is formed by the dewatering of a fiber suspension on a sieve. In the process, a card web is created, which is subsequently dried. The basis weight of paper is preferably a maximum of 225 g/m$^2$. According to DIN 6730, cardboard is a flat material, consisting mainly of fibers derived from vegetable sources, which is formed by the dewatering of a fiber suspension on a sieve or between two sieves. The fiber structure is compressed and dried. Cardboard is preferably manufactured from cellulose by gluing or pressing. Cardboard is preferably configured as solid board or corrugated cardboard 02. Above and below, corrugated cardboard 02 is cardboard made of one or more layers of corrugated paper that is glued to one layer or between multiple layers of another, preferably smooth, paper or cardboard. The basis weight of cardboard is preferably more than 225 $g/m^2$. Above and below, the term paperboard preferably refers to a sheet material that is preferably primed on one side and made of paper, preferably having a basis weight of at least 150 $g/m^2$ and no more than 600 $g/m^2$. Paperboard preferably has high strength relative to paper.

The processing machine 01 preferably comprises multiple units 100; 300; 600; 700; 900; 1000. A unit in this context shall preferably be understood to mean a group of devices that cooperate functionally, in particular in order to carry out a preferably self-contained processing operation of sheets 02. At least two, for example, and preferably at least three, and more preferably all of the units 100; 300; 600; 700; 900; 1000 are configured as modules 100; 300; 600; 700; 900; 1000 or at least each is assigned to such a module. A module in this context shall in particular be understood to mean a respective unit or a structure made up of multiple units, which preferably comprises at least one transport means and/or at least a dedicated drive controllable by open-loop and/or closed-loop control, and/or as an independently functioning module and/or as an individually manufactured and/or separately assembled machine unit or functional assembly. A dedicated drive, controllable by open-loop and/or closed-loop control, of a unit or module shall in particular be understood to mean a drive that is used to power the movements of components of this unit or module and/or that is used to transport substrate 02, in particular sheets 02, through this particular unit or module and/or through at least one processing zone of this particular unit or module and/or that is used to directly or indirectly drive at least one component of the particular unit or module that is intended for contact with sheets 02. The dedicated drive of a unit or module which can be controlled by open-loop and/or closed-loop control is preferably configured to power movements of components of this unit or module and/or configured to effect a transport of substrate 02 and/or configured to directly or indirectly drive at least one component of the particular unit or module which is intended for contact with sheets 02. These drives of the units 100; 300; 600; 700; 900; 1000 of the processing machine 01 are preferably embodied, in particular, as closed loop position-controlled electric motors.

Each unit 100; 300; 600; 700; 900; 1000 preferably comprises at least one drive control system and/or at least one drive controller, which is assigned to the respective at least one drive of the particular unit 100; 300; 600; 700; 900; 1000. The drive control systems and/or drive controllers of the individual units 100; 300; 600; 700; 900; 1000 can preferably be operated individually and independently of one another. More preferably, the drive control systems and/or drive controllers of the individual units 100; 300; 600; 700; 900; 1000 are linked and/or can be linked in terms of circuitry, in particular by means of at least one BUS system, to one another and/or to a machine control system of the processing machine 01 in such a way that coordinated open-loop and/or closed-loop control of the drives of multiple or all units 100; 300; 600; 700; 900; 1000 of the processing machine 01 is and/or can be carried out. Accordingly, the individual units 100; 300; 600; 700; 900; 1000 and/or in particular modules 100; 300; 600; 700; 900; 1000 of the processing machine 01 can be and/or are operated preferably electronically synchronized with one another, at least with respect to their drives, in particular by means of at least one electronic master axis. For this purpose, an electronic master axis is preferably specified, for example by a higher-level machine control system of the processing machine 01. As an alternative or in addition, the individual units 100; 300; 600; 700; 900; 1000 of the processing machine 01 are and/or can be mechanically synchronized with one another, for example, at least with respect to their drives. Preferably, however, the individual units 100; 300; 600; 700; 900; 1000 of the processing machine 01 are mechanically decoupled from one another, at least with respect to their drives.

The spatial area provided for transporting substrate 02, which the substrate 02, if present, at least temporarily occupies, is the transport path. The transport path is preferably defined by at least one device for guiding the substrate 02 in an operating state of the processing machine 01. Unless described otherwise, each of the units 100; 300; 600; 700; 900; 1000 of the processing machine 01 is preferably characterized in that the section of a transport path provided for a transport of sheets 02, which is defined by the respective unit 100; 300; 600; 700; 900; 1000, is at least substantially flat, and more preferably completely flat. A substantially flat section of the transport path provided for the transport of sheets 02 in this context shall be understood to mean a section that has a minimum radius of curvature of at least 2 meters, more preferably at least 5 meters, and still more preferably at least 10 meters, and still more preferably at least 50 meters. A completely flat section has an infinitely large radius of curvature and is thus likewise substantially flat and therefore likewise has a minimum radius of curvature of at least 2 meters. Unless described otherwise, each of the units 100; 300; 600; 700; 900; 1000 of the processing machine 01 is preferably characterized in that the section of the transport path provided for the transport of sheets 02, which is defined by the respective unit 100; 300; 600; 700; 900; 1000, extends at least substantially horizontally, and more preferably exclusively horizontally. This transport path preferably extends in a direction T, in particular in the transport direction T. A substantially horizontal transport path provided for the transport of sheets 02 means, in particular, that within the entire area of the particular unit 100; 300; 600; 700; 900; 1000, the provided transport path only has one or more directions that deviate by no more than 30°, preferably no more than 15°, and more preferably no more than 5° from at least one horizontal direction. The direction of the transport path, in particular the transport direction T, is in particular the direction in which the sheets 02 are transported at the point at which the direction is measured. The transport path provided for the transport of sheets 02 preferably begins at the point where the sheets 02 are removed from a feeder pile 104.

The processing machine 01 preferably comprises at least one substrate feed device 100, which more preferably is configured as a unit 100, in particular a substrate feed unit 100, and/or as a module 100, in particular a substrate feed module 100. In particular in the case of a sheet processing machine 01, the at least one substrate feed device 100 is preferably configured as a sheet feeder 100 and/or sheet feeder unit 100 and/or sheet feeder module 100.

For example, the processing machine 01 comprises at least one unit configured as a conditioning device, in particular a conditioning unit, which is more preferably configured as a module, in particular as a conditioning module. Such a conditioning device is configured, for example, as a pre-processing device or as a post-processing device. The processing machine 01 preferably comprises at least one unit configured as a pre-processing device, in particular a pre-processing unit, which more preferably is configured as a module, in particular as a pre-processing module and represents a conditioning device. The processing machine 01 preferably comprises at least one post-processing device. The processing machine 01 preferably comprises at least one unit 300, preferably an infeed device 300, which is more preferably configured as an infeed unit 300 and/or infeed module 300. Alternatively, the at least one infeed device 300 is configured as a component of the substrate feed device 100 or of another unit.

For example, the processing machine 01 comprises at least one unit 600, e.g., an application unit 600, which is preferably configured as a module 600, in particular an application module 600. The at least one application unit 600 is preferably arranged and/or composed based on its function and/or application method. The at least one application unit 600 is preferably used to apply at least one respective application fluid or coating agent over the entire surface area and/or a portion of the surface area of the sheets 02. One example of an application unit 600 is a printing unit 600 or printing module 600, which is used in particular to apply printing ink and/or ink onto substrate 02, in particular sheets 02. In particular, the at least one application unit 600 is configured to apply application fluid, preferably printing ink and/or ink, over the entire surface area and/or a portion of the surface area of the sheets 02. Above and below, an optionally provided priming unit and/or an optional finish coating unit may also be considered as such an application unit 600 or printing unit 600.

Independently, in particular, of the function of the application fluid that can be applied by the application units 600, these units can preferably be distinguished in terms of their application method. One example of an application unit 600 is a forme-based application unit 600, which comprises, in particular, at least one fixed, physical, and preferably exchangeable printing forme. Forme-based application units 600 preferably operate according to a planographic printing process, in particular an offset planographic printing process, and/or according to a gravure printing process, and/or according to a letterpress printing process, in particular preferably according to a flexo printing process. The corresponding application unit 600 is then a flexo application unit 600 or flexo printing unit 600, for example, in particular a flexo application module 600 or flexo printing module 600.

The processing machine 01, for example, comprises at least one unit configured as a drying device, in particular a drying unit, which is more preferably configured as a module, in particular as a drying module. As an alternative or in addition, at least one drying device 506 and/or at least one after-drying device, for example, is a component of at least one unit 100; 300; 600; 700; 900; 1000 preferably configured as a module 100; 300; 600; 700; 900; 1000. For example, at least one application unit 600 comprises at least one drying device 506 and/or comprises at least one unit 700 configured as a transport device 700 and/or at least one transport unit 700.

The processing machine 01 preferably comprises at least one transport device 700, which more preferably is configured as a unit 700, in particular a transport unit 700, and/or as a module 700, in particular as a transport module 700. The transport device 700 is also referred to as a transport means 700. In addition or as an alternative, the processing machine 01 preferably comprises transport devices 700, for example as components of other units and/or modules.

The processing machine 01 preferably comprises at least one shaping device 900, which more preferably is configured as a unit 900, in particular a shaping unit 900 or die-cutting unit 900, and/or as a module 900, in particular as a shaping module 900 or die-cutting module 900 and/or as a die-cutting device 900. The processing machine 01 preferably comprises at least one shaping unit 900 configured as a die-cutting unit 900. The at least one shaping device 900 is preferably configured as a rotary die-cutting device 900 and/or preferably comprises at least one shaping mechanism 914 or die-cutting mechanism 914. A shaping device 900 shall also be understood to mean a stamping device and/or a creasing device. A perforating device is preferably likewise a form of a die-cutting device 900.

The processing machine 01 preferably comprises at least one unit 1000 configured as a substrate output device 1000, in particular as a delivery device 1000, in particular a unit 1000 configured as a sheet delivery unit 1000, in particular a delivery unit 1000, which is more preferably configured as a module 1000, in particular as a delivery module 1000.

The processing machine 01, for example, comprises at least one unit configured as a post-press processing device, in particular a post-press processing unit, which is more preferably configured as a module, in particular as a post-press processing module. The at least one post-press processing device is preferably arranged downstream from a separation device 903 in the transport direction T. The at least one post-press processing device is preferably arranged upstream from the substrate output device 1000 in the transport direction T. For example, the at least one post-press processing device is configured as a gluing device and/or folding device.

The transport direction T provided in particular for the transport of sheets 02 is the direction T that is preferably oriented at least substantially, and more preferably entirely, horizontally and/or that preferably points from a first unit 100; 300; 600; 700; 900; 1000 of the processing machine 01 to a last unit 100; 300; 600; 700; 900; 1000 of the processing machine 01, in particular from a sheet feeder unit 100 or a substrate feed device 100 on the one hand to a delivery unit 1000 or a substrate output device 1000 on the other hand, and/or that preferably points in a direction in which the sheets 02 are transported, apart from vertical movements or vertical components of movements, in particular from a first point of contact with a unit 100; 300; 600; 700; 900; 1000 of the processing machine 01 that is arranged downstream from the substrate feed device or a first point of contact with the processing machine 01 to a last point of contact with the processing machine 01. Regardless of whether the infeed device 300 is an independent unit 300 or module 300 or is a component of the substrate feed device 100, the transport direction T is preferably the direction T in which a horizontal component of a direction points which is oriented from the infeed device 300 to the substrate output device 1000.

A direction A, preferably a transverse direction A, is preferably a direction A that is oriented orthogonally to the transport direction T of the sheets 02 and/or orthogonally to the intended transport path of the sheets 02 through the at least one application unit 600 and/or through the at least one shaping unit 900 and/or through the at least one sheet delivery unit 1000. The transverse direction A is preferably a horizontally oriented direction A. A working width of the processing machine 01 and/or of the at least one application unit 600 and/or of the at least one shaping unit 900 and/or of the at least one sheet delivery unit 1000 is preferably a dimension that extends preferably orthogonally to the intended transport path of the sheets 02 through the at least one application unit 600 and/or the at least one shaping unit 900 and/or the at least one sheet delivery unit 1000, more preferably in the transverse direction A. The working width of the processing machine 01 preferably corresponds to a maximum width that a sheet 02 may have in order to still be able to be processed by the processing machine 01, i.e., in particular a maximum sheet width that can be processed by the processing machine 01. The width of a sheet 02 shall, in particular, be understood to mean its dimension in the transverse direction A. This is preferably independent of whether this width of the sheet 02 is greater than or less than a horizontal dimension of the sheet 02 orthogonal thereto, which more preferably represents the length of this sheet 02. The working width of the processing machine 01 preferably corresponds to the working width of the at least one application unit 600 and/or of the at least one shaping unit 900 and/or of the at least one sheet delivery unit 1000. The working width of the processing machine 01, in particular sheet processing machine 01, is preferably at least 100 cm, more preferably at least 150 cm, still more preferably at least 160 cm, still more preferably at least 200 cm, and still more preferably at least 250 cm.

A vertical direction V preferably denotes a direction that is situated parallel to the normal vector of a plane spanned by the transport direction T and the transverse direction A. For example, in the region of the shaping device 900, the vertical direction V is preferably oriented so as to point from the printing substrate 02 toward a plate cylinder 901 of the shaping device 900.

The processing machine 01 preferably comprises transport means 07; 08; 09; 904 at one or more points. At least one of these transport means 07; 08; 09 is preferably configured as a suction transport means 07; 08; 09, in particular as a suction belt 07; 09 and/or as a suction box belt and/or as a roller suction system 08 and/or as a suction roller. Such suction transport means 07; 08; 09 are preferably used to move sheets 02 forward in a controlled manner and/or to enable movements while sheets 02 are held against at least one counterpressure surface of the corresponding suction transport means 07; 08; 09. A relative vacuum is preferably used in the process to pull and/or to press the sheets 02 against at least one transport surface 22; 23; 24. A transporting movement of the sheets 02 is preferably produced by a corresponding, in particular revolving movement of the at least one transport surface 22; 23; 24. As an alternative or in addition, the sheet 02 is held in its path, for example along the transport path provided for the transport of sheets 02, by the at least one suction transport means 07; 08; 09, and a transporting movement of the sheet 02 is produced in the process by a force that is predefined by another transport means situated upstream and/or downstream, for example. The vacuum is in particular a vacuum relative to an ambient pressure, in particular relative to an atmospheric pressure.

The suction transport means 07; 08; 09 shall thus preferably be understood to mean a device that has at least one counterpressure surface 22; 23; 24, which more preferably is configured as a sliding surface and/or in particular as a movable transport surface 22; 23; 24, and which is at least partially movable, for example, at least in the transport direction T. The respective suction transport means 07; 08; 09 furthermore preferably comprises at least one vacuum chamber, which more preferably is connected to at least one vacuum source by means of a suction line. The vacuum source comprises a fan, for example. The at least one vacuum chamber has at least one suction opening, which is used to apply suction to the sheets 02 and/or is configured to apply suction to sheets 02, for example. Depending on the embodiment of the suction transport means 07; 08; 09 and the size of the sheets 02, the sheets 02 are drawn by suction into a position in which they close the at least one suction opening or are only drawn by suction against a counterpressure surface 22; 23; 24 in such a way that ambient air can still travel and/or, for example, travels past the sheets 02 and into the suction opening. The transport surface 22; 23; 24 has one or more intake openings 36, for example. The intake openings 36 are preferably used to pass a vacuum from the suction opening of the vacuum chamber to the transport surface 22; 23; 24, in particular without pressure losses or with very low pressure losses. As an alternative or in addition, the suction opening acts on the sheets 02 in such a way that the sheets are drawn by suction against the transport surface 22; 23; 24, even though the transport surface 22; 23; 24 has no intake openings 36. At least one deflection means 47 is provided, for example, which directly or indirectly ensures a revolving movement of the at least one transport surface 22; 23; 24. The at least one deflection means 47 and/or the transport surface 22; 23; 24 preferably are and/or can be self-propelled, in particular to ensure movement of the sheets 02. Alternatively, the transport surface 22; 23; 24 allows sheets 02 to slide along the transport surface 22; 23; 24.

A first embodiment of a suction transport means 07; 09 is a suction belt 07; 09. A suction belt 07; 09 shall be understood to mean a device that comprises at least one flexible transport belt 37; 38, the surface of which serves as a transport surface 22; 24 and/or is configured as a transport surface 22; 24. The at least one transport belt 37; 38 is preferably deflected by deflection means 47 configured as deflection rollers 47 and/or deflecting cylinders 47 and/or is preferably self-contained, in particular such that continuous circulation is enabled. The at least one transport belt 37; 38 preferably has a multiplicity of intake openings 36. The at least one transport belt 37; 38 preferably covers the at least one suction opening 36 of the at least one vacuum chamber over at least a portion of its circulation path. More preferably, the vacuum chamber is only connected to a surrounding environment and/or to sheets 02 by way of the intake openings 36 of the at least one transport belt 37; 38. Support means are preferably provided, which prevent the at least one transport belt 37; 38 from being pulled too far or at all into the vacuum chamber and/or which ensure that the transport surface 22; 24 assumes a desired shape, for example such that it forms a flat surface, at least in the region in which its intake openings 36 are connected to the vacuum chamber. A revolving movement of the at least one transport belt 37; 38 then results in a forward movement of the transport surface 22; 24, with sheets 02 being held securely on the transport surface 22; 24 precisely in the region where they lie opposite the suction opening that is covered by the at least one transport belt 37; 38, with the exception of the intake openings 36.

A second embodiment of a suction transport means 08 is a roller suction system 08. A roller suction system 08 shall be understood to mean a device in which the at least one transport surface 23 is formed of at least sections of lateral surfaces of a multiplicity of transport rollers 26 and/or transport cylinders 26. Thus, each of the transport rollers 26 and/or transport cylinders 26 forms a part of the transport surface 23 that is closed, for example, and/or that circulates as a result of rotation. The roller suction system 08 preferably has a multiplicity of suction openings. These suction openings are preferably arranged at least between adjacent transport rollers 26 and/or transport cylinders 26. At least one covering mask is provided, for example, which preferably represents a boundary of the vacuum chamber. The covering mask preferably has the multiplicity of suction openings. The covering mask preferably forms a substantially flat surface. The transport rollers 26 and/or transport cylinders 26 are preferably arranged in such a way that they are intersected by this flat surface and more preferably protrude only slightly, for example only a few millimeters, beyond this flat surface, in particular in a direction facing away from the vacuum chamber. The suction openings then preferably have a frame-like configuration, with each opening surrounding at least one of the transport rollers 26 and/or transport cylinders 26. A revolving movement of the transport rollers 26 and/or transport cylinders 26 then results in a forward movement of the corresponding parts of the transport surface 23, with sheets 02 being held securely on the transport surface 23 precisely in the region in which they lie opposite the suction opening.

A third embodiment of a suction transport means is a suction box belt. A suction box belt shall be understood to mean a device that comprises a plurality of in particular circulating suction boxes, each of which has an outer surface that serves as a transport surface.

A fourth embodiment of a suction transport means is at least one suction roller. A suction roller shall be understood to mean a roller whose a lateral surface is used as a transport surface, in particular is configured as a transport surface, and has a multiplicity of intake openings, and which comprises at least one vacuum chamber in its interior, which is connected to at least one vacuum source, for example by means of a suction line.

A fifth embodiment of a suction transport means is at least one sliding suction device. The sliding suction device is preferably configured as a passive transport means and is used, in particular, to establish boundary conditions with respect to a position of a respective sheet 02, without setting the sheet 02 itself in motion. The respective sliding suction device preferably includes at least one sliding surface and at least one vacuum chamber and at least one suction opening. This at least one sliding surface then serves as a counterpressure surface and serves as a transport surface. In the case of the sliding suction device, the transport surface configured as a sliding surface is preferably not moved. The sliding surface serves as a counterpressure surface against which the corresponding sheets 02 are pressed. The sheets 02 can nevertheless be moved along the sliding surface, in particular to the extent that they are acted upon otherwise by a force that is at least also oriented parallel to the sliding surface. In particular, the sliding surface is configured as a counterpressure surface against which the corresponding sheets 02 are pressed, the sheets 02 being configured to be moved and/or movable along the sliding surface. A region between two driven suction transport means can be bridged and/or is preferably bridged by means of a sliding suction device, for example.

It is possible for different embodiments of suction transport means to be combined. These suction transport means can, for example, comprise at least one shared vacuum source and/or at least one shared vacuum chamber and/or at least can cooperate as a suction transport means and/or can be arranged behind one another and/or side by side. Each such combination is then preferably assigned to at least two of the embodiments of suction transport means.

Regardless of the embodiment of the particular suction transport means 07; 08; 09, at least two configurations of the particular suction transport means 07; 08; 09 as described below are possible.

In a first arrangement, a section of the transport path provided for the transport of sheets 02 which is defined by the particular suction transport means 07; 08; 09 is situated beneath the, in particular movable, transport surface 22; 23; 24, which is used, in particular, as a counterpressure surface 22; 23; 24 and, for example, can be moved at least partially in the transport direction T. For example, the particular suction transport means 07; 08; 09 is then configured as an upper suction transport means 07; 08; 09, wherein more preferably its suction openings or intake openings 36, at least while these are connected to the at least one vacuum chamber, preferably at least also or only point downwardly and/or its suctioning action is preferably at least also or only directed upwardly. The sheets 02 are then transported, preferably in a hanging state, by the suction transport means 07; 08; 09.

In a second arrangement, a section of the transport path provided for the transport of sheets 02 which is defined by the particular suction transport means is located above the, in particular movable, transport surface, which is used, in particular, as a counterpressure surface, in particular is configured as a counterpressure surface, and, for example, can be moved at least partially at least in the transport direction T. For example, the particular suction transport means is then configured as a lower suction transport means, wherein more preferably its suction openings or intake openings, at least while these are connected to the at least one vacuum chamber, preferably at least also or only point upwardly and/or its suctioning action is preferably at least also or only directed downwardly. The sheets 02 are then preferably transported lying flat by the suction transport means.

The sheet processing machine 01 is preferably a sheet processing machine 01 comprising at least one shaping device 900 and at least one delivery device 1000 arranged downstream from the at least one shaping device 900 along a transport path provided for the transport of sheets 02. The at least one shaping device 900 is preferably configured as a die-cutting device 900 and/or as a rotary die-cutting device 900. For example, exactly one shaping device 900, in particular die-cutting device 900, and/or rotary die-cutting device 900, is provided. The at least one shaping device 900 preferably has at least one, and more preferably exactly one, shaping point 909. The at least one shaping device 900 preferably has the at least one, and more preferably exactly one, shaping point 909, which is formed by at least one, and more preferably exactly one, plate cylinder 901, in particular configured as a die plate cylinder 901, on the one hand, and at least one counterpressure cylinder 902 on the other. The shaping point 909 is preferably the region in which the particular plate cylinder 901 and the particular counterpressure cylinder 902 are closest to one another. The at least one shaping point 909 is preferably configured as at least one die-cutting point 909 and/or as at least one transport means 909 and/or as at least one shaping transport means 909 and/or as at least one die-cutting transport means 909. The shaping device 900, in particular the shaping mechanism 914, preferably comprises at least one tool, and more preferably the at least one plate cylinder 901 comprises at least one tool. In a preferred embodiment, the tool of the shaping device 900, in particular of the shaping mechanism 914, preferably the tool of the plate cylinder 901, is in direct contact with the counterpressure cylinder 902, in particular in the region of the shaping point 909.

Above and below, according to DIN 16500-2 the term multiple-up 1101 preferably refers to the number of identical objects that are produced from the same piece of material and/or are arranged on joint substrate material, for example a shared sheet 02. A multiple-up 1101 is preferably the region of a sheet 02 that is either configured as a product of the sheet processing machine 01, in particular as an intermediate product for producing an end product, for example as a blank, and/or, for example, is further processed and/or is configured to be further processable to the desired or required end product. Each of the at least one multiple-up 1101 of the respective, preferably the at least one, sheet 02 preferably has at least one print image. The at least one sheet 02 thus preferably has at least one print image. Here, the desired or required end product, which was generated by the respective, preferably the at least one multiple-up 1101, or preferably by further processing of the respective, preferably the at least one, multiple-up 1101, is preferably a folder-type box and/or a telescope-type box and/or a slide-type box and/or a rigid-type box. The sheet 02 preferably comprises at least one multiple-up 1101, preferably at least two multiple-ups 1101, more preferably at least four multiple-ups 1101, more preferably at least eight multiple-ups 1101, for example twenty multiple-ups 1101. After having been processed in the shaping device 900 and/or in the separation device 903, the sheet 02 preferably comprises the at least two multiple-ups 1101, preferably the at least four multiple-ups 1101, more preferably the at least eight multiple-ups 1101, for example the twenty multiple-ups 1101, which are connected to one another so as to be easily separable, preferably by way of at least one crosspiece and/or by way of at least one connecting piece. The crosspiece and/or the connecting piece are preferably formed of at least one layer of paper of the sheet 02, for example only of one layer of the corrugated cardboard sheet 02, and are configured to connect the at least two multiple-ups 1101, and preferably to additionally impart stability.

Above and below, an offcut piece 1102A, preferably a scrap piece 1101A, is the region of a sheet 02 that does not correspond to any multiple-up 1101. An offcut piece 1102A is preferably configured as a scrap piece 1102A and/or trimmed-off piece 1102A and/or broken-off piece 1102A and is preferably configured to be removable. During operation of the sheet processing machine 01, the at least one scrap piece 1102A is preferably generated at at least one shaping point 909 of the shaping device 900, for example during at least one die-cutting process, and is preferably at least partially, preferably entirely, removed from the particular sheet 02 during operation of the sheet processing machine 01.

A sheet 02 that has been processed by the shaping device 900, i.e., that is arranged downstream from the at least one shaping point 909 on the transport path in the transport direction T, preferably includes at least one die-cut impression 1103. The at least one die-cut impression 1103 is configured as a crease and/or a score mark and/or an embossment and/or a cut and/or a perforation, for example. The at least one die-cut impression 1103, in particular when it is configured as a perforation and/or a cut, is preferably configured to at least partially separate the at least one multiple-up 1101 from at least one offcut piece 1102A and/or from at least one further multiple-up 1101. A sheet 02 that has been processed by the shaping device 900, i.e., that is arranged downstream from the at least one shaping point 909 on the transport path in the transport direction T, preferably comprises the at least one multiple-up 1101, preferably the at least two multiple-ups 1101, and the at least one scrap piece 1102A.

The sheet processing machine 01 is preferably characterized in that the at least one separation device 903 for removing at least one offcut piece 1102A, in particular an offcut piece 1102A configured as a scrap piece 1102A, from at least one sheet 02 is arranged downstream from the at least one shaping point 909 along the transport path provided for the transport of sheets 02. The at least one separation device 903 is preferably arranged downstream from the at least one shaping point 909 along the transport path provided for the transport of the sheets 02. The separation device 903 is preferably configured to entirely remove scrap pieces 1102A from the particular sheet 02. The separation device 903 is preferably configured to remove, more preferably entirely remove, the at least one offcut piece 1102A from the at least one sheet 02. The at least one separation device 903 is thus used, in particular, to separate offcut pieces 1102A, in particular of the former portions of the sheet 02 that were already entirely or partially detached from the sheet 02 and are to be removed from the sheet 02, from multiple-ups 1101, in particular those portions of the sheet 02 that are to continue to be treated as sheets 02 and, if necessary, to be further processed. Above and below, a remaining portion of the at least one sheet 02, or also a remaining sheet 02, is preferably the portion of the sheet 02 that is situated downstream from the separation device 903 and/or that the inspection device 916 is configured to inspect. The remaining portion of the at least one sheet 02 preferably only comprises multiple-ups 1101, but preferably no offcut pieces 1102A. The separation device 903 is preferably configured to separate offcut pieces 1102A from multiple-ups 1101. The separation device 903 is preferably configured to remove at least one offcut piece 1102A from the sheet 02 that was generated at the at least one shaping point 909, but was not yet removed and/or severed and/or separated from the sheet 02. The at least one separation device 903 is configured as a separation unit 903 and/or as a separation module 903, for example. As an alternative, the at least one separation device 903 is a component of another unit 900 or module 900, in particular of the at least one shaping unit 900 or shaping module 900.

The at least one separation device 903 preferably comprises at least one transport means 904 configured as a separation transport means 904, in particular for transporting sheets 02. The at least one separation transport means 904 is preferably used to transport respective sheets 02 along the transport path provided for the transport of sheets 02 and/or in the transport direction T, while scrap pieces 1102A are removed from the respective sheets 02. In particular, the at least one separation transport means 904 is configured to transport sheets 02 along the transport path, while scrap pieces 1102A are removed from the respective sheets 02. The scrap pieces 1102A are preferably transported in a respective direction that has at least one component which is oriented orthogonally to the transport direction T, preferably counter to a vertical direction V, for example vertically downwardly. Preferably, at least the force of gravity is also used to remove such scrap pieces 1102A from the respective sheets 02. In this way, it is preferably only necessary to apply a force that severs the respective scrap piece 1102A from the respective sheet 02, and the respective scrap piece 1102A is then carried away by gravity in a direction that has at least one component oriented orthogonally to the transport direction T, preferably downwardly.

Preferably, exactly one separation transport means 904 is arranged along the transport path provided for the transport of sheets 02. As an alternative, multiple, for example differently configured, separation transport means 904 are arranged along the transport path provided for the transport of sheets 02. As an alternative or in addition, the sheet processing machine 01 is preferably characterized in that the at least one separation transport means 904 is configured to act and/or to be capable of acting on sheets 02 both from above and from beneath. This allows sheets 02 to be transported with sufficient accuracy along the transport path provided for the transport of sheets 02 despite the action of the at least one separation device 903, and/or sheets 02 are then preferably transported with sufficient accuracy along the transport path. As an alternative or in addition, the sheet processing machine 01 is preferably characterized in that the at least one separation transport means 904 comprises multiple upper separation transport belts 907 arranged side by side and spaced apart from one another, based on a transverse direction A, and/or multiple lower separation transport belts 908 arranged side by side and spaced apart from one another, based on a transverse direction A. Separation transport belts 907; 908 are configured as continuous and/or revolving belts, for example, which more preferably have a relatively small dimension in the transverse direction A, for example less then 5 cm, preferably less than 2 cm, and more preferably less than 1 cm. Based on the transverse direction A, relatively large distances between respective adjacent separation transport belts 907; 908 are preferably, for example, at least 2 cm, more preferably at least 5 cm, still more preferably at least 10 cm, and still more preferably at least 20 cm. In this way, scrap pieces 1102A can be moved through, in particular can drop through, between the separation transport belt 907; 908 in a direction that has at least one component oriented orthogonally to the transport direction A, preferably in or counter to the vertical direction V, more preferably downwardly and/or upwardly. The scrap pieces 1102A are preferably moved through between the separation transport belts 907; 908 in the direction that has at least one component oriented orthogonally to the transport direction T.

As an alternative or in addition, the sheet processing machine 01 is characterized, for example, in that at least one roller nip is used as the separation transport means 904. Scrap pieces 1102A can then be moved downwardly and/or upwardly, and in particular can drop through, between the respective roller nip and another transport means, for example upstream or downstream from the particular roller nip. The scrap pieces 1102A are preferably moved through between the particular roller nip and another transport means. At least one additional roller nip and/or at least one separation transport belt 907; 908, for example, can be provided and/or is provided, for example, as such a further transport means. As an alternative or in addition, the sheet processing machine 01 is preferably characterized in that the at least one separation transport means 904 is different from any suction transport means, i.e., is not configured as a suction transport means.

As an alternative or in addition, the sheet processing machine 01 is preferably characterized in that the at least separation device 903 is configured as at least one jogging device 903 and/or that the at least separation device 903 comprises at least one jogging drive 911. The at least one jogging drive 911 can preferably be used to deflect at least one separation transport belt 907; 908 orthogonally to its local transfer direction. A local transfer direction shall be understood to mean the direction in which a respective element of the respective separation transport belt 907; 908 is moved based on a revolving movement of the respective separation transport belt 907; 908, in particular apart from any superimposed deflection movements. The at least one jogging drive 911 is thus preferably used to jog the respective sheet 02, in particular by movements in directions orthogonal to the transport direction T. The at least one jogging drive 911 is preferably configured to jog the particular sheet 02. Such movements are only necessary in the case of a small deflection, for example. For example, the at least one jogging drive 911 is arranged to act and/or to be capable of acting directly or indirectly on the at least one separation transport means 904 and/or at least one separation transport belt 907; 908, for example via at least one impact shaft. For example, the at least one jogging drive 911 is arranged to act and/or to be capable of acting directly or indirectly on at least one deflection means and/or at least one guide means of at least one separation transport belt 907; 908. At least one electric and/or at least one pneumatic and/or at least one hydraulic and/or at least one magnetic drive is provided as the jogging drive 911, for example. As an alternative or in addition, the at least one separation device 903 comprises at least one separation fan, for example, which is more preferably used to remove scrap pieces 1102A and/or which is configured to remove the scrap pieces 1102A from the respective sheets 02 using at least one at least intermittently activated flow of gas.

As an alternative or in addition, the sheet processing machine 01 is preferably characterized in that the at least one separation transport means 904 comprises at least one transport drive 912, by means of which at least one component of the at least one separation transport means 904 can be driven so as to revolve, in particular in at least one respective local transfer direction. The at least one transport drive 912 of the at least one separation transport means 904, and in particular the drive controller thereof, is preferably connected to the machine controller of the processing machine 01 and/or to the electronic master axis, in particular via the BUS system.

As an alternative or in addition, the sheet processing machine 01 is preferably characterized in that the at least one separation device 903 comprises at least one collecting device 917; 918 for scrap pieces 1102A, which is preferably arranged in at least one vertically displaced plane parallel to a transport plane, which more preferably is arranged beneath the transport path provided for the transport of sheets 02. The collecting device 917 is, for example, configured as a driven removal device 917, for example as a transport belt. The collecting device 918 is configured as a container 918 and/or as a shredding device 918, for example. The shaping device 900 preferably comprises at least a portion of the at least one collecting device 917; 918, in particular of the removal device 917. For example, scrap pieces 1102A present in the collecting device 917; 918 are configured to be feedable to a reprocessing device and/or post-press processing device, which is configured to generate further sheets 02, for example.

A sheet 02 that is situated on the transport path downstream from the at least one shaping point 909 and downstream from the at least one separation device 903 in the transport direction T preferably includes at least one multiple-up 1101, preferably at least two multiple-ups 1101, more preferably at least four multiple-ups 1101, and at least one sheet opening 1102L, preferably at least two sheet openings 1102L, more preferably at least four sheet openings 1102L. The at least one sheet 02 detected by the inspection device 916 preferably includes at least one multiple-up, more preferably at least two multiple-ups 1101, and at least one sheet opening 1102L. The at least one sheet 02 preferably includes at least one multiple-up 1101, preferably at least two multiple-ups 1101, more preferably at least four multiple-ups 1101, and at least one sheet opening 1102L, preferably at least two sheet openings 1102L. The sheet 02 that is arranged on the transport path downstream from the at least one shaping point 909 and downstream from the at least one separation device 903 in the transport direction T, is preferably referred to as a remaining portion of the sheet 02 processed by the shaping device 900. Each of the at least one multiple-up 1101 of the particular sheet 02 preferably includes at least one print image. The sheet 02 preferably includes at least two multiple-ups 1101, each including at least one print image. Each of the at least two multiple-ups 1101 of the one particular sheet 02 preferably includes at least one preferably identical print image.

A sheet 02 that is situated on the transport path downstream from the at least one shaping point 909 and downstream from the at least one separation device 903 in the transport direction T and, additionally or alternatively, after passing through the sheet processing machine 01, is situated outside the sheet processing machine 01, includes at least one multiple-ups 1101, preferably at least two multiple-ups 1101, wherein at least one offcut piece 1102A, preferably at least two offcut pieces 1102A, were removed from the sheet 02. For example, the sheet 02 additionally includes at least one die-cut impression 1103, preferably at least two die-cut impressions 1103, in particular a die-cut impression 1103 configured as a crease and/or score mark and/or embossment. The sheet 02 preferably does not include any offcut pieces 1102A downstream from the separation device 903 in the transport direction T or after passing through the sheet processing machine 01. Different multiple-ups 1101 are configured to be separable and/or to be separated from one another within a sheet 02, for example by at least one die-cut impression 1103, for example a perforation and/or an at least partial cut and/or a crease. The at least one die-cut impression 1103, for example the perforation and/or the at least partial cut and/or the crease, is preferably configured to generate the at least one crosspiece and/or the at least one connecting piece between at least two mutually adjoining multiple-ups 1101 of the sheet 02.

A sheet 02 preferably does not include any scrap pieces 1102A downstream from the separation device 903 in the transport direction T. A sheet 02 preferably in each case includes a sheet opening 1102L and/or sheet gap 1102L downstream from the separation device 903 in the transport direction T at the positions of the scrap pieces 1102A whose dimension and/or whose contour corresponds to the dimension and/or contour of the respective removed scrap piece 1102A. In an alternative or additional embodiment, the dimension and/or contour of a sheet opening 1102L, for example, corresponds to the dimension and/or contour of multiple mutually adjoining scrap pieces 1102A. The remaining contour of the sheet 02, in particular the remaining contour of the at least one multiple-up 1101, preferably corresponds to the contour of the at least one offcut piece 1102A removed upstream from the inspection device 916 and/or to a combined contour of at least two offcut pieces 1102A removed upstream from the inspection device 916. The remaining contour of the sheet 02, in particular the remaining contour of the at least one multiple-up 1101, preferably corresponds to the contour of the sheet 02 including the at least one multiple-up 1101, more preferably including the at least two multiple-ups 1101, wherein at least one offcut piece 1102A, preferably at least two offcut pieces 1102A, more preferably at least four offcut pieces 1102A, were removed.

Above and below, a sheet opening 1102L, preferably in an actual state of the relevant, preferably the at least one, sheet 02, preferably denotes a region of sheets 02 at which, after the at least one processing operation in the shaping device 900 and, additionally or alternatively, after the at least one processing operation in the separation device 903, the relevant sheet 02 preferably does not have any mass, preferably a gap. The sheet opening 1102L is configured as a sheet gap 1102L, for example. Preferably, at least one scrap piece 1102A of the relevant, preferably the at least one, sheet 02 can be assigned and/or is assigned to a respective sheet opening 1102L. A sheet opening 1102L is preferably the region of a sheet 02 from which at least one scrap piece 1102A was removed and/or in which the sheet 02 lost mass and/or does not have any remaining mass compared to a time prior to the at least one processing operation in the shaping device 900 and, additionally or alternatively, prior to the at least one processing operation in the separation device 903. In particular, the sheet opening 1102L corresponds to a removed scrap piece 1102A, the removal of which generated the surface area of the sheet opening 1102L in or at the at least one sheet 02. Opposing delimitations of the respective sheet opening 1102L, in particular two opposing edges of the respective, preferably the at least one, sheet 02 are preferably spaced apart from one another at a distance of greater than zero, preferably greater than 5 mm (five millimeters), more preferably greater than 10 mm, more preferably greater than 20 mm, more preferably greater than 30 mm, so as to delimit the particular sheet opening 1102L. For example, the at least one relevant sheet opening 1102L is configured as a handle in the desired or required end product that was generated by the respective multiple-up 1101 or the post-press processing thereof. The sheet opening 1102L is preferably different from a straight cutting edge along an entire length or width of the at least one sheet 02.

Above and below, the term sheet 02 refers in particular both to sheets 02 that have not yet been processed by means of the at least one shaping device 900, and to sheets 02 that have already been processed by means of the at least one shaping device 900 and/or by means of the at least one separation device 903 and in the process have been altered in terms of their shape and/or their mass. Above and below, a relevant sheet 02 or also a respective sheet 02 preferably denotes the at least one sheet 02 that is to be inspected or to be detected and/or was inspected or detected by the inspection device 916 and/or that the inspection device 916 is configured to inspect or detect. A remaining sheet 02 preferably denotes the at least one sheet 02 that is situated downstream from the at least one shaping point 909 and/or downstream from the at least one separation device 903 in the transport direction T.

As an alternative or in addition, the sheet processing machine 01 is preferably characterized in that at least one transport means 09; 906 configured as a selective transport means 09; 906 is arranged along the transport path provided for the transport of sheets 02, in particular downstream from the at least one separation transport means 904 along the transport path provided for the transport of sheets 02. The at least one transport means 09; 906 configured as a selective transport means 09; 906 is preferably arranged following the at least one separation transport means 904 along the transport path provided for the transport of sheets 02, in particular directly following the at least one separation transport means 904. A selective transport means 09; 906 shall in particular be understood to mean a transport means 09; 906 that only transports and/or is configured to be capable of only transporting selected objects, for example exclusively sheets 02 and/or no offcut pieces 1102A. At least one position and/or at least one dimension of the particular object, in particular with respect to the transverse direction A, is used as a distinguishing criterion. The at least one selective transport means 09; 906 is preferably configured as at least one upper suction transport means 09; 906 for the hanging transport of sheets 02, more preferably as at least one exclusively upper suction transport means 09; 906 and/or for an exclusively hanging transport of sheets 02. Any offcut pieces 1102A can then also drop out counter to the vertical direction V, preferably downwardly, downstream from the at least one separation transport means 904, and can be moved away from the sheets 02 without interfering with subsequent processes.

The sheet processing machine 01 is preferably characterized in that the sheet processing machine 01 comprises at least one transport means 09; 906, in particular an upper suction transport means 09; 906, along the transport path provided for the transport of sheets 02 downstream from the separation device 903 in the transport direction T, which is configured for the hanging transport of sheets 02, preferably for the hanging transport of the at least one remaining portion of the at least one sheet 02 processed by the shaping device 900, the sheet including the at least one multiple-up 1101.

The sheet processing machine 01 is characterized in that at least one inspection device 916 is arranged along the transport path provided for the transport of sheets 02 for at least partially inspecting sheets 02, preferably for at least partially inspecting at least one remaining portion of the at least one sheet 02 processed by the shaping device 900, the sheet including at least one multiple-up 1101, preferably at least two multiple-ups 1101. The at least one inspection device 916 inspecting or detecting the at least one sheet 02 is preferably arranged along the transport path provided for the transport of sheets 02.

The inspection device 916 for at least partially inspecting the contour of at least one offcut piece 1102A, which was removed on the transport path upstream from the inspection device 916, at the remaining sheet 02, in particular at the at least one multiple-up 1101 and/or the at least one sheet opening 1102L, is configured in an ascertaining manner. The inspection device 916 is preferably configured to ascertain the contour of at least one offcut piece 1102A, which was removed on the transport path upstream from the inspection device 916, at the at least one sheet 02, in particular at the at least one multiple-up 1101 and/or the at least one sheet opening 1102L. The contour of the remaining, preferably the at least one, sheet 02 on the transport path downstream from the separation device 903, or, for example, after the sheet 02 has passed through the sheet processing machine 01, preferably results from the removal of the at least one offcut piece 1102A from the relevant, preferably the at least one, sheet 02.

The sheet processing machine 01 comprising a shaping device 900 for processing sheets 02 preferably comprises the at least one separation device 903 and the at least one delivery unit 1000, wherein the separation device 903 is configured to remove at least one offcut piece 1102A from the at least one sheet 02. The separation device 903 is preferably configured to remove the at least one offcut piece 1102A from the at least one sheet 02. The at least one inspection device 916 for at least partially inspecting at least a remaining portion of the at least one sheet 02 processed by the shaping device 900, the sheet including the at least one multiple-up 1101, preferably at least two multiple-ups 1101, is preferably downstream from the at least one separation device 903 in the transport direction T of the sheets 02. The at least one inspection device 916 is preferably configured to at least partially inspect the at least one remaining portion of the at least one sheet 02 processed by the shaping device 900, the sheet including the at least one multiple-up 1101, preferably at least two multiple-ups 1101. The remaining portion of the at least one sheet 02 is preferably the portion of the at least one sheet 02 that is arranged downstream from the separation device 903 and/or that the inspection device 916 is configured to inspect.

A device for inspecting at least one sheet 02 is preferred. The particular sheet 02 preferably includes the at least one multiple-up 1101, preferably the at least two multiple-ups 1101, more preferably the at least four multiple-ups 1101, including at least one print image and the at least one sheet opening 1102L, preferably the at least two sheet openings 1102L, more preferably the at least four sheet openings 1102L. The respective, preferably the at least one, sheet 02 preferably includes the at least one multiple-up 1101, preferably the at least two multiple-ups 1101, and the at least one sheet opening 1102L, preferably the at least two sheet openings 1102L, wherein the respective, preferably the at least one, sheet 02 is made of paper or cardboard or paperboard. The inspection device 916 is configured to at least partially detect the at least one sheet 02, in particular in the region of the at least one sheet opening 1102L, at this sheet 02. The inspection device 916 is preferably configured to at least partially detect the at least one sheet opening 1102L. The inspection device 916, preferably the evaluation means, is configured to compare the at least one sheet 02 detected by the inspection device 916 to a reference of the sheet 02, in particular with respect to the at least one sheet opening 1102L of the at least one sheet 02. The inspection device 916, preferably the evaluation means, is preferably configured to compare the at least one sheet opening 1102L to a reference of the at least one sheet opening 1102L.

The reference of the at least one sheet opening 1102L preferably contains at least some of the information, preferably all the information, that is necessary to unambiguously determine a required desired state of the relevant sheet opening 1102L. The reference of the at least one sheet opening 1102L is preferably configured as a digital and/or taught-in reference. The digital reference is preferably configured as a digital image template. The digital reference preferably corresponds to data that was generated in a prepress. The digital reference preferably has a pdf or tif or jpg data format. The taught-in reference is preferably a sheet 02 that is configured as a sample sheet and includes at least one sheet opening 1102L, which corresponds to the sheet opening 1102L to be inspected, and/or, for example, is detected by the inspection device 916 and/or stored in the evaluation means as a basis for comparison. The inspection device 916 is preferably configured to inspect at least one sample sheet, preferably at least two sample sheets, more preferably a plurality of sample sheets, so as to create the taught-in reference. The inspection device 916 is preferably configured to detect individual points of the at least one sample sheet and is accordingly configured to check the surrounding environment thereof within the at least one sheet 02. The reference of the at least one sheet 02 preferably encompasses the reference of the at least one sheet opening 1102L.

The at least on inspection device 916 is preferably configured in such a way that the at least one inspection device 916 preferably comprises at least one optical image acquisition device and/or that the image acquisition device is configured as a camera. The inspection device 916 preferably comprises the at least one image acquisition device, preferably at least one optical image acquisition device. The at least one image acquisition device is preferably configured as a camera, more preferably as a color camera, more preferably as a line scan camera, more preferably as a CMOS sensor and/or CCD sensor. For example, the inspection device 916 comprises at least one light source, for example an LED light source, in addition to the at least one image acquisition device. The inspection device 916 preferably comprises at least one optical device, which is preferably arranged between the at least one image acquisition device and the transport path provided for the transport of sheets 02. The inspection device 916, in particular the at least one image acquisition device, is preferably configured to detect at least a portion of the working width, more preferably the entire working width, of the sheet processing machine 01. The inspection device 916 is preferably configured to detect at least a portion of the working width of the sheet processing machine 01. For example, an image acquisition device only detects a portion of the working width, and in this case the inspection device 916 preferably comprises at least two image acquisition devices, which are each configured to detect regions of the working width that are at least partially different from one another. If present, the at least two image acquisition devices of the inspection device 916 are preferably arranged side by side in the transverse direction T and/or behind one another in the transverse direction A.

In a preferred embodiment, the inspection device 916 is arranged immediately following the separation device 903 in the transport direction T. The inspection device 916 is preferably arranged immediately following the separation device 903 in the transport direction T, without any possible further processing device being interposed and/or without any possible further processing stage, such as gluing a multiple-up 1101 and/or separating individual multiple-ups 1101 from one another, being interposed. More preferably, the inspection device 916 is arranged immediately following the separation device 903, upstream from any possible further processing device, for example a gluing device and/or a multiple-up separation device, for possibly further processing the at least one sheet 02. The inspection device 916 is preferably arranged upstream from the at least one delivery unit 1000, and downstream from the separation device 903, in the transport direction T.

In addition or as an alternative, the sheet processing machine 01 is preferably characterized in that the at least one inspection device 916 is preferably arranged orthogonally to the transport path of the at least one sheet 02 provided for the transport of sheets 02 and is directed at the transport path of the at least one sheet 02. The at least one inspection device 916 is preferably arranged orthogonally to the transport plane of the at least one sheet 02 and is directed at the transport plane of the at least one sheet 02. Above and below, the transport plane preferably denotes a plane of the transport path spanned by the transverse direction T and the transverse direction A, in particular at the position along the transport path to which reference is made. The inspection device 916 is preferably arranged outside the transport path and is directed at the transport path and/or the transport plane. The inspection device 916 is preferably directed perpendicularly at the transport path and/or the transport plane. The inspection device 916 is preferably arranged upstream and/or downstream from the transport path in the vertical direction V. The inspection device 916 is preferably configured to inspect the sheet 02 from the side of the main surface area of the sheet 02 on which the at least one print image is applied to the sheet 02.

For example, when sheets 02 are guided lying flat, the inspection device 916 is preferably arranged above the transport path and/or of the transport plane, in particular downstream from the transport path and/or from the transport plane in the vertical direction V. In this way, the inspection device 916 can inspect the sheet 02 from above and/or, for example, is configured to inspect the sheet 02 from above. When the sheet 02 is guided lying flat, the at least one print image is preferably arranged to point upwardly on the main surface area of the sheet 02. In this embodiment, the inspection device 916 can thus likewise inspect the at least one print image of the sheet 02 and/or is configured to inspect the at least one print image.

In the case of hanging guidance of sheets 02, the inspection device 916 is preferably arranged beneath the transport path and/or the transport plane, in particular upstream from the transport path and/or upstream from the transport plane in the vertical direction V. The inspection device 916 is thus preferably configured to inspect the sheet 02 from beneath. In the case of hanging guidance of sheets 02, the at least one print image is preferably arranged to point downwardly on the main surface area of the sheet 02. At least in this embodiment, the inspection device 916 is thus, preferably additionally or alternatively, configured to inspect the at least one print image of the sheet 02 from beneath, and preferably is configured to inspect it from upstream from the transport path and/or from upstream from the transport plane in the vertical direction V.

In addition or as an alternative, the inspection device 916 is preferably configured to inspect the at least one remaining portion of the at least one sheet 02 processed by the shaping device 900 during at least one shaping process of at least one further sheet 02. The inspection device 916 is thus preferably configured to detect each sheet 02, and preferably is configured to individually detect each sheet 02 that passes the inspection device 916 on the transport path in the transport direction T. The at least one inspection device 916 is preferably configured to detect the at least one sheet 02 that passes the inspection device 916 on the transport path in the transport direction T. For example, further sheets 02 are already processed in at least one shaping process of the at least one shaping device 900 and/or pass through at least one unit 100; 300; 600; 700; 900 of the sheet processing machine 01, which is arranged upstream from the inspection device 916 in the transport direction T, while a sheet 02 is being detected by the inspection device 916. For example, the at least one shaping device 900 is configured to already process further sheets 02 of the sheets 02 in at least one shaping process, preferably at the at least one shaping point 909, and/or, for example, further sheets 02 of the sheets 02 are configured to pass through at least one unit 100; 300; 600; 700; 900 of the sheet processing machine 01, which is arranged upstream from the at least one inspection device 916 in the transport direction T, while the at least one sheet 02 is being detected by the at least one inspection device 916.

In a preferred embodiment, the inspection device 916, in particular the image acquisition device of the inspection device 916, is at least configured to at least partially detect at least one sheet opening 1102L, for example at least one sheet gap 1102L, of the at least one sheet 02 and/or at least an inner contour of the at least one sheet 02, preferably defined by at least one sheet opening 1102L, and/or at least one outer contour of the at least one sheet 02, preferably defined by at least one outer edge of the respective, preferably the at least one, sheet 02. As an alternative, the inspection device 916, in particular the image acquisition device of the inspection device 916, is preferably at least configured to at least partially detect the at least one multiple-up 1101 and/or the contour, in particular the boundary line, of the particular multiple-up 1101. The inspection device 916 is preferably configured to at least partially detect the at least one sheet 02, more preferably the at least one multiple-up 1101 and/or the contour of the particular multiple-up 1101, for example defined by the removal of at least one offcut piece 1102A from the at least one sheet 02 and/or the generation of at least one sheet opening 1102L, in the at least one sheet 02. Above and below, the contour of a sheet 02 describes the shape of the particular sheet 02, in particular an outer and/or inner boundary line of the at least one multiple-up 1101 of the particular sheet 02. The outer contour of the sheet 02 is preferably defined by at least one outer edge of the sheet 02, in particular by at least one outer edge of the at least one multiple-up 1101. The inner contour of the sheet 02 is preferably defined by at least one sheet opening 1102L and/or sheet gap 1102L, preferably within the outer contour of the particular sheet 02, more preferably within the main surface area in the region of the at least one multiple-up 1101 of the particular sheet 02. The inspection device 916, in particular the image acquisition device of the inspection device 916, is preferably configured to at least partially detect the main surface area of sheets 02. The inspection device 916, in particular the image acquisition device of the inspection device 916, is preferably configured to at least partially detect the region of the at least one offcut piece 1102A and/or of the at least one sheet opening 1102L of sheets 02. In particular, the inspection device 916 is thus, for example, configured to detect at least the inner contour of the at least one sheet 02. The region detected by the inspection device 916 preferably at least partially corresponds to the contour of the at least one sheet opening 1102L and/or at least partially to the boundary line of the at least one sheet 02, i.e., in particular its inner and/or outer contour. More preferably, at least the region of the main surface area of the at least one sheet 02 which at least partially includes the at least one sheet opening 1102L, i.e., for example at least a portion of the boundary line of the at least one sheet 02 around the at least one sheet opening 1102L, is thus detected by the inspection device 916. The at least one sheet opening 1102L preferably corresponds to at least a portion of an offcut piece 1102A removed from the at least one sheet 02 and/or was generated by removing at least a portion of the at least one offcut piece 1102A from the at least one sheet 02.

The inner contour of the at least one sheet 02 preferably corresponds to a contour of the at least one offcut piece 1102A of the relevant, preferably the at least one, sheet 02, in particular after the at least one offcut piece 1102A has been removed from the relevant, preferably the at least one, sheet 02. In particular, the inner contour corresponds to the boundary line of the at least one offcut piece 1102A that was broken out of the at least one sheet 02.

The inspection device 916 preferably comprises at least one evaluation means or is connected to an evaluation means.

The inspection device 916 is preferably configured to ascertain an actual state of the at least one sheet 02, preferably of the at least one sheet 02 of the sheets 02, in particular by way of the image acquisition device. The actual state of sheets 02, preferably of the at least one sheet 02, is preferably the state, in particular with respect to shape and/or mass and/or contour, that the respective, preferably the at least one, sheet 02 has at the time of detection by way of the inspection device 916.

In addition or as an alternative, the sheet processing machine 01 is preferably characterized in that the inspection device 916 comprises the evaluation means or is connected to the evaluation means, and that the evaluation means is configured to compare the actual state of the at least one sheet 02 to a desired state of the relevant, preferably the at least one, sheet 02. The evaluation means is preferably configured to receive data about the actual state of sheets 02 from the image acquisition device of the inspection device 916, and to evaluate the data. The desired state of the relevant, preferably the at least one, sheet 02 is preferably the state, in particular with respect to shape and/or mass and/or contour, that the at least one sheet 02, preferably an ideally produced sheet 02, is to have, in particular at the time of detection by way of the inspection device 916, and/or that is predefined by at least one reference and/or by at least one sample sheet, in particular as a comparative value, for the at least one sheet 02. For example, the desired state of the relevant, preferably the at least one, sheet 02 is the desired and/or required state that a product produced from corresponding sheets 02, for example a folder-type box, is to have. An ideally produced sheet 02 preferably describes a sheet 02 that preferably exactly agrees with the reference for this sheet 02 underlying the particular processing operation after the processing operation has been completed, preferably within the unit 100; 300; 600; 700; 900; 1000 assigned to the particular processing operation. In particular, the desired state describes an ideal state of the outer contour of the at least one multiple-up 1101, preferably of the at least two multiple-ups 1101, and/or of the inner contour of the at least one multiple-up 1101, preferably of the at least two multiple-ups 1101, and/or of the at least one sheet opening 1102L. The desired state preferably describes an ideal state of the outer contour of the at least one sheet 02, wherein the outer contour encompasses at least two multiple-ups 1101, and/or of the inner contour of the sheet 02, wherein the inner contour encompasses at least two multiple-ups 1101, and/or of the at least one sheet opening 1102L of the at least one sheet 02. For example, the desired state describes an outer contour and/or an inner contour of at least one individual multiple-up 1101 that can preferably be post-press processed to yield a product configured as a folder-type box, more preferably of at least two multiple-ups 1101 that are at least slightly joined to one another and can preferably be post-press processed to yield at least two products configured as folder-type boxes.

In a preferred embodiment, the desired state of the relevant, preferably the at least one, sheet 02 is determined and/or configured to be determinable based on a digital reference and/or a taught-in reference. The desired state of the at least one sheet 02 is preferably determined and/or configured to be determinable based on a digital, prepress-based reference and/or a taught-in reference. The digital reference and/or the taught-in reference preferably contain information regarding the at least one sheet 02 including the at least one multiple-up 1101, preferably the at least two multiple-ups 1101. The digital reference and/or the taught-in reference preferably contain information regarding the at least one sheet 02 including the at least one multiple-up 1101, preferably the at least two multiple-ups 1101, which the inspection device 916 is configured to inspect. For example, additionally, the digital reference and/or the taught-in reference contain information regarding the at least one die-cut impression 1103 of the at least one sheet 02, preferably the at least one crosspiece and/or the at least one connecting piece between two mutually adjoining multiple-ups 1101. The digital reference preferably contains at least some of the information, preferably all the information, that is necessary to unambiguously determine the required desired state of the relevant sheet 02. The digital reference is preferably configured as a digital image template. The digital reference preferably includes data which was generated in a prepress and/or has been derived from the prepress. The digital reference preferably has a pdf or tif or jpg data format. The taught-in reference is preferably a sheet 02 that is configured as a sample sheet and/or, for example, is detected by the inspection device 916 and/or stored in the evaluation means as a basis for comparison. The inspection device 916 is preferably configured to inspect the at least one sample sheet, preferably the at least two sample sheets, more preferably a plurality of sample sheets, so as to create the taught-in reference. The inspection device 916 is preferably configured to detect individual points of the at least one sample sheet and is accordingly configured to check the surrounding environment thereof within the at least one sheet 02.

The inspection device 916, in particular the evaluation means, is preferably configured to ascertain a degree of a deviation of the at least one sheet opening 1102L and/or of the at least one inner contour and/or of the at least one outer contour of the sheet 02 from the desired state of the respective, preferably the at least one, sheet 02. Depending on the result of the ascertained degree of the deviation of the at least one sheet opening 1102L and/or of the at least one inner contour and/or of the at least one outer contour of the sheet 02 from the desired state of the respective, preferably the at least one, sheet 02, the inspection device 916, in particular the evaluation means, is preferably configured to output a signal, for example an optical signal and/or an open-loop signal and/or closed-loop control signal. If the degree of the deviation is within the scope of the tolerance of the desired state of the relevant sheet 02, the inspection device 916, in particular the evaluation means, is preferably configured to output at least one "good" signal, i.e., the relevant, preferably the at least one sheet, 02 is considered to be fine. If the degree of the deviation is outside the scope of the tolerance of the desired state of the relevant sheet 02, the inspection device 916, in particular the evaluation means, is preferably configured to output at least one "bad" signal, i.e., the relevant, preferably the at least one sheet, 02 is not considered to be fine. For example in addition or as an alternative to the at least one "bad" signal, the inspection device 916, in particular the evaluation means, is preferably configured to transmit at least one signal for closed-loop control and/or open-loop control to the sheet diverter 49.

If, for example, a sheet opening 1102L comprises at least a remaining portion of the at least one offcut piece 1102A, the actual state of the relevant sheet 02 deviates from the desired state of the relevant sheet 02. If the remaining portion of the offcut piece 1102A, for example, has a surface area of less than 25 $mm^2$ (twenty-five square millimeters), preferably of less than 20 $mm^2$, more preferably of less than 15 $mm^2$, the degree of the deviation is preferably within the scope of the tolerance of the desired state of the particular sheet 02, and the at least one "good" signal is output. For example, in the case of a surface area of at least 25 $mm^2$ (twenty-five square millimeters), preferably at least 30 $mm^2$, more preferably 35 $mm^2$, of the at least one remaining portion of the offcut piece 1102A, the at least one "bad" signal is preferably output.

In addition or as an alternative, the sheet processing machine 01 is preferably characterized in that the sheet processing machine 01 comprises at least one application mechanism 614 for applying at least one print image onto sheets 02, preferably an application mechanism 614 applying at least one print image, and that the inspection device 916 comprises an evaluation means and/or is connected to an evaluation means, and that the inspection device 916 and/or the evaluation means are at least configured to evaluate at least one color register of the at least one print image of the at least one sheet 02 and/or at least configured to compare the at least one print image of the at least one sheet 02 to the at least one sheet opening 1102L and/or the at least one inner contour and/or the at least one outer contour of the particular sheet 02. The inspection device 916 and/or the evaluation means are preferably configured to evaluate the at least one color register and/or to compare the at least one print image of the at least one sheet 02 to the at least one sheet opening 1102L and/or the at least one inner contour and/or the at least one outer contour of the at least one sheet 02. The inspection device 916 is preferably configured to evaluate the at least one color register of the at least one print image of the at least one sheet 02 and/or at least configured to compare the at least one print image of the at least one sheet 02 to the at least one sheet opening 1102L and/or the at least one inner contour and/or the at least one outer contour of the particular sheet 02.

Above and below, in accordance with DIN 16500-2, a color register, for example in a multicolor printing process, refers to a joining of individual print images in the correct position to form an image, wherein the individual print images were applied, for example, by different application mechanisms 614 and/or, for example, by at least two different application fluids.

If the sheet processing machine 01, in addition to the shaping device 900, comprises at least one application unit 600 comprising at least one application mechanism 614, the inspection device 916 is preferably configured to at least partially detect and/or evaluate, preferably to detect and/or to evaluate, the at least one print image on sheets 02, which was applied by the at least one application mechanism 614. The inspection device 916 is preferably configured to detect the at least one print image of the relevant sheet 02 as at least one informational component of the actual state of the particular sheet 02, and to preferably compare this state to the desired state regarding the sheet 02, for example by the evaluation means. As an alternative or in addition, the inspection device 916 is preferably configured to at least partially detect, preferably to detect, the at least one print image, and to at least partially detect, preferably to detect, the at least one sheet opening 1102L and/or the at least one inner contour and/or the at least one outer contour of sheets 02. The inspection device 916, in particular the evaluation means, is preferably configured to compare the at least one print image of the sheet 02 at least to the contour of the respective, preferably the at least one, sheet 02, for example by comparing the actual state to the desired state of the particular sheet 02.

In addition or as an alternative, the sheet processing machine 01 is preferably characterized in that the inspection device 916 comprises the evaluation means or is connected to the evaluation means, and that the inspection device 916 and/or the evaluation means are configured to ascertain a degree of tool wear of the at least one tool of the at least one shaping device 900. The shaping device 900, in particular the shaping mechanism 914 and/or the plate cylinder 901, preferably comprise the at least one tool, preferably at least one cutting tool and/or at least one creasing tool and/or at least one perforating tool and/or at least one embossing tool and/or at least one die-cutting tool, for processing sheets 02. The shaping device 900, in particular the shaping mechanism 914 and/or the plate cylinder 901, is preferably configured to process sheets 02 by way of the at least one tool. The tool is configured to be subject to wear due to the processing of sheets 02. The inspection device 916 is preferably configured to ascertain the degree of wear of the at least one tool of the shaping device 900, in particular of the shaping mechanism 914, preferably of the plate cylinder 901, by detecting sheets 02, in particular inspecting the at least one remaining portion of the at least one sheet 02 processed by the shaping device 900, the sheet including at least one multiple-up 1101, and/or by preferably comparing the actual state of the respective, preferably the at least one, sheet 02 to the desired state of the relevant, preferably the at least one, sheet 02. The inspection device 916 preferably ascertains the degree of wear of the at least one tool of the shaping device 900. For example, due to the direct contact between the tool of the shaping device 900, in particular of the shaping mechanism 914, preferably of the plate cylinder 901, with the counterpressure cylinder 902 and/or the sheet 02, at least an external force acts on the tool and, for example, causes wear of the tool and/or counterpressure cylinder 902.

In addition, or as an alternative, the sheet processing machine 01 is preferably characterized in that the inspection device 916 comprises the evaluation means or is connected to the evaluation means, and that the inspection device 916 and/or the evaluation means are configured to ascertain a degree of wear of at least one surface of the at least one counterpressure cylinder 902 of the at least one shaping device 900. The at least one counterpressure cylinder 902, for example in the case of a rotary die-cutting device 900, preferably has a surface that is preferably in direct contact with the tool of the shaping device 900, in particular the tool of the plate cylinder 901. For example, due to the direct contact between the surface of the counterpressure cylinder 902 and the tool of the shaping device 900, preferably of the plate cylinder 901, at least an external force acts on the surface of the counterpressure cylinder 902 and, for example, causes wear of the counterpressure cylinder 902 and/or of the particular tool.

The inspection device 916, in particular the evaluation means, is preferably configured to store and evaluate data about the respective transported sheets 02, and preferably to create at least one report about the quality of the sheets 02. The respective transported sheets 02 preferably encompass the at least one sheet 02 and at least one further sheet 02 of the sheets 02. The inspection device 916 is preferably configured to store and evaluate data about the at least one sheet 02 and respective further transported sheets 02 of the sheets 02, and to create at least one report about a quality of the sheets 02. The report preferably includes at least the total number of processed sheets 02 within at least one unit of time and/or a joint job and/or the number and/or percentage of processed sheets 02 that were in each case guided to the delivery pile carrier 48 and/or to the diverted delivery unit 51. In addition, or as an alternative, the report preferably includes a total number of multiple-ups 1101 and/or the number and/or percentage of multiple-ups 1101 that were in each case guided to the delivery pile carrier 48 and/or to the diverted delivery unit 51. In addition, or as an alternative, the report preferably contains at least one piece of information about the respective cause for channeling the relevant sheets 02 and/or multiple-ups 1101 to the diverted delivery unit 51. The cause for the channeling out to the diverted delivery unit 51 is, for example, the degree of the deviation of the at least one sheet opening 1102L and/or inner contour and/or outer contour of the particular sheet 02 from the desired state of the relevant sheet 02, additionally or alternatively the evaluation of the at least one color register of the at least one print image of the relevant sheet 02 and/or the comparison of the at least one print image to at least one sheet opening 1102L and/or inner contour and/or outer contour of the relevant sheet 02. In addition, or as an alternative, the report, for example, includes at least one piece of information about the degree of wear of the at least one tool of the shaping device 900. In addition, or as an alternative, the report preferably includes the degree of the position of the at least one multiple-up 1101 relative to a reference of the position of the at least one multiple-up 1101 and, additionally or alternatively, the degree of the color of the at least one print image of the particular sheet 02 and/or multiple-up 1101 and, additionally or alternatively, the degree of at least one defect of the at least one processing operation of the particular sheet 02 and/or multiple-up 1101 and/or of the at least one print image of the particular sheet 02 and/or multiple-up 1101. For example, the report includes further information that is preferably detected and/or detectable by the at least one inspection device 916 or also by further components of the sheet processing machine 01. It is thus possible, for example, to exactly set, and preferably to guarantee, a desired and/or required quality of the sheets 02 preferably processed by the shaping machine 900, for example in the delivery pile 28 of the delivery unit 1000.

In addition, or as an alternative, the sheet processing machine 01 is preferably characterized in that the inspection device 916 is preferably configured to ascertain a degree of a position of the at least one multiple-up 1101 relative to a reference of the position of the at least one multiple-up 1101 and, additionally or alternatively, a degree of the color of at least one print image of the particular sheet 02 and, additionally or alternatively, a degree of at least one defect of a processing operation of the particular sheet 02 and/or of a print image of the particular sheet 02 due to missing portions and/or additional portions, from the comparison of the actual state of the at least one sheet 02 to the desired state of the respective, preferably the at least one, sheet 02.

As an alternative or in addition, the sheet processing machine 01 is preferably characterized in that at least one transport means 07 configured as a sheet decelerating means 07 is arranged downstream from the at least one selective transport means 906 along the transport path provided for the transport of sheets 02, which more preferably is arranged at least partially and more preferably entirely above a delivery pile carrier 48 of the sheet delivery unit 1000. The at least one sheet decelerating means 07 is used, in particular, to decelerate sheets 02 before they are deposited onto a delivery pile 28. The at least one sheet decelerating means 07 is preferably configured to decelerate sheets 02.

In addition, or as an alternative, the sheet processing machine 01 is preferably characterized in that at least one change of the transport path provided for the transport of sheets 02, in particular a sheet diverter 49, is controlled by open-loop and/or closed-loop control and/or configured to be controllable by closed-loop control and/or configured to be controllable by open-loop control, downstream from the inspection device 916 and upstream from the at least one delivery unit 1000, preferably upstream from the sheet delivery unit 1000, in the transport direction T. The change of the transport path for channeling and/or diverting sheets 02 onto a transport path that bypasses the actual transport path is preferably configured to channel out and/or divert sheets 02. The change of the transport path, in particular the sheet diverter 49, is preferably configured to channel out and/or divert sheets 02 onto a transport path that bypasses the at least one sheet decelerating means 07. The change of the transport path, in particular the at least one sheet diverter 49, is used, for example, to channel out at least one sheet 02, in particular a test sheet to be inspected and/or at least one waste sheet. The at least one sheet diverter 49 is preferably configured to channel out the at least one sheet 02. More preferably, the sheet processing machine 01 is characterized in that the change of the transport path, in particular the at least one sheet diverter 49, for channeling sheets 02 onto a transport path that bypasses the at least one sheet decelerating means 07 is arranged between the at least one separation device 903 and the at least one sheet decelerating means 07 along the transport path provided for the transport of sheets 02.

The at least one sheet diverter 49 comprises at least one deflecting element, for example, more preferably multiple deflecting elements, which are arranged side by side based on the transverse direction A. The deflecting elements are preferably arranged in such a way that they can be switched, in particular pneumatically, between a color register position and a deflected position. When at least one deflecting element is in the pass-through position, at least one respective sheet 02 is preferably passed on along the transport path provided for the transport of sheets 02 to the at least one sheet decelerating means 07 and/or the delivery pile carrier 48. When at least one deflecting element is in the deflecting position, at least one respective sheet 02 is preferably passed on to the transport path that bypasses the at least one sheet decelerating means 07 and/or to a diverted delivery unit 51. At least one guide 52, in particular at least one guide plate 52, is preferably provided, by means of which more preferably the passing-on to the transport path that bypasses the at least one sheet decelerating means 07 and/or to the diverted delivery unit 51 is preferably carried out. For example, sheets 02 are guided by means of the at least one deflecting element between two guides 52, which initially act as upper and lower guides 52 and which, as a result of their curvature, become forward and rear guides 52 during the further course of the transport path. The at least one deflecting element is arranged, for example, in such a way that, in its deflecting position, it is arranged between at least two conveyor belts and/or transport belts of the at least one selective transport means 09; 906 in the transverse direction.

In addition or as an alternative, the sheet processing machine 01 is preferably characterized in that the inspection device 916 comprises the evaluation means or is connected to the evaluation means, and that the change of the transport path of a relevant, preferably the at least one, sheet 02, in particular the sheet diverter 49, is controlled by open-loop control and/or closed-loop control and/or configured to be controllable by closed-loop control and/or configured to be controllable by open-loop control based on at least one signal of the evaluation means. The change of the transport path, in particular the sheet diverter 49, is preferably controlled by closed-loop control and/or open-loop control and/or configured to be controllable by closed-loop control and/or configured to be controllable by open-loop control as a function of the evaluation of the detected sheet 02 by the evaluation means, preferably by the evaluation means of the inspection device 916. For example, a signal can be transmitted from the evaluation means, in particular from the evaluation means of the inspection device 916, to an open-loop control unit and/or closed-loop control unit of the sheet diverter 49, which prompts and/or is configured to prompt a closed-loop control of the sheet diverter 49 and/or a change of the transport path.

In addition, or as an alternative, the sheet processing machine 01 is preferably characterized in that the transport path between the inspection device 916 and the position of the change of the transport path of the relevant, preferably the at least one, sheet 02, in particular of the sheet diverter 49, is at least 30 cm (thirty centimeters), preferably at least 40 cm, more preferably at least 50 cm. The transport path between the inspection device 916 and the sheet diverter 49 preferably has a length that the particular transported sheet 02 is preferably configured to travel in at least 50 ms (fifty milliseconds), preferably in at least 80 ms, more preferably in at least 100 ms, as a function of the speed of the transported sheets 02. The transport path between the inspection device 916 and the sheet diverter 49 preferably has a length that the particular transported sheet 02 is preferably configured to travel in no more than 1000 ms (thousand milliseconds), preferably in no more than 800 ms, more preferably in no more than 300 ms, as a function of the speed of the transported sheets 02.

In addition, or as an alternative, the respective at least one selective transport means 09; 906 preferably comprises at least two, and more preferably at least five, transport belts arranged side by side in the transverse direction A and/or spaced apart in the transverse direction A. For example, multiple suction belts are in each case arranged as the at least one selective transport means 09; 906. These suction belts, for example, in each case have a width that is preferably at least 10 mm, more preferably at least 20 mm, still more preferably at least 50 mm, and that is preferably no more than 200 mm, more preferably no more than 100 mm, and still more preferably no more than 80 mm. Overall, these suction belts preferably cover at least 10%, more preferably at least 20%, and still more preferably at least 25%, and, independently thereof, preferably no more than 50%, more preferably no more than 40%, and still more preferably no more than 35% of the working width of the sheet processing machine 01.

As an alternative or in addition, the sheet processing machine 01 is preferably characterized in that two selective transport means 09; 906 are arranged behind one another along the transport path provided for the transport of sheets 02 and/or in the transport direction T. A first of these at least two selective transport means 09; 906, based in particular on the transport path provided for the transport of sheets 02 and/or the transport direction T, is configured as an output transport means 906 of the at least one shaping device 900. The at least one output transport means 906 of the at least one shaping device 900 is used, for example, to ensure that only sheets 02 without scrap pieces 1102A are passed on. A second and/or last of these at least two selective transport means 09; 906, based in particular on the transport path provided for the transport of sheets 02 and/or the transport direction T, is configured as a sheet transfer means 09. The at least one sheet transfer means 09 is used, for example, to pass on sheets 02 that are intended for the delivery pile 28 and/or is configured to pass on these sheets 02. The at least one sheet transfer means 09 is assigned to the sheet delivery unit 1000, for example. The operating zone of the at least one sheet diverter 49 is located, for example, at a point along the transport path provided for the transport of sheets 02 that, as viewed in the transport direction T, is situated no more than 100 cm, more preferably no more than 50 cm, and still more preferably no more than 20 cm from both the at least one output transport means 906 and the at least one sheet transfer means 09. A modular structure can then be implemented, for example, and/or is implemented, for example, in which the at least one output transport means 906 can be adapted to respective machine conditions, while the at least one sheet transfer means 09 has a standardized configuration. The at least one diverted delivery unit 51 and/or the at least one guide 52 are preferably arranged beneath the at least one sheet transfer means 09.

In addition, or as an alternative, each of the at least two selective transport means 09; 906 is preferably configured as a respective suction transport means 09; 906. The at least one selective transport means 09; 906 preferably comprises at least one dedicated drive 21; 913, which more preferably is configured, in particular, as a closed loop position-controlled electric motor 21; 913. More preferably, each of the at least two selective transport means 09; 906 comprises a dedicated drive 21; 913, which more preferably is configured, in particular, as a closed loop position-controlled electric motor 21; 913. In particular, the at least one output transport means 906 preferably comprises at least one drive 913, e.g., an output drive 913, which more preferably is configured, in particular, as a closed loop position-controlled electric motor 913. The at least one output transport means 906, and in particular its drive controller, is preferably connected to the machine controller of the processing machine 01 and/or to the electronic master axis, in particular via the BUS system.

As an alternative or in addition, the sheet processing machine 01 is preferably characterized in that at least one imbricating device 46 is arranged between the at least one selective transport means 906 on the one hand and the at least one sheet decelerating device 07 on the other along the transport path provided for the transport of sheets 02. As an alternative or in addition, the sheet processing machine 01 is preferably characterized in that the at least one imbricating device 46 is arranged between the at least one sheet diverter 49 on the one hand and the at least one sheet decelerating device 07 on the other along the transport path provided for the transport of sheets 02. As an alternative or in addition, the sheet processing machine 01 is preferably characterized by comprising at least one transport means 08 configured as an upper suction transport means 08 and/or as a sheet infeed means 08. More preferably, the at least one upper suction transport means 08 of the at least one imbricating device 46 is configured as a passively driven suction transport means 08 and/or as a sliding suction device 08.

As an alternative or in addition, the sheet processing machine 01 is preferably characterized in that the delivery unit 1000, preferably the sheet delivery unit 1000, comprises at least one forward pile limiter 04 and/or in that a delivery pile area is at least delimited by the at least one rear sheet stop 03 and the at least one forward pile limiter 04 and/or in that the sheet delivery unit 1000 comprises at least one upper sheet transport system 06, which is configured for a hanging transport of sheets 02 and comprises the at least one imbricating device 46, and/or that the at least one imbricating device 46 produces imbrication for an imbricated, hanging transport of at least two sheets 02 at at least one point situated above the delivery pile area, as viewed in the vertical direction V.

As an alternative or in addition, the sheet processing machine 01 is preferably characterized in that the at least one upper sheet transport system 06 configured for a hanging transport of sheets 02 comprises at least one sheet infeed means 08 configured as an upper suction transport means 08 and at least one sheet decelerating means 07 configured as an upper suction transport means 07 and/or that the at least one sheet infeed means 08 is at least partially arranged upstream from the at least one sheet decelerating means 07, based on the transport direction T and/or that the at least one sheet infeed means 08 is at least partially arranged upstream from the at least one forward pile limiter 04, based on the transport direction T and/or extends beyond the at least one forward pile limiter 04 and/or that at least one downwardly acting, activatable displacement element 12 is arranged in the region of the at least one sheet infeed means 08, based on the transport path provided for the transport of sheets 02 and/or the transport direction T, and/or that at least one downwardly acting, activatable displacement element 12 is positioned in such a way that its displacement region at least partially overlaps with a transporting section, determined by the at least one sheet infeed means 08, of the transport path provided for the transport of sheets 02, based on the transport direction T.

As an alternative or in addition, the sheet processing machine 01 is preferably characterized in that the at least one sheet decelerating means 07 is arranged entirely downstream from the at least one forward pile limiter 04, based on the transport path provided for the transport of sheets 02 and/or the transport direction T. It is then preferably ensured that a succeeding sheet 02 is not negatively influenced by the at least one sheet decelerating means 07. As an alternative or in addition, the sheet processing machine 01 is preferably characterized in that the at least one sheet decelerating means 07 is the next transport means 07 following the at least one sheet infeed means 08, based on the transport path provided for the transport of sheets 02 and/or the transport direction T.

As an alternative or in addition, the sheet processing machine 01 is preferably characterized in that transport means 906; 07; 08; 09 configured exclusively as upper suction transport means 906; 07; 08; 09 and/or transport means 906; 07; 08; 09 for sheets 02 that are provided for a hanging transport of sheets 02 are arranged along the transport path provided for the transport of sheets 02, extending from a point downstream from the at least one separation transport means 904 to a point above the delivery pile carrier 48 of the sheet delivery unit 1000.

For example, at least one transport means 909 configured as a shaping point 909 and acting and/or capable of acting on sheets 02 from above and beneath is arranged along the transport path provided for the transport of sheets 02. For example, at least one transport means 904 configured as a separation transport means 904 and preferably acting and/or capable of acting on sheets 02 from above and beneath is arranged downstream from the at least one shaping point 909 along the transport path provided for the transport of sheets 02. For example, at least one transport means 906 configured as an output transport means 906 and preferably intended for a hanging transport of sheets 02 and/or acting and/or capable of acting on sheets 02 only from above is arranged downstream from the at least one separation transport means 904 along the transport path provided for the transport of sheets 02. A transfer point for the hanging transfer of sheets 02 to a succeeding upper suction transport means 09 is preferably situated at the end of the at least one output transport means 906 along the transport path provided for the transport of sheets 02.

For example, at least one transport means 09 configured as a sheet transfer means 09 and preferably intended for a hanging transport of sheets 02, and/or acting and/or capable of acting on sheets 02 only from above, is arranged downstream from the at least one output transport means 906 along the transport path provided for the transport of sheets 02. For example, at least one transport means 08 configured as a sheet infeed means 08 and preferably intended for a hanging transport of sheets 02, and/or acting and/or capable of acting on sheets 02 only from above, is arranged downstream from the at least one sheet transfer means 09 along the transport path provided for the transport of sheets 02. For example, at least one transport means 07 configured as a sheet decelerating means 07 and preferably intended for a hanging transport of sheets 02, and/or acting and/or capable of acting on sheets 02 only from above, is arranged downstream from the at least one sheet infeed means 08 along the transport path provided for the transport of sheets 02.

In addition, or as an alternative, the sheet delivery unit 1000 is preferably a sheet delivery unit 1000 of a sheet processing machine 01. The sheet delivery unit 1000 preferably comprises at least one rear sheet stop 03, also referred to as a rear pile limiter 03. The sheet delivery unit 1000 preferably comprises at least one forward pile limiter 04, also referred to as a forward sheet stop 04. The transport direction T is preferably a horizontal direction T that is oriented from the forward pile limiter 04 toward the rear sheet stop 03.

As an alternative or in addition, the sheet delivery unit 1000 is preferably characterized in that the sheet delivery unit 1000 comprises at least one sheet transport system 06 configured in particular for a hanging transport of sheets 02, which more preferably is configured as an upper sheet transport system 06. The in particular upper sheet transport system 06 preferably comprises at least one sheet infeed means 08 configured as an upper suction transport means 08. The in particular upper sheet transport system 06 preferably comprises the at least one sheet decelerating means 07 configured as an upper suction transport means 07. The at least one sheet infeed means 08 is preferably at least partially arranged upstream from the at least one sheet decelerating means 07, based on the transport direction T. In particular, the at least one sheet decelerating means 07 is preferably at least partially arranged downstream from the at least one sheet infeed means 08, based on the transport direction T.

As an alternative or in addition, the sheet delivery unit 1000 is preferably characterized in that the at least one sheet infeed means 08 and the at least one sheet decelerating means 07 are arranged in such a way that the at least one sheet infeed means 08 and the at least one sheet decelerating means 07 overlap partially, based on transport direction T. This means, in particular, that in this case, at least one component of the at least one sheet infeed means 08 and at least one component of the at least one sheet decelerating means 07 are preferably arranged side by side in the transverse direction A. In a possible refinement, a component of a transport surface 22 of the at least one sheet decelerating means 07 is arranged in the transverse direction A next to a component of a transport surface 23 of the at least one sheet infeed means 08.

In addition, or as an alternative, at least one sheet transfer means 09 is preferably arranged at least partially upstream from the at least one sheet infeed means 08, and more preferably entirely upstream from the at least one sheet decelerating means 07, based on the transport direction T and/or along the transport path provided for the transport of sheets 02. The at least one sheet transfer means 09 is preferably used to feed sheets 02 coming from a region of the processing machine 01 that is further upstream to the sheet delivery unit 1000 and/or to the at least one sheet infeed means 08 and/or is configured to feed the sheets 02 to the sheet delivery unit 1000 and/or to the sheet infeed means 08. The at least one sheet transfer means 09 is configured, for example, as a component of the sheet delivery unit 1000 or as a component of another unit 600; 700; 900, for example as a component of the at least one shaping unit 900 or die-cutting unit 900 or as a component of an application unit 600 or as a component of a transport unit 700.

In addition, or as an alternative, the at least one sheet transfer means 09 is preferably configured as at least one upper suction transport means 09, more preferably as at least one suction belt 09. The at least one sheet transfer means 09 preferably comprises a plurality of transport belts 38 arranged side by side in the transverse direction A, each having intake openings 36. The transport belts 38 of the at least one sheet transfer means 09 preferably establish a transport surface 24 of the at least one sheet transfer means 09. The individual transport belts 38 of the at least one sheet transfer means 09 are preferably arranged spaced apart from one another. The spaces situated therebetween preferably provide room for arranging the at least one sheet transfer means 09 and the at least one sheet infeed means 08 with partial overlap, based on the transport direction T.

In a preferred embodiment, at least one sheet transfer means 09 configured as an upper suction transport means 09 is arranged at least partially upstream from the at least one sheet infeed means 08, and more preferably entirely upstream from the at least one sheet decelerating means 07, based on the transport direction T In particular, the at least one sheet infeed means 08 is preferably arranged at least partially downstream from the at least one sheet transfer means 09, based on the transport direction T.

In addition, or as an alternative, at least one drive 21 configured as a transfer means drive 21 is preferably provided, by means of which the at least one sheet transfer means 09 can be driven, in particular with respect to movements of the transport surface 24 of the at least one sheet transfer means 09, at least in the transport direction T. The at least one transfer means drive 21 is preferably configured in particular as a closed loop position-controlled electric motor 21. The at least one transfer means drive 21, and in particular its drive controller, is preferably connected to the machine controller of the processing machine 01 and/or to the electronic master axis, in particular via the BUS system.

In a preferred embodiment, the at least one sheet transfer means 09 and the at least one sheet infeed means 08 partially overlap, based on the transport direction T. This means, in particular, that in this case, at least one component of the at least one sheet transfer means 09 and at least one component of the at least one sheet infeed means 08 are preferably arranged side by side in the transverse direction A. In a possible refinement, a component of the transport surface 24 of the at least one sheet transfer means 09 is arranged in the transverse direction A next to a component of the transport surface 23 of the at least one sheet infeed means 08.

As an alternative or in addition, the sheet delivery unit 1000 is preferably characterized in that the at least one sheet infeed means 08 begins upstream from the at least one forward pile limiter 04 and also ends upstream from the at least one forward pile limiter 04. As an alternative or in addition, the sheet delivery unit 1000 is preferably characterized in that the at least one sheet infeed means 08 extends in particular beyond the at least one forward pile limiter 04, based on the transport direction T, i.e., in particular begins upstream from the at least one forward pile limiter 04 and ends downstream from the at least one forward pile limiter 04. Preferably, the sheets 02 are held, in particular are held overhead, at least temporarily by means of the at least one sheet infeed means 08 in a region situated vertically above the at least one forward pile limiter 04, in particular while they are being transported. The at least one sheet infeed means 08 is preferably configured as a roller suction system 08, and more preferably comprises a plurality of transport rollers 26. The at least one roller suction system 08 comprises multiple shafts, for example, each of which can be rotated about a respective axis, with each axis extending in the transverse direction A. On each of these shafts, multiple transport rollers 26 are arranged side by side, for example, in particular spaced apart from one another, in the transverse direction A. Preferably, however, the at least one sheet infeed means 08 comprises multiple individual guide elements 39, each of which comprises a plurality of transport rollers 26 that are arranged behind one another in the transport direction T, and more preferably can be turned and/or rotated independently of one another. Each such guide element 39 comprises exactly one row of such transport rollers 26, for example. The transport rollers 26 are preferably mounted in a respective housing of the respective guide element 39, which more preferably also forms a corresponding vacuum chamber. The respective guide elements 39 are arranged spaced apart from one another in the transverse direction A, for example. The guide elements 39 are arranged, for example, at least partially, for example at one of their ends, in a respective space between transport belts 38 of the at least one sheet transfer means 09, and at their other end are arranged in a respective space between transport belts 37 of the at least one sheet decelerating means 07.

As an alternative or in addition, the sheet delivery unit 1000 is preferably characterized in that the at least one sheet infeed means 08 is configured as a passively driven suction transport means 08, in particular based on a transport of sheets in the transport direction T and/or with respect to its transport surface 23. A passively driven suction transport means 08 shall be understood to mean in particular as a suction transport means 08 that does not have a dedicated drive for moving the sheets 02 forward, and instead has at least one freely movable, in particular freely rotatable transport surface 23, which is set in motion solely by way of contact with a sheet 02. Even though the passively driven suction transport means 08 uses a vacuum to hold the sheets 02 on its transport surface 23, it preferably does not actively influence their movement in the transport direction T.

In a preferred embodiment, the at least one sheet infeed means 08 configured as a passively driven suction transport means 08 and as a roller suction system 08 offers the advantage that portions of at least two sheets 02 can thus be transported and/or, for example, are transported simultaneously at different speeds. A vacuum preferably exists in the sheet infeed means 08 continuously during operation of the sheet processing machine 01.

As an alternative or in addition, the sheet delivery unit 1000 is preferably characterized in that at least one decelerating means drive 19 is provided, by means of which the at least one sheet decelerating means 07 can be driven. The at least one decelerating means drive 19 is preferably configured, in particular, as a closed loop position-controlled electric motor 19. The at least one decelerating means drive 19, and in particular its drive controller, is preferably connected to the machine controller of the processing machine 01 and/or to the electronic master axis, in particular via the BUS system. The at least one sheet decelerating means 07 can be used to decelerate sheets 02, for example from a transfer speed and/or to a final speed. The transfer speed is preferably a speed at which sheets 02 are fed to the sheet delivery unit 1000. The final speed is preferably a speed, based on the transport path provided for the transport of sheets 02 and/or on the transport direction T, at which sheets 02 are transported at the moment at which they are detached from the at least one sheet decelerating means 07. The final speed is preferably zero. A downward movement for depositing the respective sheets 02 on a delivery pile 28 is not factored into this speed.

In a preferred embodiment, the at least one sheet decelerating means 07 is preferably configured as at least one suction belt 07. The at least one sheet decelerating means 07 preferably comprises a plurality of transport belts 37 arranged side by side in the transverse direction A, each having intake openings 36. The transport belts 37 of the at least one sheet decelerating means 07 preferably establish the transport surface 22 of the at least one sheet decelerating means 07. The individual transport belts 37 of the at least one sheet decelerating means 07 are preferably arranged spaced apart from one another. The spaces therebetween provide room for at least one dropping means 32, for example, and preferably for one dropping means each. The spaces therebetween alternatively or additionally provide room for arranging the at least one sheet decelerating means 07 and the at least one sheet infeed means 08 with partial overlap, based on the transport direction T.

As an alternative or in addition, the sheet delivery unit 1000 is preferably characterized in that the sheet delivery unit 1000 comprises at least one dropping means 32, which can be moved between at least one standby position and at least one dropping position, and that, in its at least one standby position, the at least one dropping means 32 is positioned entirely above the portion of the transport surface 22 of the at least one sheet decelerating means 07 which helps to establish the transport path provided for the transport of sheets 02, and that, in its at least one dropping position, the at least one dropping means 32 protrudes at least partially downwardly to a point beneath this portion of the transport surface 22 of the at least one sheet decelerating means 07. The at least one dropping means 32 is in particular used to press sheets 02 downward in a targeted, in particular controlled and/or regulated manner, and/or to release it from the at least one sheet decelerating means 07, in particular so that the respective sheet 02 can be deposited onto the delivery pile 28. In particular, the at least one dropping means 32 is configured to press sheets 02 downward, for example, in a targeted manner and/or to detach them from the at least one sheet decelerating means 07. At least one dropping drive 33; 34 is preferably provided, by means of which at least one dropping means 32 can be moved. The at least one dropping drive 33; 34 is preferably configured as an in particular closed loop position-controlled electric motor 33; 34. As an alternative or in addition, at least one hydraulic and/or at least one pneumatic dropping drive can also be provided and/or is provided, for example. As an alternative or in addition, at least one blower device can also be provided and/or is provided, for example, for effecting and/or supporting the detachment of the sheets 02 from the at least one sheet decelerating means 07. The at least one dropping drive 33; 34, and in particular its drive controller, is preferably connected to the machine controller of the processing machine 01 and/or to the electronic master axis, in particular via the BUS system.

In addition, or as an alternative, the at least one dropping means 32 is preferably connected at a first connection point 41 to a first dropping drive 33, in particular via at least one first dropping gear mechanism 43. The first dropping gear mechanism 43 comprises, for example, at least one first dropping eccentric which is connected to the first dropping drive 33 and which is connected to an upper end of a first dropping connecting rod. At a lower end, the first dropping connecting rod is preferably connected to a first guide element, for example a first guide lever. This limits the degrees of freedom of movement of this lower end of the first dropping connecting rod. This lower end of the first dropping connecting rod is connected to the respective dropping means 32 at the first connection point 41, for example via at least one first suspension element. The at least one dropping means 32 is preferably connected at a second connection point 42 to a second dropping drive 34, in particular via a second dropping gear mechanism 44. The second dropping gear mechanism 44 comprises, for example, at least one second dropping eccentric, which is connected to the second dropping drive 34 and which is connected to an upper end of a second dropping connecting rod. At a lower end, the second dropping connecting rod is preferably connected to a second guide element, for example a second guide lever. This limits the degrees of freedom of movement of the lower second end of the second dropping connecting rod. This lower end of the second dropping connecting rod is connected to the respective dropping means 32 at the second connection point 42, for example via at least one second suspension element. The first connection point 41 is preferably situated upstream from the second connection point 42, based on the transport direction T.

As an alternative or in addition, the sheet delivery unit 1000 is preferably characterized in that the sheet delivery unit 1000 comprises at least one upper sheet transport system 06 configured for a hanging transport of sheets 02, comprising at least one imbricating device 46 for the imbricated, hanging transport of at least two sheets 02, in particular for the imbricated, hanging transport of at least two sheets 02 at at least one point situated above at least one delivery pile carrier 48 and/or above a delivery pile 28 and/or above a delivery pile area, as viewed in the vertical direction V. The delivery pile area is preferably the area in which the respective delivery pile 28 is formed, in particular on the at least one delivery pile carrier 48, during operation of the sheet delivery unit 1000 and/or of the sheet processing machine 01. The delivery pile area is preferably at least delimited, in particular with respect to the transport direction T, by the at least one rear sheet stop 03 and the at least one forward pile limiter 04. The at least one delivery pile carrier 48 is, for example, a pallet and/or a component of the sheet delivery unit 1000 and/or of the sheet processing machine 01 that supports and/or is capable of supporting a pallet.

As an alternative or in addition, the sheet delivery unit 1000 is preferably characterized in that at least one displacement element 12 is provided, which acts downwardly, and in particular is capable of acting downwardly on sheets 02. The at least one displacement element 12 is preferably configured to be activatable. The at least one displacement element 12 is also preferably configured to be deactivatable. The at least one displacement element 12 can then be activated for each sheet 02 and thereafter be deactivated again and/or is activated and thereafter deactivated again, for example. The at least one displacement element 12 is preferably arranged in the region of the at least one sheet decelerating means 08, based on the transport direction T. The at least one displacement element 12 is preferably arranged in such a way that its displacement region, based on the transport direction T, preferably at least partially overlaps with a transporting section of the transport path provided for the transport of sheets 02, the section being determined by the at least one sheet infeed means 08. In particular, the at least one displacement element 12, based on the transport direction, is thus preferably arranged at least partially, and more preferably entirely, at least at a point where also at least a portion of the transport surface 23 of the at least one sheet infeed means 08 is arranged, based on the transport direction T. More preferably, the at least one displacement element 12, based on the transport direction T, is arranged at least partially, and more preferably entirely, at least at a point that is spaced apart from each transport surface 24 of the at least one sheet transfer means 09 and/or from each transport surface 22 of the at least one sheet decelerating means 07, based on the transport direction T. Preferably, the one displacement element 12 is arranged at least partially and, for example, at least temporarily entirely upstream from the at least one forward pile limiter 04, based on the transport direction T.

As an alternative or in addition, the sheet delivery unit 1000 is preferably characterized in that the at least one displacement element 12 is preferably used to displace a portion of a respective, in particular leading, sheet 02, in particular its trailing end 29. For example, the at least one displacement element 12 is configured to displace a portion of a respective, in particular leading, sheet 02. This opens up a spatial area, which can then be occupied and/or is occupied, for example, by a respective leading end 31 of a respective sheet 02 succeeding the respective leading sheet 02. The sheets 02 are thus arranged and transported at least temporarily in an imbricated state. The at least one displacement element 12 is preferably a component of the imbricating device 46. The succeeding sheet 02, based on the transport direction T, can thus enter and/or, for example, enters a portion of the transport path provided for the transport of sheets 02 in which the leading sheet 02, based on the transport direction T, is still situated, in particular because its deceleration process has not yet been fully completed and/or because it is still attached to the at least one sheet decelerating means 07. In this way, a more gentle deceleration of the sheets 02, for example, and/or a greater number of decelerated sheets 02 per unit of time can be realized and/or is realized, for example.

In addition, or as an alternative, the at least one displacement element 12 is preferably configured as at least one displacement member 12 and/or as at least one displacement opening 12. A respective displacement member 12 acts in particular on sheets 02 by being brought into contact with the respective sheet 02 and displacing it at least partially from its current position, in particular with at least one directional component that is oriented orthogonally to the transport direction T. A respective displacement opening 12 acts, in particular, on sheets 02 in that at least one displacement fluid, in particular at least one gas or gas mixture, preferably air, is expelled from the respective displacement opening 12, and this at least one displacement fluid displaces the sheet 02 at least partially from its current position, in particular with at least one directional component that is oriented orthogonally to the transport direction T. As an alternative or in addition, the sheet delivery unit 1000 is preferably characterized in that the at least one displacement element 12 is configured as at least one displacement opening 12 configured to expel a displacement fluid, and more preferably in that this displacement fluid is embodied as a gas and/or gas mixture and/or air. The at least one displacement opening 12 preferably is and/or can be connected to at least one compressed air source. A displacement element 12 configured as at least one displacement opening 12 is suitable, for example, for displacing sheets 02 that are particularly vulnerable in terms of their material and/or their surface as gently as possible.

A displacement region is preferably the region in which the at least one displacement element 12 influences and/or is capable of influencing a position of a particular sheet 02. In the case of a displacement element 12 configured as a displacement member 12, the displacement region is, for example, the spatial area that, in particular at each of its spatial elements, is and/or can be occupied at least temporarily by the at least one displacement element 12 and also is and/or can be occupied at least temporarily, in particular at other times, by at least one sheet 02. In the case of a displacement element 12 configured as a displacement opening 12, the displacement region is, for example, the spatial area into which the displacement fluid is blown, at least temporarily, and which is and/or can be occupied at least temporarily, in particular at other times, by at least one sheet 02.

As an alternative or in addition, the sheet delivery unit 1000 is preferably characterized in that the at least one displacement element 12 is configured as at least one displacement member 12, the position of which can preferably be changed between at least one pass-through position and at least one displacement position, preferably at least by means of at least one displacement drive 27. A displacement element 12 configured as at least one displacement member 12 is suitable, for example, for displacing sheets 02 as precisely as possible and for influencing succeeding sheets 02 as little as possible, particularly when contact with succeeding sheets 02 is avoided.

Figure 8A:
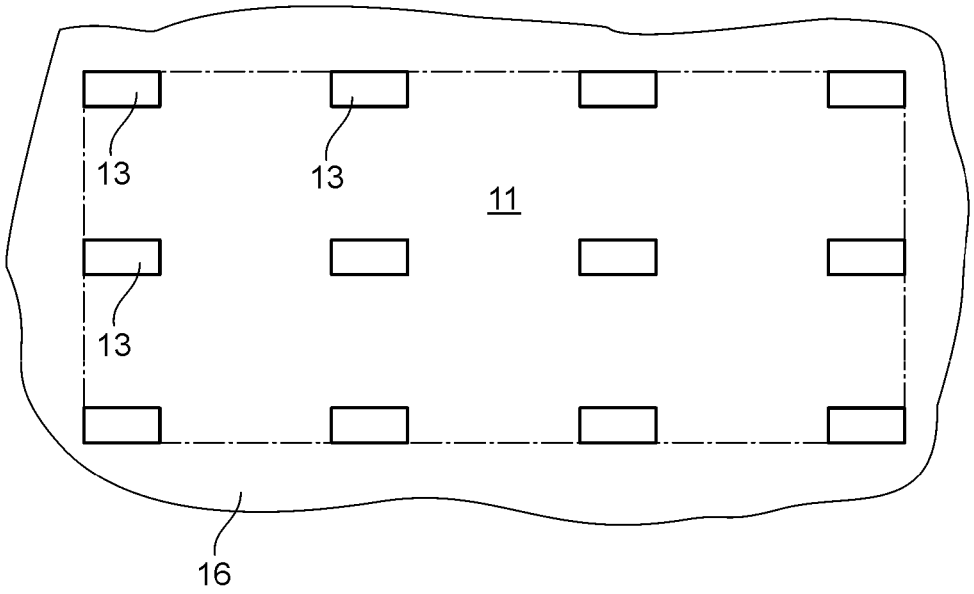
FIG. 8*a* a schematic representation to explain a respective contact region and a contact surface of a sheet infeed means.
Figure 8B:
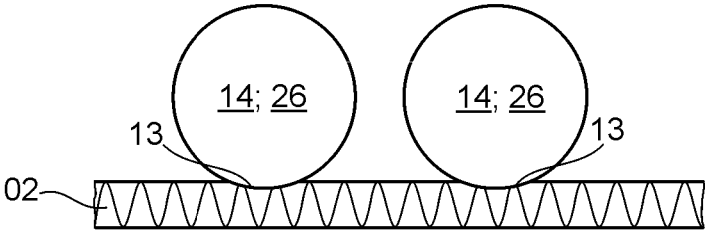
FIG. 8*b* a schematic representation to explain a respective contact region and a contact surface of a sheet infeed means.
Figure 9:
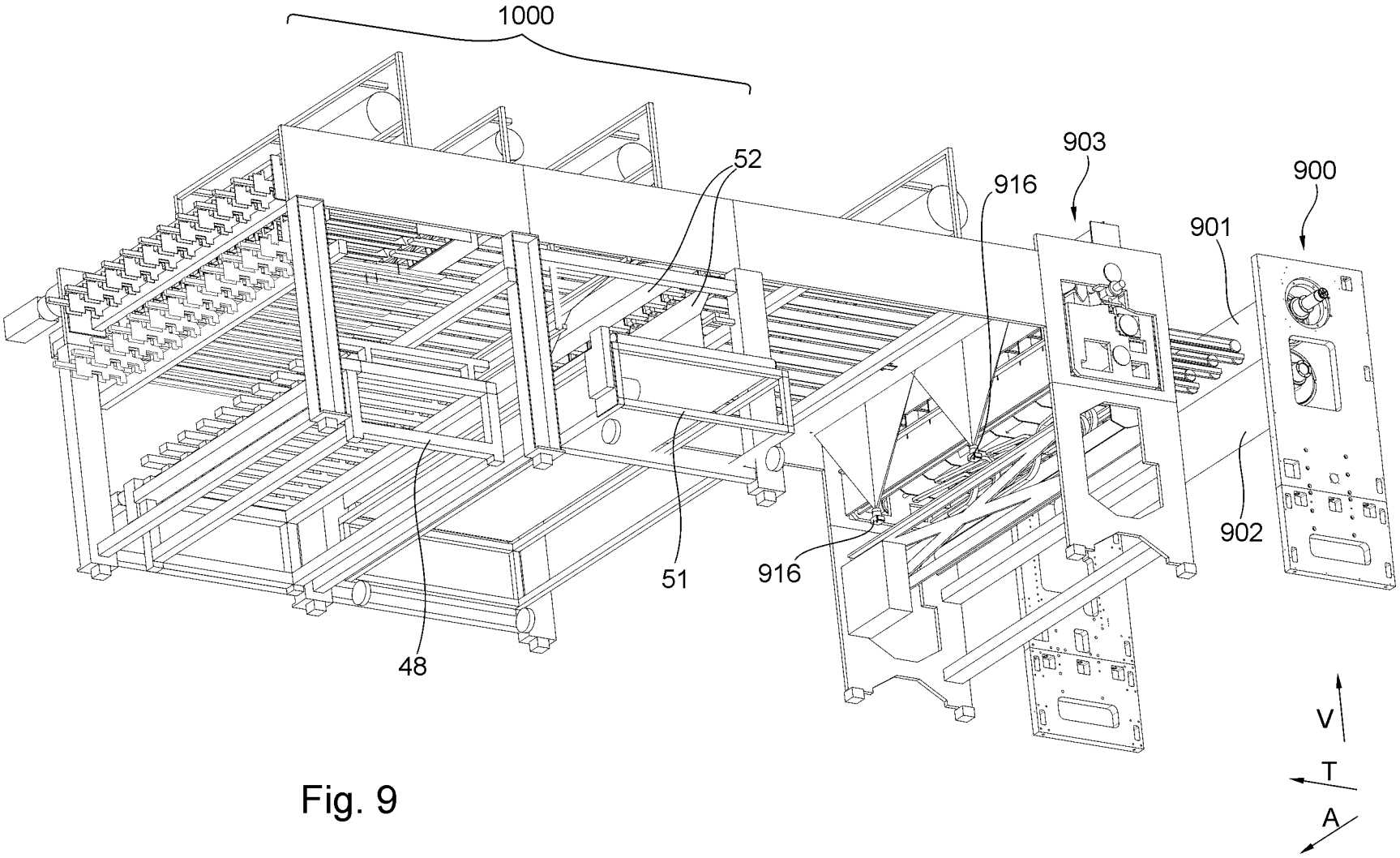
FIG. 9 a schematic representation of a shaping device and of a sheet delivery unit comprising at least one inspection device from beneath.
Figure 10:
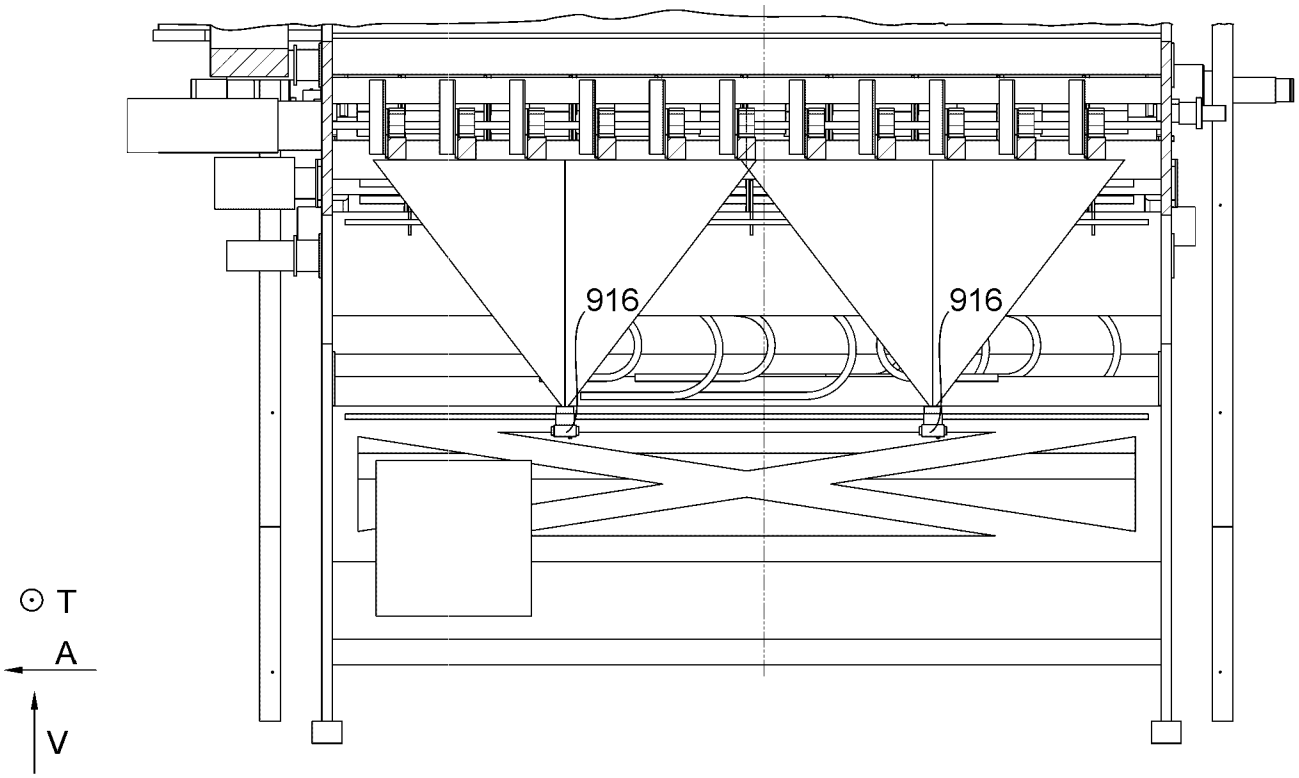
FIG. 10 a schematic representation of the at least one inspection device in a transport direction.
Figure 11:
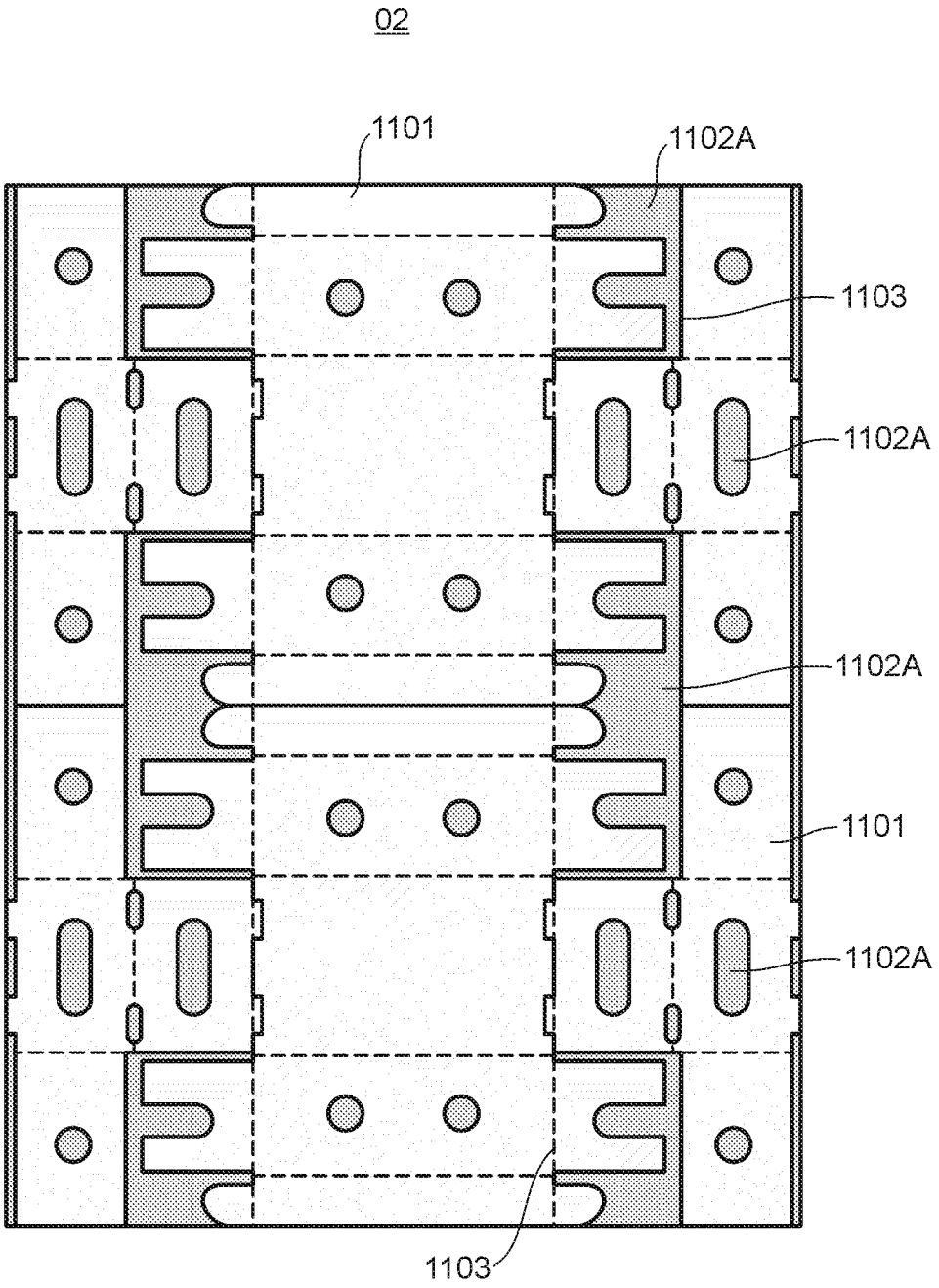
FIG. 11 an exemplary representation of a sheet comprising multiple-ups and scrap pieces.
Figure 12:
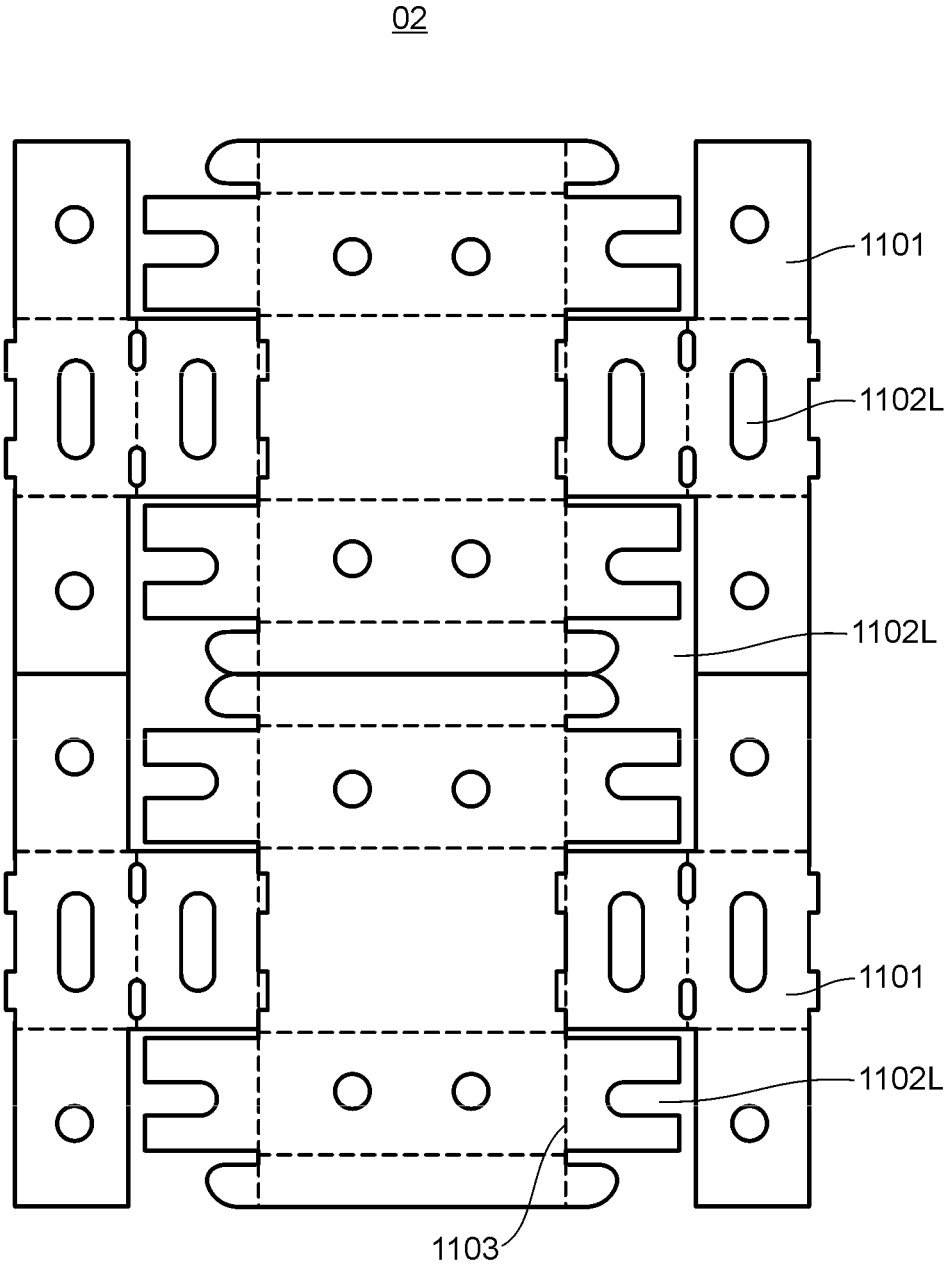
FIG. 12 an exemplary representation of a sheet comprising multiple-ups and sheet openings and/or sheet gaps.

A respective contact region 13 of the at least one sheet infeed means 08 is preferably the respective, in particular flat region 13 in which contact is provided for between a respective, in particular movable component 14 of the at least one sheet infeed means 08 on the one hand and a respective sheet 02 to be transported on the other. Such a respective component 14 is, for example, a respective transport roller 26 of the at least one sheet infeed means 08. A contact surface 16 shall preferably be understood to mean a simply connected surface 16 that comprises all the contact regions 13 of the at least one sheet infeed means 08. In mathematical terms, a surface is simply connected if every closed path located exclusively within this surface can be contracted to a point. A reference surface 11 is preferably defined as the contact surface 16, out of all contact surfaces 16, that has both the shortest boundary line and the smallest surface area. A boundary line in this context is the line that delimits this contact surface 16. (This is depicted schematically by way of example in FIGS. 8*a* and 8*b*.) As an alternative or in addition, the sheet delivery unit 1000 is preferably characterized in that, in its at least one displacement position, the at least one displacement member 12 protrudes downwardly through the reference surface 11 in a displacement region, and more preferably that, in its at least one pass-through position, the at least one displacement member 12 is entirely situated above the reference surface 11. As an alternative or in addition, the sheet delivery unit 1000 is preferably characterized in that the contact surface 16 is located at least substantially, and more preferably entirely, within a contact plane and/or that the reference surface 11 is located at least substantially, and more preferably entirely, within a reference plane. The displacement axis 17 is preferably located above a reference surface 11.

As an alternative or in addition, the sheet delivery unit 1000 is preferably characterized in that, in at least one displacement position in a displacement region, the at least one displacement member 12 protrudes downward by at least 1 mm, more preferably at least 2 mm, still more preferably at least 5 mm, still more preferably at least 9 mm, still more preferably at least 11 mm, and still more preferably at least 14 mm through the reference surface 11. The displacement region is preferably the spatial area that is located below the reference surface 11 and taken up by the at least one displacement member 12. As an alternative or in addition, the sheet delivery unit 1000 is preferably characterized in that, in at least one displacement position in the displacement region, the at least one displacement member 12 protrudes downwardly through the reference surface 11 by at least 100%, more preferably at least 120%, and still more preferably at least 150% of a maximum thickness of sheets 02 that can be processed by the sheet delivery unit 1000.

As an alternative or in addition, the sheet delivery unit 1000 is preferably characterized in that, at least in at least one displacement position based on the transport direction T, the at least one displacement member 12 is arranged at least partially upstream from the at least one forward pile limiter 04, more preferably at least 5 mm upstream, still more preferably at least 10 mm upstream, and still more preferably at least 15 mm upstream. As an alternative or in addition, the sheet delivery unit 1000 is preferably characterized in that the at least one displacement axis 17, based on the transport direction T, is arranged at least partially upstream from the at least one forward pile limiter 04, more preferably at least 5 mm upstream, still more preferably at least 10 mm upstream, and still more preferably at least 15 mm upstream. As an alternative or in addition, the sheet delivery unit 1000 is preferably characterized in that, at least in at least one displacement position based on the transport direction T, the at least one displacement member 12 is arranged at least partially upstream from the at least one sheet decelerating means 07, more preferably at least 2 cm upstream, still more preferably at least 3 cm upstream, still more preferably at least 5 cm upstream, and still preferably still at least 10 cm upstream, and independently thereof is preferably arranged no more than 50 cm upstream, and more preferably no more than 25 cm upstream. As an alternative or in addition, the sheet delivery unit 1000 is preferably characterized in that the at least one displacement axis 17, based on the transport direction T, is arranged at least partially upstream from the at least one sheet decelerating means 07, more preferably at least 2 cm upstream, still more preferably at least 3 cm upstream, still more preferably at least 5 cm upstream, and still more preferably at least 10 cm upstream, and independently thereof, is preferably arranged no more than 50 cm upstream, and more preferably no more than 25 cm upstream. As an alternative or in addition, the sheet delivery unit 1000 is preferably characterized in that a position of the at least one displacement element 12 and/or of the at least one displacement axis 17, based on the transport direction T, can be modified. The system can then be adjusted and/or is adjusted, for example, to different sheet lengths.

As an alternative or in addition, the sheet delivery unit 1000 is preferably characterized in that the at least one displacement element 12 comprises at least one contact roller 18, and more preferably at least one inherently damped contact roller 18. The inherently damped contact roller 18 preferably has an inner ring, an outer ring, and a number of spokes, the spokes more preferably each extending in a spiral shape from the inner ring to the outer ring. The at least one contact roller 18 is preferably configured as a freely rotatable contact roller 18. The at least one contact roller 18 is preferably used to enable rolling contact between a respective sheet 02 on the one hand and the at least one displacement member 12 on the other, and/or is configured to enable a rolling contact.

In a preferred embodiment, the sheet processing machine 01 is characterized in that the at least one imbricating device 46 preferably comprises at least one displacement element 12. More preferably, the at least one imbricating device 46 additionally comprises the at least one displacement drive 27 and/or the at least one contact roller 18 and/or the at least one sheet infeed means 08.

In addition, or as an alternative, the at least one displacement element 12 is preferably configured as at least one displacement lever 12, which is arranged so as to be turnable, in particular pivotable or more preferably rotatable, about a displacement axis 17, in particular by means of the at least one displacement drive 27. The at least one displacement drive 27 is preferably in particular configured as a closed loop position-controlled electric motor 27. The at least one displacement drive 27, and in particular its drive controller, is preferably connected to the machine controller of the processing machine 01 and/or to the electronic master axis, in particular via the BUS system. This allows movement profiles of the at least one displacement member 12 that are particularly precise and/or matched to movements of the sheets 02 to be implemented.

In addition, or as an alternative, the displacement axis 17 is preferably oriented parallel to the transverse direction A. Respective rotational movements of the at least one displacement member 12 about the displacement axis 17 are preferably carried out in a direction of rotation D. The direction of rotation D is preferably characterized in that rotational movements of components of the at least one displacement member 12 that rotate in the direction of rotation D and are located below the displacement axis 17, based on the vertical direction V, have a directional component that is oriented parallel to the transport direction T. As an alternative or in addition, the sheet delivery unit 1000 is preferably characterized in that the displacement axis 17 is arranged upstream from the at least one forward pile limiter 04 and/or upstream from the at least one sheet decelerating means 07.

As an alternative or in addition, the sheet delivery unit 1000 is preferably characterized in that, in at least one displacement position, and more preferably in each displacement position, the at least one displacement member 12 is arranged at least partially lower than the at least one sheet decelerating means 07 and the at least one sheet infeed means 08, and more preferably also lower than the at least one sheet transfer means 09, and still more preferably lower than every component of the sheet delivery unit 1000 that transports the sheet 02 on its transport path to the dropping point and/or that drives or decelerates the sheet in the transport direction T.

In addition or as an alternative, the sheet processing machine 01 is preferably characterized by comprising at least one shaping unit 900 or die-cutting unit 900 and/or at least one application unit 600, and in that the sheet processing machine 01 comprises at least one sheet delivery unit 1000, which is configured as described above and/or below. As an alternative or in addition, the sheet processing machine 01 is preferably characterized in that the at least one application unit 600 is configured as a flexo application unit 600 and/or as a flexo printing unit 600 and/or that the sheet processing machine 01 comprises at least one substrate feed device 100 configured as a sheet feeder 100.

Preferably, a method for inspecting the at least one remaining portion of the at least one sheet 02 of the sheet processing machine 01 which is processed by a shaping device 900 is described. The particular sheet 02 includes at least one multiple-up 1101, preferably at least two multiple-ups 1101, more preferably at least four multiple-ups 1101, more preferably at least eight multiple-ups 1101, for example twenty multiple-ups 1101. The respective, preferably the at least one, sheet 02 is preferably processed in the at least one shaping device 900. Preferably, respective sheets 02 of the sheets 02 are processed in at least one respective processing operation by means of at least one device of the sheet processing machine 01, for example are furnished with at least one application fluid and/or mechanically processed and/or altered in terms of their shape and/or are die-cut. The sheets 02 are preferably transported at a processing speed during their respective processing operation, in particular along the transport path provided for the transport of sheets 02. Preferably, at least one offcut piece 1102A is removed from the respective, preferably the at least one, sheet 02 downstream from the shaping device 900, preferably the die-cutting device 900 and/or rotary die-cutting device 900, in the transport direction T of the sheets 02. The at least one offcut piece 1102A is preferably already removed from the respective, preferably the at least one, sheet 02 during the at least one processing operation and/or during the transport of the particular sheet 02 along the transport path, preferably along the transport path between the at least one shaping device 900 and the at least one separation device 903, and/or by the at least one separation device 903. The separation device 903 is preferably configured for the removal of the at least one offcut piece 1102A. The separation device 903 is preferably configured to remove the at least one offcut piece 1102A. More preferably, the separation device 903 is configured to entirely remove the at least one offcut piece 1102A from the respective, preferably the at least one, sheet 02.

The at least one inspection device 916 ascertains the actual state of the respective, preferably the at least one, sheet 02. Preferably, the at least one inspection device 916 ascertains the actual state of the respective sheet 02 downstream from the separation device 903 for the removal of at least one offcut piece 1102A from the at least one sheet 02. The inspection device 916 preferably ascertains the actual state of the respective sheet 02, which is preferably the state of the sheet 02, in particular with respect to shape and/or mass and/or contour, that the respective sheet 02 has at the time of detection by way of the inspection device 916. The inspection device 916 preferably ascertains the actual state of the at least one remaining portion of the at least one sheet 02 processed by a shaping device 900.

The actual state of the respective, preferably the at least one, sheet 02 is compared to the desired state of the respective, preferably the at least one, sheet 02. The inspection device 916 and/or the evaluation means preferably compare the actual state of the respective, preferably the at least one, sheet 02 to the desired state of the respective, preferably the at least one, sheet 02. More preferably, the evaluation means of the inspection device 916 compares the actual state of the respective sheet 02 to the desired state of the respective sheet 02. The actual state of the respective sheet 02 is preferably compared to the desired state of the respective sheet 02, wherein the desired state of the respective sheet 02 is preferably the state of the sheet 02, in particular with respect to shape and/or mass and/or contour, that an ideally produced sheet 02 in particular is to have and/or has at the time of detection by way of the inspection device 916.

Preferably in addition or as an alternative, the method for inspecting the at least one sheet 02 of sheets 02 by way of the at least one inspection device 916 in the sheet processing machine 01 is characterized in that the at least one sheet 02 detected by the inspection device 916 includes at least two multiple-ups 1101 and at least one sheet opening 1102L. The at least one inspection device 916 ascertains the actual state of the at least one sheet 02. The actual state of the at least one sheet 02 is compared to the desired state of the at least one sheet 02.

In addition or as an alternative, the method is preferably characterized in that the inspection device 916 preferably at least partially detects the at least one sheet opening 1102L of the at least one sheet 02 and/or the at least one inner contour of the at least one sheet 02, preferably defined by at least one sheet opening 1102L, and/or the at least one outer contour of the at least one sheet 02, preferably defined by at least one outer edge of the respective, preferably the at least one, sheet 02. The inspection device 916 preferably detects the shape of the sheet 02 and/or of the at least one multiple-up 1101, preferably at least the inner and/or outer boundary lines of the at least one multiple-up 1101 of the particular sheet 02. More preferably, the inspection device 916 detects the shape of the at least two multiple-ups 1101 of the at least one sheet 02, preferably at least the inner and/or outer boundary lines of the at least two multiple-ups 1101. The outer boundary line preferably encompasses the at least two multiple-ups 1101. The inspection device 916 preferably detects the at least one outer edge of the at least one sheet 02 and, additionally or alternatively, the at least one sheet opening 1102L of the relevant sheet 02. The inspection device 916 preferably at least detects the region of the at least one offcut piece 1102A and/or at least the region of the at least one sheet opening 1102L. The inner contour of the at least one sheet 02 preferably corresponds to the contour of the at least one offcut piece 1102A of the relevant, preferably the at least one, sheet 02, which was preferably removed from the relevant sheet 02.

As an alternative or in addition, the method is preferably characterized in that the degree of the deviation of the at least one sheet opening 1102L and/or of the at least one inner contour and/or of the at least one outer contour of the sheet 02 from the desired state of the respective, preferably the at least one, sheet 02 is ascertained from the comparison of the actual state of the at least one sheet 02 to the desired state of the relevant, preferably the at least one, sheet 02. Depending on the result of the ascertained degree of the deviation of the at least one sheet opening 1102L and/or of the at least one inner contour and/or of the at least one outer contour of the sheet 02 from the desired state of the respective sheet 02, the inspection device 916, in particular the evaluation means, preferably outputs at least the one signal, for example the optical signal and/or the open-loop and/or closed-loop control signal. If the degree of the deviation is within the scope of the tolerance of the desired state of the relevant sheet 02, the inspection device 916, in particular the evaluation means, preferably outputs the at least one "good" signal. If the degree of the deviation is outside the scope of the tolerance of the desired state of the relevant sheet 02, the inspection device 916, in particular the evaluation means, preferably outputs the at least one "bad" signal. For example, in addition or as an alternative to the at least one "bad" signal, the inspection device 916, in particular the evaluation means, preferably outputs the at least one signal for the closed-loop and/or open-loop control of the sheet diverter 49.

For example, at a surface area of less than 25 $mm^2$ (twenty-five square millimeters), preferably of less than 20 $mm^2$, more preferably of less than 15 $mm^2$, of the at least one remaining offcut piece 1102A, in the case that at least a portion of the at least one offcut piece 1102A has remained in the relevant sheet 02 downstream from the separation device 903 in the transport direction T, the degree of the deviation is preferably within the scope of the tolerance of the actual state of the particular sheet 02 and, for example, the at least one "good" signal is output. For example, at a surface area of at least 25 $mm^2$ (twenty-five square millimeters), preferably at least 30 $mm^2$, more preferably 35 $mm^2$, of the at least one remaining portion of the offcut piece 1102A, the at least one "bad" signal is preferably output and, additionally or alternatively, the at least one signal for the closed-loop and/or open-loop control of the sheet diverter 49 is output.

In addition, or as an alternative, the method is preferably characterized in that the desired state of the relevant, preferably the at least one, sheet 02 is determined based on the digital and/or taught-in reference.

In addition, or as an alternative, the method is preferably characterized in that a change of the transport path, provided for the transport of sheets 02, of the relevant, preferably the at least one, sheet 02, in particular the sheet diverter 49, is controlled by open-loop and/or closed-loop control, downstream from the inspection device 916 and upstream from the at least one delivery unit 1000 in the transport direction T as a function of the comparison of the actual state of the relevant, preferably the at least one, sheet 02 to the desired state of the relevant, preferably the at least one, sheet 02. Preferably, the change of a transport path provided for the transport of sheets 02, in particular the sheet diverter 49, is controlled by open-loop and/or closed-loop control as a function of the comparison of the at least one sheet opening 1102L to the reference of the at least one sheet opening 1102L and/or as a function of the comparison of the actual state of the respective sheet 02 to the desired state of the respective sheet 02. The relevant, preferably the at least one, sheet 02 is preferably left on the intended transport path or diverted from the intended transport path to an alternative transport path, as a function of the comparison of the actual state of the relevant, preferably the at least one, sheet 02 to the desired state of the relevant, preferably the at least one, sheet 02.

The inspection device 916, in particular the evaluation means, preferably outputs the at least one signal for controlling by open-loop and/or closed-loop control the change of the transport path, in particular the sheet diverter 49. The inspection device 916 preferably comprises the evaluation means or is connected to the evaluation means, and the change of the transport path, in particular the sheet diverter 49, is preferably controlled by closed-loop control and/or open-loop control based on the at least one signal of the evaluation means. The inspection device 916, in particular the evaluation means, preferably outputs the at least one signal for controlling by open-loop and/or closed-loop control the change of the transport path, in particular the sheet diverter 49, in particular when the degree of the deviation is outside the scope of tolerance of the desired state of the relevant sheet 02. The inspection device 916, in particular the evaluation means, preferably outputs the at least one signal for controlling by open-loop and/or closed-loop control the change of the transport path, in particular the sheet diverter 49, regardless of whether the degree of the deviation is outside the scope of tolerance of the desired state of the relevant sheet 02. This means that the inspection device 916, in particular the evaluation means, preferably outputs the at least one signal for controlling by open-loop and/or closed-loop control the change of the transport path, in particular the sheet diverter 49, during and/or after the inspection of the relevant sheet 02, for example in addition or as an alternative to the at least one "good" signal or the at least one "bad" signal.

In addition, or as an alternative, the method is preferably characterized in that the inspection device 916 comprises the evaluation means or is connected to the evaluation means, and that the change of the transport path of the respective sheet 02, in particular the sheet diverter 49, is controlled by open-loop control and/or closed-loop control based on the at least one signal of the evaluation means.

In addition, or as an alternative, the method is preferably characterized in that the response time from the beginning of the ascertainment of the actual state of the relevant sheet 02 to the closed-loop control and/or open-loop control of the change of the transport path for deflecting the respective sheet 02, in particular the sheet diverter 49, is at least 50 ms (fifty milliseconds), preferably at least 80 ms, more preferably at least 100 ms. The ascertainment of the actual state of the relevant sheet 02 preferably begins at the leading end 31 in the transport direction T, more preferably a forward edge of the relevant sheet 02 in the transport direction T, and/or preferably as soon as the forward edge of the relevant sheet 02 in the transport direction T reaches the region of the transport path in the transport direction T which is detected by the inspection device 916. The relevant sheet 02, in particular the leading end 31 of the relevant sheet 02 in the transport direction T, preferably travels the transport path between the inspection device 916 and the position for the change of the transport path, in particular the sheet diverter 49, as a function of the speed of the transported sheets 02, in at least 50 ms (fifty milliseconds), preferably in at least 80 ms, more preferably in at least 100 ms. The relevant sheet 02, in particular the leading end 31 of the relevant sheet 02 in the transport direction T, preferably the forward edge of the relevant sheet 02 in the transport direction T, preferably travels the transport path between the inspection device 916 and the position for the change of the transport path, in particular the sheet diverter 49, as a function of the speed of the transported sheets 02, in no more than 1000 ms (one-thousand milliseconds), preferably in no more than 800 ms, more preferably in no more than 300 ms.

In addition, or as an alternative, the method is preferably characterized in that the inspection device 916 is arranged orthogonally to the transport path of the at least one sheet 02 provided for the transport of sheets 02 and is directed at the transport path of the at least one sheet 02. The inspection device 916 preferably detects the at least one portion of the transport path and/or of the transport plane at which it is directed. The inspection device 916 is preferably directed perpendicularly at the transport path and/or the transport plane and preferably perpendicularly detects the at least one portion of the transport path.

In addition, or as an alternative, the method is preferably characterized in that the at least one print image, in particular the at least one print image of the respective multiple-up 1101, is applied onto the at least one sheet 02 by the at least one application mechanism 614 of the sheet processing machine 01 upstream from the shaping device 900 in the transport direction T. For example, the at least one print image is applied onto the relevant sheet 02 by at least one application mechanism 614. For example, the sheet processing machine 01 comprises at least two application mechanisms 614, whereby, for example, two print images that differ from one another in at least one property, for example the application fluid that is used and/or the position of the print images on the sheet 02, are applied and/or can be applied onto the relevant sheet 02.

The at least one sheet 02 preferably has at least one respective print image. In addition, or as an alternative, the method is preferably characterized in that the inspection device 916 comprises the evaluation means or is connected to the evaluation means, and that the inspection device 916 and/or the evaluation means detect and/or evaluate the at least one color register of the at least one print image. The method is preferably characterized in that the inspection device 916 comprises the evaluation means or is connected to the evaluation means, and that the inspection device 916 and/or the evaluation means evaluate the at least one color register of the at least one print image of the at least one sheet 02 and/or compare the at least one print image of the at least sheet 02 to the at least one sheet opening 1102L and/or the at least one inner contour and/or the at least one outer contour of the respective sheet 02. The inspection device 916, in particular the evaluation means, preferably compares the actual state to the desired state of the relevant, preferably the at least one, sheet 02, wherein the at least one print image of the relevant sheet 02, in particular of the particular multiple-up 1101, and/or the at least one sheet opening 1102L and/or the at least one inner contour and/or the at least one outer contour of the relevant sheet 02 are preferably ascertained for ascertaining the actual state of the relevant sheet 02.

In addition, or as an alternative, the method is preferably characterized in that the inspection device 916 comprises the evaluation means or is connected to the evaluation means, and that the inspection device 916 and/or the evaluation means detect and/or evaluate the position of the at least one multiple-up 1101 relative to the reference of the position of the at least one multiple-up 1101. Preferably, at least one further multiple-up 1101 and/or at least one marker are formed on the particular sheet 02 and/or at least one edge of the sheet 02 and/or at least one delimitation of the particular sheet 02, in particular the outer contour of the particular sheet 02, as the reference of the position of the relevant multiple-up 1101.

In addition, or as an alternative, the method is preferably characterized in that the inspection device 916 comprises the evaluation means or is connected to the evaluation means, and that the inspection device 916 and/or the evaluation means detect and/or evaluate the at least one ink of the at least one print image. The respective ink of the print image is preferably established by the at least one application fluid that is preferably used to generate the print image and/or preferably corresponds to the application fluid that is preferably dried on the sheet 02 and used to generate the particular print image.

In addition or as an alternative, the method is preferably characterized in that the inspection device 916 comprises the evaluation means or is connected to the evaluation means, and that the inspection device 916 and/or the evaluation means detect and/or evaluate at least one defect in the processing of the respective, preferably the at least one, sheet 02 and/or at least one defect of the at least one print image as a result of missing portions and/or additional portions. For example, a defect in the processing of the particular sheet 02 is an imperfection in the material of the particular sheet 02. For example, a defect of the at least one print image is an application that, for example, is additionally applied onto the sheet 02, for example a grease stain or additionally applied application fluid.

In addition, or as an alternative, the method is preferably characterized in that the degree of tool wear of the at least one tool of the at least one shaping device 900, in particular of the shaping mechanism 914, preferably of the plate cylinder 901, of the sheet processing machine 01 is ascertained from the comparison of the actual state of the at least one sheet 02 to the desired state of the respective, preferably the at least one, sheet 02. The inspection device 916 preferably comprises the evaluation means or is connected to the evaluation means, and the inspection device 916 and the evaluation means preferably ascertain the degree of tool wear of the at least one tool of the at least one shaping device 900 of the sheet processing machine 01 for processing the particular sheet 02 prior to the inspection of the relevant sheet 02 by way of the inspection device 916.

In addition, or as an alternative, the method is preferably characterized in that the degree of wear of the at least one surface of the at least one counterpressure cylinder 902 of the at least one shaping device 900 of the sheet processing machine 01 is ascertained from the comparison of the actual state of the at least one sheet 02 to the desired state of the respective, preferably the at least one, sheet 02.

In addition, or as an alternative, the method is preferably characterized in that the at least one sheet 02 is transported in a hanging state in the transport direction T, and the inspection device 916 is arranged beneath the transport path of the at least one sheet 02, which is provided for the transport of sheets 02, and is directed at the transport path. The inspection device 916 preferably inspects the sheet 02 from the side of the main surface area of the sheet 02 onto which the at least one print image is applied to the sheet 02. In the case of the hanging guidance of sheets 02, the inspection device 916 is preferably arranged beneath the transport path and/or the transport plane, preferably upstream from the transport path and/or upstream from the transport plane in the vertical direction V and/or is directed at the transport path and/or the transport plane. The inspection device 916 thus preferably inspects the sheet 02 from beneath. The inspection device 916 thus preferably detects, from beneath, at least a portion of the transport path and/or at least a portion of the transport plane, and thus at least a portion of the at least one sheet 02 passing the inspection device 916 on the transport path in the transport direction T, at the position of the transport path and/or of the transport plane at which the inspection device 916 is directed. The at least one print image is preferably applied onto the sheet 02 from beneath, i.e., upstream from the sheet 02 in the vertical direction V. At least in this embodiment, the inspection device 916 thus, preferably additionally or alternatively, inspects the at least one print image of the sheet 02 from beneath, and preferably inspects it from upstream from the transport path and/or from upstream from the transport plane in the vertical direction V.

In addition or as an alternative, the method is preferably characterized in that the degree of the position of the at least one multiple-up 1101 relative to a reference of the position of the at least one multiple-up 1101 and, additionally or alternatively, the degree of the ink of at least one print image of the respective, preferably the at least one, sheet 02 and, additionally or alternatively, the degree of at least one defect in a processing of the respective, preferably the at least one, sheet 02 and/or of the at least one print image of the respective, preferably the at least one, sheet 02 due to missing portions and/or additional portions, are ascertained from the comparison of the actual state of the at least one sheet 02 to the desired state of the respective, preferably the at least one, sheet 02.

A method for inspecting at least one sheet 02 is preferred. The respective, preferably at least one, sheet 02 preferably includes the at least one multiple-up 1101 with the at least one print image and the at least one sheet opening 1102L, for example the at least one sheet gap 1102L. The inspection device 916 preferably at least partially detects the at least one sheet opening 1102L. The inspection device 916, in particular the evaluation means, preferably compares the at least one sheet opening 1102L to the reference of the at least one sheet opening 1102L.

The respective, preferably the at least one, sheet 02 preferably includes the at least one multiple-up 1101 and at least one sheet opening 1102L. The respective sheet 02 is preferably made of paper or cardboard or paperboard. The inspection device 916 preferably at least partially detects the at least one sheet opening 1102L.

The at least one sheet opening 1102L preferably corresponds to at least a portion of an offcut piece 1102A removed from the particular sheet 02. In addition or as an alternative, the sheet opening 1102L was preferably generated by removing the at least one portion of the at least one offcut piece 1102A from the particular sheet 02.

In addition, or as an alternative, the method is preferably characterized in that the inspection device 916 at least partially detects the at least one contour and/or the at least one shape and/or the at least one mass and/or the at least one surface area of the at least one sheet opening 1102L.

In addition, or as an alternative, the method is preferably characterized in that the contour and/or shape and/or mass and/or surface area of the at least one sheet opening 1102L correspond to the contour and/or shape and/or mass and/or surface area of the at least one offcut piece 1102A removed from the respective, preferably the at least one, sheet 02.

The reference of the at least one sheet opening 1102L and/or the desired state of the relevant sheet 02 is preferably determined and/or configured to be determinable based on the digital reference and/or the taught-in reference. The reference of the particular sheet 02 preferably encompasses the reference of the at least one sheet opening 1102L of the particular sheet 02.

The sheet 02 is preferably inspected with respect to the processing of the particular sheet 02 by the shaping device 900 and, additionally or alternatively, the at least one print image applied onto the particular sheet 02 and, additionally or alternatively, the at least one print image applied onto the particular sheet 02 relative to the at least one sheet opening 1102L and/or the at least one inner contour and/or the at least one outer contour of the particular sheet 02.

The method is preferably characterized in that the sheets 02 are modified in terms of their shape in a respective shaping process. The respective shaping process is preferably a respective die-cutting process, in which the respective, preferably the at least one, sheet 02 is die cut, wherein in particular portions of the sheet 02 are removed.

As an alternative or in addition, the method is preferably characterized in that, in a respective separation process, the sheets 02 are at least partially freed from the offcut pieces 1102A, for example by being jogged. During this process, the respective sheets 02 are preferably transported by means of the at least one separation transport means 904.

As an alternative or in addition, the method is preferably characterized in that, in a respective transport process, in particular immediately following the respective separation process, the sheets 02 are transported along the transport path provided for the transport of sheets 02 to the delivery device 1000, preferably the sheet delivery unit 1000, in particular by means of the output transport means 906, which is preferably configured as an upper suction transport means 906, and/or in a hanging state.

As an alternative or in addition, the method is preferably characterized in that, in a respective infeed process, substrate 02, in particular processed substrate in the form of a sequence of sheets 02 that are spaced apart from one another in the transport direction T, is preferably fed in this transport direction T, in particular at a transfer speed, to the sheet delivery unit 1000 of the sheet processing machine 01. The transfer speed is preferably the same as the processing speed. The infeed process is preferably the process in which the respective sheets 02 transported in the transport process are transferred, in particular in a hanging state, from the output transport means 906 to the at least one sheet transfer means 09. Alternatively, in the case that instead of a series of output transport means 906 and sheet transfer means 09 only one selective transport means 09; 906 is provided, the transport process may be dispensed with, and the infeed process is carried out immediately following the respective separation process.

As an alternative or in addition, the method is preferably characterized in that, at least during a sheet decelerating process and/or during an imbricating process, at least two sheets 02 are guided, at least temporarily, in a hanging state by means of an upper sheet transport system 06 of the sheet delivery unit 1000 which is configured for a hanging transport of sheets 02, and are transported in an imbricated arrangement at least also in the transport direction T.

As an alternative or in addition, the method is preferably characterized in that, in particular in a respective deceleration transfer process, the sheets 02 are transported in each case in a hanging state by means of the at least one sheet infeed 08 means of the sheet delivery unit 1000 which is configured as an upper suction transport means 08, and are transferred therefrom to the at least one sheet decelerating means 07 that is configured as an upper suction transport means 07, and more preferably at least partially arranged downstream from the at least one sheet infeed means 08, as viewed in the transport direction T. The at least one sheet decelerating means 07 is preferably used to decelerate the sheets 02 from the processing speed and/or transfer speed so that these can be deposited on the delivery pile 28. The at least one sheet decelerating means 07 is preferably configured to decelerate sheets 02. For example, the sheets 02 are subsequently deposited on the delivery pile 28.

As an alternative or in addition, the method is preferably characterized in that, in particular in a respective displacement process, a respective trailing end 29 of a respective leading sheet 02 is pushed downwardly and away from the at least one sheet infeed means 08 by means of at least one displacement element 12. As an alternative or in addition, the method is preferably characterized in that, during the displacement process, the respective trailing end 29 of the respective leading sheet 02 is pushed downwardly and away from the at least one sheet infeed means 08 by means of the at least one displacement element 12, at least also upstream from the at least one forward pile limiter 04, based on the transport direction T. During this process, a leading end 31 of the respective leading sheet 02 is preferably in contact with a transport surface 22 of the at least one sheet decelerating means 07. During the respective displacement process, at least a rear section of the leading sheet 02 preferably moves out of contact with the at least one sheet infeed means 08, although this rear section of the leading sheet 02 is still situated below the at least one sheet infeed means 08 in the vertical direction V. This creates an imbrication gap between the respective rear section of the leading sheet 02 on the one hand and the at least one sheet infeed means 08, in particular its contact surface 16, on the other.

For example, by activating the at least one displacement element 12, a distance, based on the vertical direction V, between the at least one sheet decelerating means 07 and the respective leading sheet 02 is preferably created and/or enlarged for at least part of the respective leading sheet 02.

As an alternative or in addition, the method is preferably characterized in that, in the sheet decelerating process, this respective leading sheet 02 is decelerated, in particular with respect to the movement in the transport direction T, by means of the at least one sheet decelerating means 07. The respective sheet 02 is preferably decelerated in that the respective sheet 02 is pulled against a transport surface 22 of the at least one sheet decelerating means 07 by means of a vacuum, and the transport surface 22 is decelerated. The transport surface 22 of the at least one sheet decelerating means 07 is preferably decelerated in that a decelerating means drive 19 driving the at least one sheet decelerating means 07 is operated at a decreasing speed, in particular in the form of an at least partially predefined deceleration profile. During its deceleration process, the respective sheet 02 is preferably held or touched only on its upper side, based on the vertical direction V.

As an alternative or in addition, the method is preferably characterized in that the respective sheet decelerating process of a particular sheet 02 preferably begins before the respective displacement process of this sheet 02 begins. The respective displacement process of a respective sheet 02 preferably takes place at least partly simultaneously with the respective sheet decelerating process of the respective sheet 02. The respective displacement process of a respective sheet 02 preferably ends before the respective sheet decelerating process of the respective sheet 02 is completed. The at least one displacement element 12 is preferably deactivated to end the respective displacement process. If the displacement element 12 is configured as a displacement opening 12, an expulsion of the displacement fluid is correspondingly reduced and/or interrupted and/or terminated for this purpose. If the displacement element 12 is configured as a displacement member 12, this displacement member 12 is preferably moved upwardly until it moves out of contact with the respective leading sheet 02. The respective trailing end 29 of the respective leading sheet 02 moves upwardly again upon and/or after completion of the respective displacement process of this sheet 02, for example. However, due to an imbrication that has taken place in the meantime, at least the respective trailing end 29 of the respective leading sheet 02 remains spaced apart from the transport surface 23 of the at least one sheet infeed means 08 and from the transport surface 22 of the at least one sheet decelerating means 07 with respect to the vertical direction V.

As an alternative or in addition, the method is preferably characterized in that the imbrication preferably takes place in a respective imbricating process and/or by means of the at least one imbricating device 46. The imbricating process is preferably assigned to at least two sheets 02, in particular the leading sheet 02 and the succeeding sheet 02. In the imbricating process, these sheets are preferably placed in an imbricated arrangement relative to one another as they are transported further in the transport direction T. As an alternative or in addition, the method is preferably characterized in that, in the imbricating process, a respective leading end 31 of a respective sheet 02, in particular succeeding the respective leading sheet 02, is pushed, in particular by means of the at least one sheet transfer means 09, between the trailing end 29 of the respective leading sheet 02 and the at least one sheet infeed means 08, based on the vertical direction V, while the respective leading sheet 02 is still partially held by the at least one sheet decelerating means 07. As a result, the leading sheet 02 does not have to be entirely detached from or halted by the at least one sheet decelerating means 07 when the succeeding sheet 02 is already less than its sheet length away from the rear sheet stop 03.

As an alternative or in addition, the method is preferably characterized in that transport rollers 26 of the at least one sheet infeed means 08 are rotatably driven exclusively by contact of these transport rollers 26 with the respective moving sheet 02, and/or that, as sheets 02 are being transported along the at least one sheet infeed means 08, they slide at least temporarily along at least one sliding surface of the at least one sheet infeed means 08. If, as is preferred, the at least one sheet infeed means 08 is configured as a roller suction system 08 and has passively rotatable transport rollers 26, those transport rollers 26 of the at least one sheet infeed means 08 that are still in contact with the leading sheet 02 can rotate and/or are configured to rotate at a different circumferential speed from those transport rollers 26 of the at least one sheet infeed means 08 that are already in contact with the succeeding sheet 02. Both sheets 02 are nevertheless reliably transported, for example by the vacuum of the at least one sheet infeed means 08.

As an alternative or in addition, the method is preferably characterized in that a movement of the at least one displacement member 12 is preferably carried out by means of a predefined movement profile. At least a portion of the at least one displacement member 12 is preferably guided from above to beneath the reference surface 11, where it occupies the displacement region, which in particular moves along with the at least one displacement member 12. This preferably occurs in such a synchronized way that the at least one displacement member 12 is in contact with approximately the same point on the succeeding sheet 02 for as long as possible. A constant negative acceleration of the leading sheet 02 results in a parabolic curve of the position of the trailing end 29 of the leading sheet 02, based on the transport direction T, over time. The position of the at least one displacement member 12, with respect to the transport direction T, plotted against the time, preferably follows a parabolic curve, at least until shortly before the respective leading end 31 of the succeeding sheet 02 would overtake the at least one displacement member 12. From that point on, the at least one displacement member 12 is preferably moved at a constant speed, based on the transport direction T, which corresponds to the speed of the second sheet 02, and in particular is identical to the transfer speed and/or the processing speed.

As an alternative or in addition, the method is preferably characterized in that, preferably during the displacement process, the displacement region is moved away, by a movement of the at least one displacement member 12, with at least a clearance upstream from the succeeding sheet 02 in the transport direction T, in particular as long as the at least displacement member 12 is at least partially located beneath the reference surface 11 and the succeeding sheet 02 has not yet entered the imbrication gap. The clearance is preferably at least 1 mm, more preferably at least 2 mm, still more preferably at least 5 mm, and still more preferably at least 8 mm. Independently thereof, the clearance is preferably no more than 50 mm, more preferably no more than 20 mm, and still more preferably no more than 12 mm. The smaller the clearance, the more sheets 02 can be processed per unit of time and/or the more gently the sheets 02 can be decelerated, in particular given a predetermined position of the at least one displacement member 12. As an alternative or in addition, the method is preferably characterized in that at least one sheet per second is deposited onto the delivery pile 28 by means of the sheet delivery unit 1000, more preferably at least two sheets 02 per second, still more preferably at least 2.5 sheets 02 per second, still more preferably at least three sheets 02 per second, and still more preferably at least 3.2 sheets 02 per second.

As an alternative or in addition, the method is preferably characterized in that the at least one displacement lever 12 is preferably used as the at least one displacement member 12, which is rotatably arranged about the displacement axis 17. The rotational movement of the at least one displacement lever 12 preferably follows a specified profile such that its position over time with respect to the transport direction T behaves as described above.

As an alternative or in addition, the method is preferably characterized in that the at least one displacement element 12 is configured as a displacement member 12 and, in the displacement process, is moved at least partially to below a transport surface 23 of the at least one sheet infeed means 08. As an alternative or in addition, the method is preferably characterized in that the at least one displacement element 12 is configured as a displacement lever 12 that can be turned, in particular pivoted, and more preferably rotated about a displacement axis 17, and in the displacement process is turned, in particular pivoted and/or rotated, in particular in the direction of rotation D, at least partially about the displacement axis 17 to a point below a transport surface 23 of the at least one sheet infeed means 08. As an alternative or in addition, the method is preferably characterized in that, during the displacement process, the at least one displacement element 12 is situated at least partially below the reference surface 11 of the at least one sheet infeed means 08. As an alternative or in addition, the method is preferably characterized in that a position of the at least one displacement element 12, based on the transport direction T, follows an in particular predefined movement profile as a function of time, at least during the displacement process. As an alternative or in addition, the method is preferably characterized in that the movement profile has at least one parabolic section and at least one linear section.

As an alternative or in addition, the method is preferably characterized in that, in a detachment process, the respective leading sheet 02 is detached entirely from the at least one sheet decelerating means 07, in particular by means of the at least one dropping means 32. The detachment process preferably begins after the displacement process has begun. The detachment process can begin and/or, for example, begins even before the displacement process is completed. As an alternative or in addition, the method is preferably characterized in that, in the detachment process, lowering occurs first at the first connection point 41, after which lowering occurs at a second connection point 42, which, as described, is preferably located downstream from the first connection point 41 based on the transport direction T. Overall, the leading sheet 02 is preferably detached from the upper sheet transport system 06 in that, first, its trailing end 29 is detached from the upper sheet transport system 06, and in particular from the at least one sheet infeed means 08, by means of the at least one displacement element 12, and that, thereafter, a portion of the leading sheet 02 that is located further in the transport direction T is detached from the upper sheet transport system 06, and in particular from the at least one sheet decelerating means 07, by means of the at least one dropping means 32, in particular by means of a part of the at least one dropping means 32 that can be lowered by means of the at least one first dropping drive 33, and that, thereafter, the leading end 29 of the leading sheet 02 that is located even further forward in the transport direction T is then detached from the upper sheet transport system 06, and in particular from the at least one sheet decelerating means 07 by means of the at least one dropping means 32, in particular by means of a part of the at least one dropping means 32 that can be lowered by means of the at least one second dropping drive 34.

As an alternative or in addition, the method is preferably characterized in that, following the detachment process, the at least one sheet decelerating means 07 is accelerated again, in particular to the transfer speed and/or to the processing speed, after which the respective succeeding sheet 02 is brought into contact with the at least one sheet decelerating means 07. The sheet 02 that previously was the succeeding sheet thereby becomes a new leading sheet 02 and the method can be repeated or continued accordingly.

As an alternative or in addition, the method is preferably characterized in that, in a stacking process, the respective sheet 02 that has just been detached is deposited downwardly from the at least one sheet decelerating means 07 onto a delivery pile 28. The delivery pile 28 is thereby increased by this leading sheet 02. The delivery pile 28 is preferably formed between the at least one forward pile limiter 04 and the at least one rear sheet stop 03. The at least one rear sheet stop 03 is preferably adjustable in terms of its position with respect to the transport direction T along a format adjustment path. In this way, adjustments can be made and/or, for example, are made to different sheet lengths, in particular a one-time adjustment in the event of a format change. The at least one rear sheet stop 03 establishes a rear boundary of the delivery pile 28. A forward boundary of the delivery pile 28 is preferably established by the at least one forward pile limiter 04. The at least one forward pile limiter 04 is preferably movable, in particular periodically movable, with respect to the transport direction T along a pile forming path. In this way, the delivery pile 28 can be brought into shape and/or, for example, is brought into shape, in particular by pushing respective sheets 02 in the transport direction T so as to yield uniform forward and/or rear boundaries of the delivery pile 28. Periodic movements of the at least one forward pile limiter 04 are preferably carried out multiple times during operation of the sheet processing machine 01, for example multiple times per minute. Lateral pile limiters are also provided, for example. The lateral pile limiters are preferably adjustable, based on the sheet format, in terms of their position based on the transverse direction A, and/or in particular are periodically movable with respect to the transverse direction A, in order to bring at least one lateral boundary surface of the delivery pile 28 into shape.

While preferred embodiments of a sheet processing machine, a method for inspecting at least one remaining portion of at least one sheet processed by a shaping machine and a method for inspecting a sheet, all in accordance with the present invention, have been set forth fully and completely hereinabove, it will be apparent to one of skill in the art, that various changes could be made thereto, without departing from the true spirit and scope of the present invention, which is accordingly to be limited only by the appended claims.

The invention claimed is:

1. A sheet processing machine (01) comprising:

a shaping device (900) for processing sheets (02), the shaping device (900) including at least one shaping point (909);

at least one separation device (903), the at least one separation device (903) being configured to remove at least one offcut piece (1102A) from at least one sheet (02) of the sheets (02), the at least one separation device (903) being arranged downstream from the at least one shaping point (909) along a transport path provided for transport of the sheets (02), the at least one sheet (02) including at least two multiple-ups (1101) and at least two sheet openings (1102L);

at least one inspection device (916), the at least one inspection device being configured to ascertain an actual state of the at least one sheet (02) of the sheets (02) downstream from the at least one separation device (903) in a transport direction (T) of the sheets (02), the at least one inspection device (916) at least one of comprising an evaluation means or being connected to an evaluation means, the evaluation means being configured to compare an actual state of the at least one sheet (02) to a desired state of the at least one sheet (02), the at least one inspection device (916) being arranged upstream from at least one delivery unit (1000) and downstream from the at least one separation device (903) in the transport direction (T), the at least one inspection device (916) being arranged immediately following the at least one separation device (903) in the transport direction (T), and wherein the at least one inspection device (916) is configured to at least partially detect at least one sheet opening (1102L) of the at least two sheet openings (1102L) of the at least one sheet (02) including the at least two multiple-ups (1101).

2. The sheet processing machine according to claim 1, at least one of:

wherein the at least one inspection device (916) is arranged downstream from the at least one separation device (903) in the transport direction (T) of sheets (02) to at least partially inspect at least one remaining portion of the at least one sheet (02) processed by the shaping device (900), the sheet including the at least two multiple-ups (1101), and the at least one remaining portion of the at least one sheet (02) being the portion of the at least one sheet (02) which is arranged downstream from the at least one separation device (903);

wherein the at least one inspection device (916) is configured to inspect, and wherein the at least one inspection device (916) is arranged immediately following the at least one separation device (903), upstream from any further processing device for further processing the at least one sheet (02) in the transport direction (T);

wherein the at least one inspection device (916) is arranged orthogonally to a transport path of the at least one sheet (02) provided for the transport of sheets (02), and is directed at the transport path of the at least one sheet (02);

wherein at least one change of the transport path provided for the transport of sheets (02) at least one of is controlled by a closed-loop control, is controlled by an open-loop control, is configured to be controllable by the open-loop control, or is configured to be controllable by the closed-loop control, downstream from the at least one inspection device (916) and upstream from the at least one delivery unit (1000) in the transport direction (T);

wherein the at least one inspection device (916) comprises at least one optical image acquisition device configured as a camera; or wherein the at least one inspection device (916) is configured to store and evaluate data about the at least one sheet (02) and respective further transported sheets (02) of the sheets (02), and to create at least one report about a quality of the sheets (02).

3. The sheet processing machine according to claim 1, at least one of:

wherein the desired state of the at least one sheet (02) is at least one of determined or is configured to be determinable based on at least one of a digital reference or a taught-in reference;

wherein at least one inner contour of the at least one sheet (02) corresponds to a contour of at least one offcut piece (1102A) of the at least one sheet (02);

wherein at least one of the at least two sheet openings (1102L) corresponds to at least a portion of an offcut piece (1102A) removed from the at least one sheet (02); or wherein at least one of the at least two sheet openings (1102L) is generated by removing at least a portion of the at least one offcut piece (1102A) from the at least one sheet (02).

4. The sheet processing machine according to claim 1, at least one of:

wherein the at least one shaping device (900) is configured to process further ones of the sheets (02) in at least one shaping process;

wherein the further ones of the sheets (02) are configured to pass through at least one unit (100; 300; 600; 700; 900) of the sheet processing machine (01) which is arranged upstream from the at least one inspection device (916) in the transport direction (T), while the at least one sheet (02) is being detected by the at least one inspection device (916);

wherein the shaping device (900) is configured as one of a die-cutting device (900) and as a rotary die-cutting device (900);

wherein the sheet processing machine (01) comprises one of a sheet feeder (100) and at least one application mechanism (614) applying at least one print image onto the at least one sheet (02); or wherein the sheet processing machine (01), downstream from the separation device (903) in the transport direction (T) and along the transport path provided for the transport of sheets (02), comprises at least one transport means (09; 906) that is configured to transport the sheets (02) in a hanging state.

5. The sheet processing machine according to claim 1, at least one of:

wherein at least one of the at least one inspection device (916) or the evaluation means is configured to ascertain a degree of wear of at least one tool of the at least one shaping device (900);

wherein the at least one of the at least one inspection device (916) or the evaluation means is configured to ascertain a degree of wear of at least one surface of at least one counterpressure cylinder (902) of the at least one shaping device (900); or wherein the at least one sheet (02) includes the at least two multiple-ups (1101) and the at least one inspection device (916) is configured to ascertain a degree of the position of the at least two multiple-ups (1101) relative to a reference of the position of the at least two multiple-ups (1101) and, one of additionally or alternatively, to ascertain a degree of a color of at least one print image of the at least one sheet (02) and, one of additionally or alternatively, to ascertain a degree of at least one defect in a processing of at least one of the at least one sheet (02) or a print image of the at least one sheet (02) due to at least one of missing portions or additional portions, from the comparison of the actual state of the at least one sheet (02) to the desired state of the at least one sheet (02).

6. The sheet processing machine according to claim 1, at least one of:

wherein the sheet processing machine (01) comprises at least one application mechanism (614) applying at least one print image onto the at least one sheet (02);

wherein the at least one inspection device (916) at least one of comprises the evaluation means or is connected to the evaluation means;

wherein at least one of the at least one inspection device (916) or the evaluation means is configured to evaluate at least one color register of the at least one print image of the at least one sheet (02); or wherein at least one of the at least one inspection device (916) or the evaluation means is at least configured to compare the at least one print image of the at least one sheet (02) to at least one of:

the at least one sheet opening (1102L) of the at least two sheet openings (1102L);

at least one inner contour of the at least one sheet (02); or at least one outer contour of the at least one sheet (02).

7. The sheet processing machine according to claim 2, at least one of:

wherein the at least one inspection device (916) at least one of comprises an evaluation means or is connected to the evaluation means, and the change of the transport path of the at least one sheet (02) is at least one of controlled by the at least one of the closed-loop control or the open-loop control, or is configured to be controllable by at least one of the closed-loop control or the open-loop control based on at least one signal of the evaluation means; or wherein the transport path provided for the transport of sheets (02) between the at least one inspection device (916) and the position of the change of the transport path of the at least one sheet (02) is at least 30 cm (thirty centimeters).

8. A method for inspecting at least one remaining portion of at least one sheet (02) of sheets (02) processed by a shaping device (900) in a sheet processing machine (01), the method comprising:

providing the at least one sheet (02) including at least two multiple-ups (1101) and at least two sheet openings (1102L), the at least one sheet (02) being processed in the at least one shaping device (900) of the sheet processing machine (01);

removing at least one offcut piece (1102A) from the at least one sheet (02) downstream from the shaping device (900) in a transport direction (T) of the sheets (02), the at least one offcut piece (1102A) being removed from the at least one sheet (02) by at least one separation device (903);

providing at least one inspection device (916) and using the at least one inspection device for ascertaining an actual state of the at least one sheet (02) downstream from the at least one separation device (903) in the transport direction (T), the actual state of the at least one sheet (02) being compared to a desired state of the at least one sheet (02);

arranging the at least one inspection device (916) upstream from at least one delivery unit (1000) and downstream from the at least one separation device (903) in the transport direction (T), the at least one inspection device (916) at least partially detecting at least one sheet opening (1102L) of the at least two sheet openings (1102L) of the at least one sheet (02) including the at least two multiple-ups (1101); and ascertaining a degree of a deviation of the at least one sheet opening (1102L) of the at least two sheet openings (1102L) from the desired state of the at least one sheet (02) using the comparison of the actual state of the at least one sheet (02) to the desired state of the at least one sheet (02).

9. A method for inspecting at least one sheet (02) of sheets (02) using at least one inspection device (916) in a sheet processing machine (01), the at least one inspection device (916) detecting the at least one sheet (02), including at least partially detecting at least one sheet opening (1102L), for ascertaining an actual state of the at least one sheet (02), and comparing the actual state of the at least one sheet (02) to a desired state of the at least one sheet (02), the at least one sheet (02) detected by the at least one inspection device (916) including at least two multiple-ups (1101) and the at least one sheet opening (1102L), and the at least one sheet (02) including the at least two multiple-ups (1101), each including at least one print image.

10. The method according to claim 9, including:

using the at least one inspection device (916) for at least partially detecting the at least one sheet opening (1102L) of the at least two sheet openings (1102L) of the at least one sheet (02), and at least one of at least one inner contour of the at least one sheet (02), defined by at least one sheet opening (1102L), or at least one outer contour of the at least one sheet (02), defined by at least one outer edge of the at least one sheet (02);

ascertaining a degree of a deviation of one of the at least one sheet opening (1102L) and the at least one of the at least one inner contour, or the at least one outer contour of the sheet (02) from the desired state of the at least one sheet (02) using the comparison of the actual state of the at least one sheet (02) to the desired state of the at least one sheet (02); and arranging the at least one inspection device (916) upstream from at least one delivery unit (1000) and downstream from at least one separation device (903) in the transport direction (T).

11. The method according to claim 8, further including at least one of:

providing the inner contour of the at least one sheet (02) corresponding to a contour of at least one offcut piece (1102A) of the at least one sheet (02); or controlling a change of a transport path, provided for the transport of sheets (02), of the at least one sheet (02) by at least one of open-loop or closed-loop control, downstream from the at least one inspection device (916) and upstream from the at least one delivery unit (1000) in the transport direction (T), as a function of the comparison of the actual state to the desired state of the at least one sheet (02).

12. The method according to claim 8, further including at least one of:

providing the at least two sheet openings (1102L) corresponding to at least portions of offcut pieces (1102A) removed from the at least one sheet (02);

generating the at least two sheet openings (1102L) by removing at least the portions of the offcut pieces (1102A) from the at least one sheet (02);

determining the desired state of the at least one sheet (02) based on at least one of a digital or a taught-in reference;

wherein the actual state of the at least one sheet (02) is the state that the at least one sheet (02) has at the time of being detected by the at least one inspection device (916)

wherein the desired state of the at least one sheet (02) is the state that the at least one sheet (02) at least one of is to have or that is predefined for the at least one sheet (02) by at least one of a reference sheet or a sample sheet;

wherein the at least one sheet (02) is made of at least one of paper or cardboard or paperboard;

wherein the at least one sheet (02) is configured as corrugated cardboard (02);

wherein at least one of a desired or a required end product, which was generated by one of the at least two multiple-ups (1101) or which was generated by further processing of the at least two multiple-ups (1101), is one of a folder-type box, a telescope-type box, a slide-type box, or a rigid-type box; or wherein the at least one sheet (02) is processed in the at least one shaping device (900) of the sheet processing machine (01), and that at least one print image is applied onto the at least one sheet (02) by at least one application mechanism (614) of the sheet processing machine (01) upstream from the shaping device (900) in the transport direction (T).

13. The method according to claim 8, further including at least one of:

wherein the at least one inspection device (916) at least partially detects at least one of a contour, a shape, a mass, or a surface area of the at least one sheet opening (1102L) of the at least two sheet openings (1102L), wherein the at least one of the contour, the shape, the mass, or the surface area of the at least one sheet opening (1102L) corresponds to at least one of a contour, a shape, a mass, or a surface area of the at least one offcut piece (1102A) removed from the at least one sheet (02);

wherein the at least one inspection device (916) is arranged orthogonally to a transport path of the at least one sheet (02) provided for the transport of sheets (02), and is directed at the transport path of the at least one sheet (02), and wherein the at least one sheet (02) is transported in a hanging state in the transport direction (T), and that the at least one inspection device (916) is arranged beneath the transport path of the at least one sheet (02) provided for the transport of sheets (02), and is directed at the transport path;

wherein the at least one inspection device (916) comprises at least one of at least one optical image acquisition device or at least one camera;

wherein the at least one inspection device (916) detects the at least one sheet (02) passing the at least one inspection device (916) on a transport path in the transport direction (T); or wherein the at least one inspection device (916) stores and evaluates data about the at least one sheet (02) and respective further transported sheets (02) of the sheets (02), and creates at least one report about a quality of the sheets (02).

14. The method according to claim 11, further including at least one of:

wherein the at least one inspection device (916) at least one of comprises an evaluation means or is connected to an evaluation means, and the change of the transport path of the at least one sheet (02) is controlled by the at least one of the closed-loop control or the open-loop control based on at least one signal of the evaluation means; or wherein a response time from a beginning of the ascertaining of the actual state of the at least one sheet (02) to the closed-loop control and to the open-loop control of the change of the transport path for deflecting the at least one sheet (02) is at least 50 ms (fifty milliseconds).

15. The method according to claim 8, further including at least one of:

wherein the at least one inspection device (916) comprises an evaluation means and is connected to an evaluation means, wherein the at least one sheet (02) includes at least one print image, and wherein the one of the at least one inspection device (916) and the evaluation means evaluates at least one color register of the at least one print image of the at least one sheet (02) and compares the at least one print image of the at least one sheet (02) to at least one of the at least one sheet opening (1102L), at least one inner contour, or at least one outer contour of the at least one sheet (02);

wherein at least one of the at least one inspection device (916) or the evaluation means at least one of detects and evaluates the position of the at least one multiple-up (1101) of the at least two multiple-ups (1101) relative to a reference of the position of the at least one multiple-up (1101);

wherein the at least one of the at least one inspection device (916) and the evaluation means at least one of detects or evaluates the at least one color of at least one print image of the at least one sheet (02);

wherein the at least one of the at least one inspection device (916) and the evaluation means at least one of detects or evaluates at least one of (i) at least one defect in a processing of the at least one sheet (02) or (ii) at least one defect of the at least one print image due to at least one of missing portions or additional portions;

wherein a degree of wear of at least one tool of the at least one shaping device (900) of the sheet processing machine (01) is ascertained from the comparison of the actual state of the at least one sheet (02) to the desired state of the at least one sheet (02);

wherein a degree of wear of at least one surface of at least one counterpressure cylinder (902) of the at least one shaping device (900) of the sheet processing machine (01) is ascertained from the comparison of the actual state of the at least one sheet (02) to the desired state of the at least one sheet (02); or wherein a degree of the position of at least one multiple-up (1101) of the at least two multiple-ups (1101) relative to a reference of the position of the at least one multiple-up (1101) and, one of additionally and alternatively, a degree of a color of at least one print image of the at least one sheet (02) and, one of additionally and alternatively, a degree of one of at least one defect in a processing of the at least one sheet (02) and of the at least one print image of the at least one sheet (02) due to at least one of missing portions or additional portions is ascertained from the comparison of the actual state of the at least one sheet (02) to the desired state of the at least one sheet (02).

16. The method according to claim 8, further including the at least one sheet (02) having the at least two multiple-ups (1101), each of the at least two multiple-ups (1101) including at least one print image.

17. The method according to claim 9, further including each of the at least two multiple-ups (1101) of the at least one sheet (02) having at least one identical print image as the at least one print image.

18. The method according to claim 8, characterized in that the at least one inspection device (916) is arranged immediately following the separation device (903) in the transport direction (T).

19. The sheet processing machine according to claim 1, wherein, after having been processed by the at least one separation device (903), the at least one sheet (02) comprises the at least two multiple-ups (1101), which are separably connected to each other to facilitate separation of the at least two multiple-ups (1101) from each other.

20. The sheet processing machine according to claim 1, at least one of:

wherein the at least one inspection device (916) at least one of is configured to detect or detects at least a portion of a boundary line of the at least one sheet (02) around at least one sheet opening (1102L) of the at least two sheet openings (1102L); or wherein the at least one inspection device (916) is at least one of configured to detect or detects at least one of an inner boundary line or outer boundary line of the at least two multiple-ups (1101).

21. The sheet processing machine according to claim 1, at least one of:

wherein each of the at least two multiple-ups (1101) on an individual sheet (02) of the at least one sheet (02) includes at least one print image that is identical; or wherein at least one sheet opening (1102L) of the at least two sheet openings (1102L) is situated within at least one multiple-up (1101) of the at least two multiple-ups (1101) on the individual sheet (02).

22. The sheet processing machine according to claim 1, wherein the at least one separation device (903) includes at least one transport means configured as a separation transport means (904) for transporting sheets (02), wherein the at least one separation transport means (904) comprises at least one transport drive (912), by means of which at least one component of the at least one separation transport means (904) is able to be driven so as to revolve in at least one respective local transfer direction, wherein the at least one transport drive (912) of the at least one separation transport means (904) is connected to at least one of a machine controller of the processing machine (01) or an electronic master axis.

23. The method according to claim 8, wherein, after having been processed by the at least one separation device (903), the at least one sheet (02) comprises the at least two multiple-ups (1101), which are separably connected to each other to facilitate separation of the at least two multiple-ups (1101) from each other.

24. The method according to claim 8, at least one of:

detecting, by the at least one inspection device (916), at least a portion of a boundary line of the at least one sheet (02) around at least one sheet opening (1102L) of the at least two sheet openings (1102L); or detecting, by the at least one inspection device (916), at least one of an inner boundary line or outer boundary line of the at least two multiple-ups (1101).

25. The method according to claim 8, at least one of:

wherein each of the at least two multiple-ups (1101) on an individual sheet (02) of the at least one sheet (02) includes at least one print image that is identical; or wherein at least one sheet opening (1102L) of the at least two sheet openings (1102L) is situated within at least one multiple-up (1101) of the at least two multiple-ups (1101) on the individual sheet (02).

26. The method according to claim 8, wherein the at least one separation device (903) includes at least one transport means configured as a separation transport means (904) for transporting sheets (02), wherein the at least one separation transport means (904) comprises at least one transport drive (912), the method further comprising:

driving, by the at least one transport drive (912), at least one component of the at least one separation transport means (904) so as to revolve in at least one respective local transfer direction, wherein the at least one transport drive (912) of the at least one separation transport means (904) is connected to at least one of a machine controller of the processing machine (01) or an electronic master axis.

* * * * *